US012037899B2

(12) United States Patent
Swan

(10) Patent No.: US 12,037,899 B2
(45) Date of Patent: Jul. 16, 2024

(54) AUTOMATED INITIAL SHUT-IN PRESSURE ESTIMATION

(71) Applicant: CONOCOPHILLIPS COMPANY, Houston, TX (US)

(72) Inventor: Herbert W. Swan, Houston, TX (US)

(73) Assignee: CONOCOPHILLIPS COMPANY, 925 N. Eldridge Parkway, Houston, TX (US)

( * ) Notice: Subject to any disclaimer, the term of this patent is extended or adjusted under 35 U.S.C. 154(b) by 0 days.

(21) Appl. No.: 17/669,155

(22) Filed: Feb. 10, 2022

(65) Prior Publication Data

US 2022/0307371 A1 Sep. 29, 2022

Related U.S. Application Data

(60) Provisional application No. 63/148,069, filed on Feb. 10, 2021.

(51) Int. Cl.

| | |
|---|---|
| ***E21B 43/26*** | (2006.01) |
| ***E21B 47/06*** | (2012.01) |
| ***E21B 49/00*** | (2006.01) |

(52) U.S. Cl.

CPC ..... *E21B 49/008* (2013.01); *E21B 43/26* (2013.01); *E21B 47/06* (2013.01); *E21B 2200/20* (2020.05)

(58) Field of Classification Search

CPC .... E21B 49/008; E21B 43/26; E21B 43/2605; E21B 43/2607; E21B 43/27; E21B 47/06

See application file for complete search history.

(56) References Cited

U.S. PATENT DOCUMENTS

| | | | | |
|---|---|---|---|---|
| 9,988,895 | B2 | 6/2018 | Roussel et al. | |
| 10,753,181 | B2 * | 8/2020 | Roussel | E21B 43/26 |
| 10,801,307 | B2 | 10/2020 | Roussel et al. | |
| 2016/0115780 | A1 | 4/2016 | James et al. | |
| 2018/0135395 | A1 | 5/2018 | Santarelli | |
| 2019/0120047 | A1 | 4/2019 | Jin et al. | |
| 2019/0129047 | A1 * | 5/2019 | Clark | E21B 47/095 |
| 2019/0346579 | A1 | 11/2019 | Roussel et al. | |
| 2020/0003037 | A1 | 1/2020 | Roussel | |
| 2020/0072997 | A1 | 3/2020 | Felkl et al. | |

(Continued)

FOREIGN PATENT DOCUMENTS

| | | |
|---|---|---|
| WO | 20190217480 | 11/2019 |
| WO | 2020016559 A1 | 1/2020 |

OTHER PUBLICATIONS

Raterman, K., et al "Analysis of a Drained Rock Volume: an Eagle Ford Example." 2019, URTeC 2019-263, Unconventional Resources Technology Conference, Jul. 31, 2019, Denver, CO; 20 pgs.

(Continued)

*Primary Examiner* — Catherine Loikith

(74) *Attorney, Agent, or Firm* — CONOCOPHILLIPS COMPANY

(57) ABSTRACT

Water hammer is oscillatory pressure behavior in a wellbore resulting from the inertial effect of flowing fluid being subjected to an abrupt change in velocity. It is commonly observed at the end of large-scale hydraulic fracturing treatments after fluid injection is rapidly terminated. Factors affecting treatment-related water hammer behavior including field studies correlating water hammer characteristics to fracture intensity and well productivity.

9 Claims, 46 Drawing Sheets

End of Stage Pressure = $P = e^{-yt} M \cos[\varpi t - \theta]$ + $P = be^{-at} + c$

(56) References Cited

U.S. PATENT DOCUMENTS

2020/0308958 A1 10/2020 Kabannik

OTHER PUBLICATIONS

Roussel, Nicolas—"Analyzing ISIP Stage-by-Stage Escalation to Determine Fracture Height and Horizontal-Stress Anisotropy", 2017, SPE-184865-MS; 30 pgs.
Zhang, J., et al—"Investigating Near-Wellbore Diversion Methods for Refracturing Horizontal Wells", 2020, Society of Petroleum Engineers, SPE Production & Operations; 16 pgs.
International Search Report for PCT/US2022/016010 mailed Apr. 28, 2022; 2 pgs.
Carey, et al—"Analysis of Water Hammer Signatures for Fracture Diagnostics", 2015, SPE-174866-MS, Annual Technical Conference and Exhibition, Sep. 28-39, 2015, Houston, TX; 25 pgs.
Ma, X., et al—"Evaluaton of Water Hammer Analysis as Diagnostic Tool for Hydraulic Fracturing", 2019, URTeC-2019-935, Unconventional Resources Technology Conference, Jul. 22-24, 2019, Denver, CO.; 20 pgs.
Sneddon, I.N—"The Distribution of Stress in the Neighborhood of a Crack in an Elastic Solid", 1946, Proc. R. Soc. Lond. A187 (1009): 229-260; 32 pgs.
Paige, R.W., et al—"Field Application of Hydraulic Impedance Testing for Fracture Measurement", 1995, SPE 26525-PA, SPE Production and Facilities, vol. 10, Issue No. 1, pp. 7-12; 6 pgs.
Holzhausen, G.R., et al—"Impedance of Hydraulic Fractures: Its Measurement and Use for Estimating Fracture Closure Pressure and Dimensions", 1985, SPE-13892-MS, Low Permeability Gas Reservoirs, May 19-22, 1985, Denver, CO; 12 pgs.
Paige, R.W., et al—"Fracture Measurment using Hydraulic Impedance Testing", 1992, SPE 24824MS, Annual Technical Conference and Exhibition, Oct. 4-7, 1992, Washington, DC; 10 pgs.
Nguyen, Dung, et al—"Practical Applications of Water Hammer Analysis from Hydraulic Fracturing Treatments", 2021, SPE 204154-MS, SPE Hydraulic Fracturing Technology Conference, 47 pgs.
Dunham, E. M., et al—"Hydraulic Fracture Conductivity Inferred from Tube Wave Reflections", 2017, SEG-2017-17664595, SEG International Exposition and Annual Meeting, Sep. 24-29, 2017, Houston, TX; 6 pgs.
Liang, C., et al—"Hydraulic fracture diagnostics from Krauklis-wave resonance and tube-wave reflections", 2017, Geophysics, vol. 82, Issue No. 3, pp. D171-D186; 16 pgs.
Bakku, et al—"Fracture compliance estimating using borehole tube waves", 2013, Geophysics, vol. 78, Issue No. 4, D249-D260; 12 pgs.
Cramer, D. D., et al—"Pump-Down Diagnostics for Plug-and-Perf Treatments", 2020, SPE-201376-MS, SPE Virtual Annual Technical Conference and Exhibition, Oct. 27-29, 2020; 15 pgs.
Alwarda, et al—"Automated Procedure for Quantifying ISIP and Friction Losses from Stage by Stage Hydraulic Fracture Treatment Falloff Data", 2020, SPE 201488 MS; 10 pgs.
Carey, M.A., et al—"Correlating Water Hammer Signatures with Production Log and Microseismic Data in Fractured Horizontal Wells", 2016, SPE-179108-MS, Hydraulic Fracturing Technology Conference and Exhibition, Feb. 9-11, 2016, the Woodlands, TX; 15 pgs.
Ciezobka, J., et al—"Variable Pump Rate Fracturing Leads to Improved Prodcution in the Marcellus Shale", 2016, SPE-179107-MS, Hydraulic Fracturing Technology Conference and Exhibition, Feb. 9-11, 2016, the Woodlands, TX; 11 pgs.
Clark, C.J., et al—"Diagnostic application of Borehole Hydraulic Signal Processing", 2018, URTeC-2902141, Unconventional Resources Technology Conference, Jul. 23-25, 2018, Houston, TX; 18 pgs.
Holzhausen, G.R., et al—"Fracture Diagnostics in East Texas and Western Colorado Using the Hydraulic-Impedance Method", 1986, SPE 15215-MS, Unconventional Gas Technology Symposium, May 18-21 Louisville, KY USA; 12 pgs.
Hwang, J., et al—"Hydraulic Fracture Diagnostics and Stress Interference Analysis by Water Hammer Signatures in Multi-stage Pumping Data", 2017, URTeC 2687423, Unconventional Resources Technology Conference, Jul. 24-26, 2017, Austin, TX; 12 pgs.
Iriarte, J., et al—"Using Water Hammer Characteristics as a Fracture Treatment Diagnostic", 2017, SPE 185087-MS, Oklahoma City Oil and Gas Symposium, Mar. 27-30, 2017; 14 pgs.
Mondal, S.—"Pressure Transients in Wellbores: Water Hammer Effects and Implications", 2010, PhD Dissertation, the University of Texas at Austin; 71 pgs.
Holzhausen, G., et al—"Fracture Closure Pressures from Free-Oscillation Measurements During Stress Testing in Complex Reservoirs", 1989, Int. J. Rock Mech. Min. Sci. & Geomech, vol. 26, Issue No. 6, pp. 533-540; 8 pgs.

* cited by examiner

| | Crosslinked Gel | Slickwater |
|---|---|---|
| Count | 2,578 Stages | 1,125 Stages |
| Median | 4.00 | 4.50 |
| Avg | 4.15 | 4.70 |
| Outliers | 41 | 2 |

A

B

A

B

AUTOMATED INITIAL SHUT-IN PRESSURE ESTIMATION

CROSS-REFERENCE TO RELATED APPLICATIONS

This application is a non-provisional application which claims benefit under 35 USC § 119(e) to U.S. Provisional Application Ser. No. 63/148,069 filed Feb. 10, 2021, entitled "AUTOMATED INITIAL SHUT-IN PRESSURE ESTIMATION," which is incorporated herein in its entirety.

STATEMENT REGARDING FEDERALLY SPONSORED RESEARCH

None.

FIELD OF THE INVENTION

The present invention relates generally to estimating the initial shut-in pressure (ISIP) immediately after a hydraulic fracturing. More particularly, but not by way of limitation, embodiments of the present invention include a robust, stable and objective method to estimate the ISIP, without manual intervention. An added side benefit is that the invention also estimates the initial rate of pressure decay after shut-in, as well as the final shut-in pressure (FSIP).

BACKGROUND OF THE INVENTION

ISIP Analysis is an analytical method that calculates the hydraulic height of induced fractures and the in-situ horizontal stress anisotropy from the evolution of instantaneous shut-in pressures during a multi-stage horizontal completion. The fracture height calculated will be smaller than what is measured through microseismic measurement, but larger than the propped and effective fracture height. The horizontal stress anisotropy is the difference between maximum and minimum horizontal stress. While it is generally unknown as a result of a lack of available methods, it plays a key role in the ability to stimulate natural fractures and generate complexity. Operationally, it may impact the spacing of perforations clusters, the sequencing of multi-well fracturing operations, as well as the timing and design of infill and refracturing operations.

Because every frac stage will contribute to reduce the formation's horizontal stress anisotropy, ISIP Analysis may be a useful tool to guide the spacing design of perforation clusters. The method was also extended to be able to calculate the hydraulic length of induced fractures, as well as the hydraulic area stimulated by each frac stage. As a result, ISIP analysis may be a useful addition to any workflow looking to optimize well spacing and stacking in unconventional plays.

While other techniques such as microseismic monitoring, tracers, downhole tiltmeters, pressure gauges, may be utilized to characterize fracture dimensions, the main advantage of ISIP Analysis is the ability to be applied to almost every single well, without the need for additional hardware, measurement time, or any modification to the well or completion design. It only uses data that is systematically reported after every plug & perf multi-stage completion. ISIP Analysis has been implemented into many workflows that may be easily adopted by completion engineers, and only takes a few minutes to complete.

The use of water hammer signatures as a cost-effective, scalable diagnostic solution to characterize aspects of hydraulically induced fractures has been of great interest to the industry and academic communities. The properties of the signal can indicate the quality of the connection between the wellbore, the fracture network, and the reservoir.

Holzhausen and Gooch (1985) first introduced the idea of using water-hammer signatures for fracture diagnostics, under the term impedance analysis. The method, referred to in later publications as Hydraulic Impedance Testing or HIT, relies on a lumped resistance-capacitance model to evaluate hydraulic fracture dimensions from changes in downhole impedance at the well-fracture interface. The model is analogous to an electrical circuit, where resistance (R) and capacitance (C) elements are combined in series, and fracture impedance is expressed as a function of flow resistance and fluid storage. An additional inertance term (I), describing the difference in flow potential required to cause a unit change in the rate of change of volumetric flow rate with time, was later added to the model formulation (Paige, 1992).

The technique was evaluated experimentally by Paige et al. (1995) and performed in water injection wells and mini-fracs (Holzhausen and Egan, 1986), where the interpreted fracture dimensions were compared to traditional well tests and reservoir simulations. Fracture length is calculated assuming the pulse transmitted into the fracture is reflected at the tip and by estimating excess travel time beyond the perforations. Wave speed is significantly lower in the fracture compared to the wellbore because of increased compliance, impacting travel time in the fracture. Fracture dimensions (width, height, and length) are interrelated through fracture compliance, which can be expressed analytically (Sneddon, 1946) for a semi-infinite fracture ($Lf \gg hf$).

While early efforts were directed primarily toward fractured vertical wells, recent studies assessed the applicability of the HIT methodology to characterize hydraulic fractures in modern horizontal well completions. Mondal (2010) modeled the presence of multiple hydraulic fractures connected to the wellbore in any given fracturing stage by multiple capacitance elements in parallel, and solved water-hammer equations numerically using the explicit method of characteristics (MOC). By lumping the effect of multiple fractures into a single equivalent fracture, Carey et al. (2015) was able to characterize the average dimensions of the individual fractures in various field examples. Carey et al. (2016) also highlighted the impact of R, C, I values on the simulated water-hammer signatures. and correlated them with microseismic surveys and production logs. Hwang et al. (2017) further extended the method to multi-stage hydraulic fracture treatments by accounting for mechanical stress interference in successive treatment stages.

Ma et al. (2019) proposed a new analytical formulation of water hammer pressure oscillation including pressure-dependent leak-off and perforation friction to determine fracture growth and near wellbore tortuosity. The boundary condition was derived through a fracture entry friction equation instead of using an electrical-circuit analogous system.

Another approach consists of recording reflected low-frequency tube waves generated at the wellhead and analyzing their interaction with fractures intersecting a wellbore in the frequency domain (Dunham et al. 2017; Liang et al. 2017). By quantifying amplitude ratios and tube-wave attenuation over a range of frequencies, Bakku et al. (2013) were able to estimate the compliance, aperture, and lateral extent of a fluid-filled fracture intersecting a wellbore. Dunham et al. (2017) applied the concept of fracture impedance to estimate created hydraulic fracture conductivity. Following a similar methodology, Clark et al. (2018) focused on the frequency characteristics of hydraulic impulse events.

While many of the proposed models have been successful in recreating and matching water hammer signatures, it appears the optimization problem is ill-constrained, leading to non-unique solutions. The number of physical relationships is insufficient to resolve the variables of interest, such as fracture length, height, and width. The range of fracture geometry predictions for a particular stage is often shown to be broad despite matching the water hammer waveform. While the analysis of water hammer signatures is unlikely by itself to resolve the fracture geometry, combining it with various other analyses of pressure signatures in treatment well data (e.g., ISIP, net pressure) could provide additional constraints and help narrow down the range of solutions.

BRIEF SUMMARY OF THE DISCLOSURE

The invention more particularly includes a pragmatic approach, setting bounds on what can and cannot be accomplished by analyzing water hammer oscillations. An efficient workflow is presented for providing consistent and reliable insight on reservoir characteristics and treatment effectiveness by analyzing pressure behavior at the end of treatments, using commonly available data.

In one embodiment, a method for fracturing a hydrocarbon well is provided comprising installing a wellbore in a hydrocarbon reservoir; sealing the wellbore; fracturing the wellbore by increasing pump pressure; shutting off the pump pressure; and performing a water hammer sensitivity analysis with identification of the shut-in period; identification of water hammer peaks and troughs; calculation of water hammer period and the number of periods; and calculation of water hammer decay rate. In some instances, the final pressure step-down may be 25 bbl/min or greater. The water hammer sensitivity analysis may be used to measure perforation friction, treatment stage isolation, boundary conditions, and/or casing failure depth. The water hammer analysis may be compared to a database of water hammer signatures to estimate well parameters such as near-wellbore fracture surface area, fracture quality, and/or well productivity.

In another embodiment, a method for fracturing a hydrocarbon well is provided comprising sealing a hydrocarbon wellbore; fracturing the wellbore by increasing pump pressure; shutting off the pump pressure; identification of the shut-in period; identification of water hammer peaks and troughs; calculation of water hammer period and the number of periods; and calculation of water hammer decay rate; and calculating the instantaneous shut-in pressure (ISIP); and identifying one or more fracturing patterns from ISIP signature. The fracturing pattern may be indicative of a successful fracture, an unseated ball, or a leak in the wellbore. The ISIP signature may be calculated via a Linear Method, Quadratic Method, or Signal processing. The ISIP signature may also be used to characterize the in-situ stress regime, assess net fracturing pressure, characterize fracture dimensions or a combination thereof. The ISIP signature may used to improve fracture parameters for subsequent fractures, adjust fracturing pressure, time, viscosity, proppant, pressure step-down, valve closure, and the like.

| Abbreviation | Term |
|---|---|
| bpm | barrel per minute; bbl/min |
| CSV | comma separate values |
| FDI | fracture driven interactions |
| ISIP | instantaneous shut-in pressure |
| TVD | true vertical depth |

BRIEF DESCRIPTION OF THE DRAWINGS

The patent or application file contains at least one drawing executed in color. Copies of this patent or patent application publication with color drawing(s) will be provided by the Office upon request and payment of the necessary fee. A more complete understanding of the present invention and benefits thereof may be acquired by referring to the follow description taken in conjunction with the accompanying drawings.

closed inlet, closed outlet.

Figure 9:
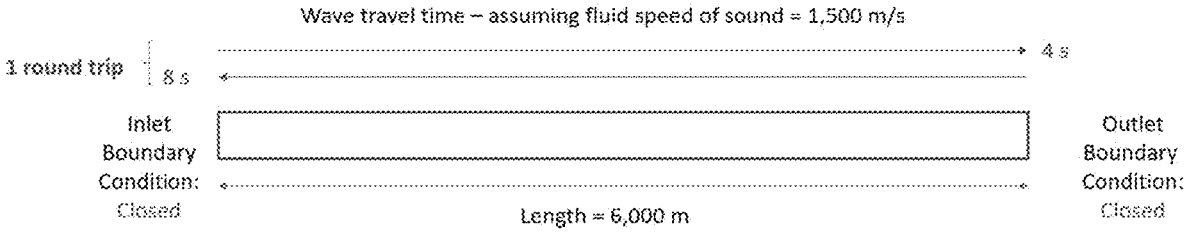

FIG. 9 provides a schematic of wave travel time for one water hammer cycle (period): closed inlet, closed outlet.

Figure 10:
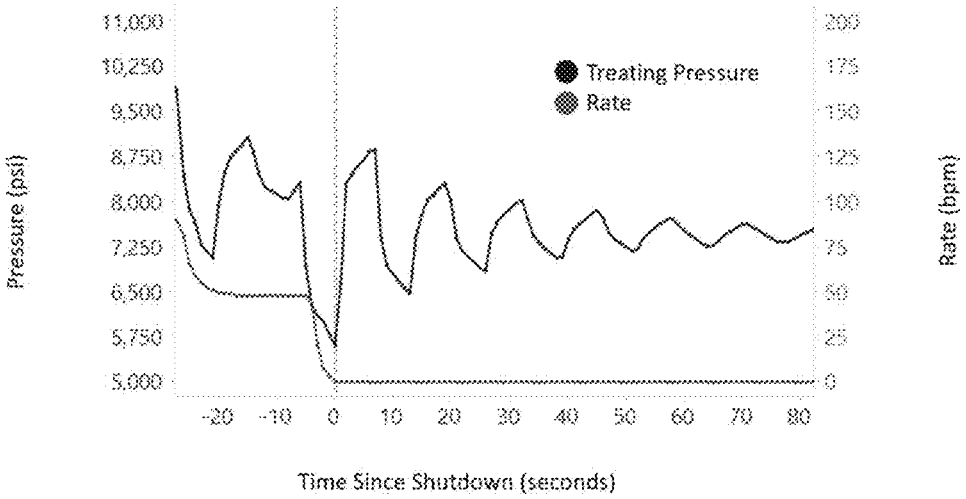

FIG. 10 shows a water hammer example.

Figure 11:
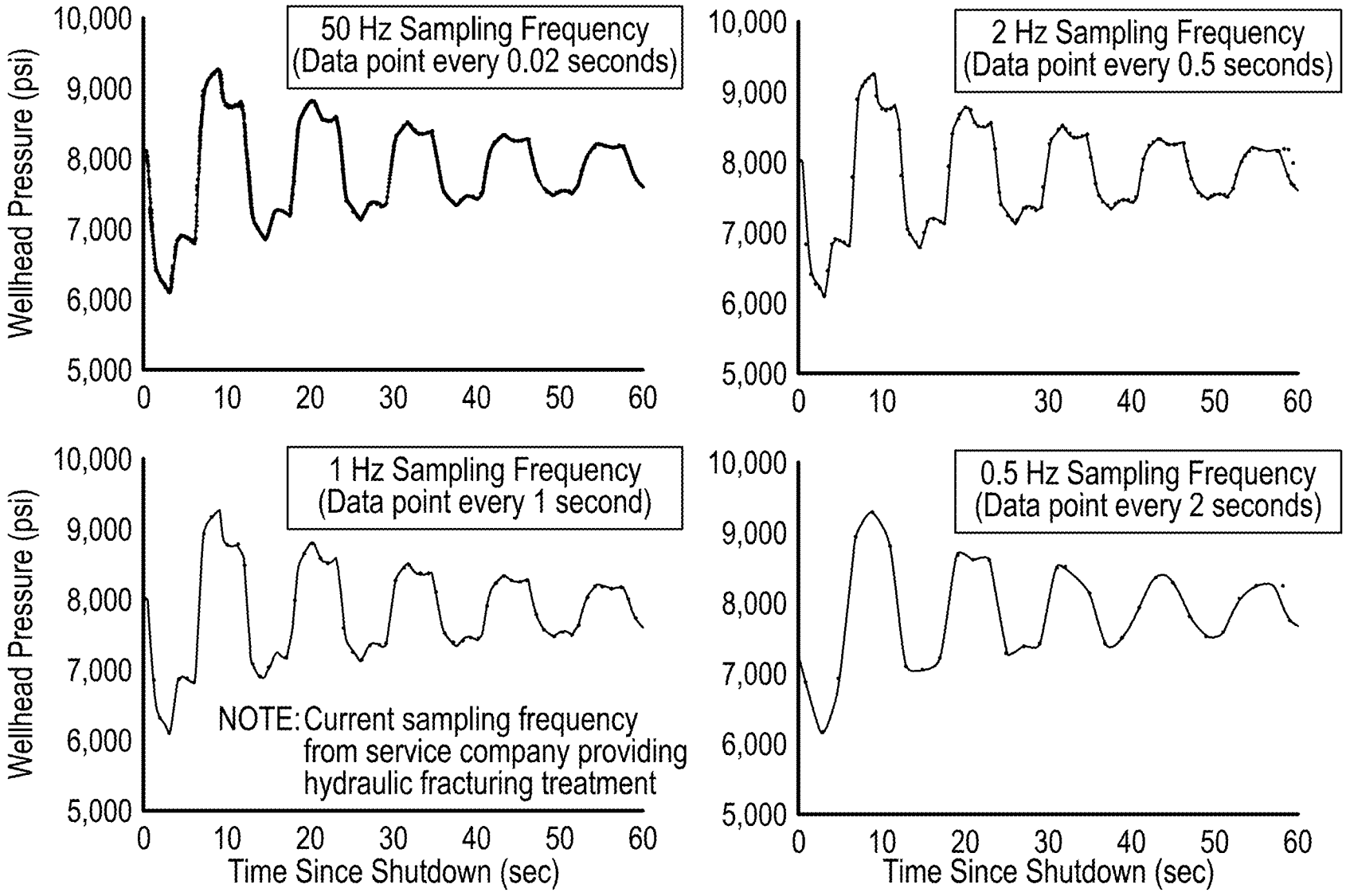

FIG. 11 compares water hammer data at various sampling frequencies (50, 2, 1, 0.5 Hz).

Figure 12:
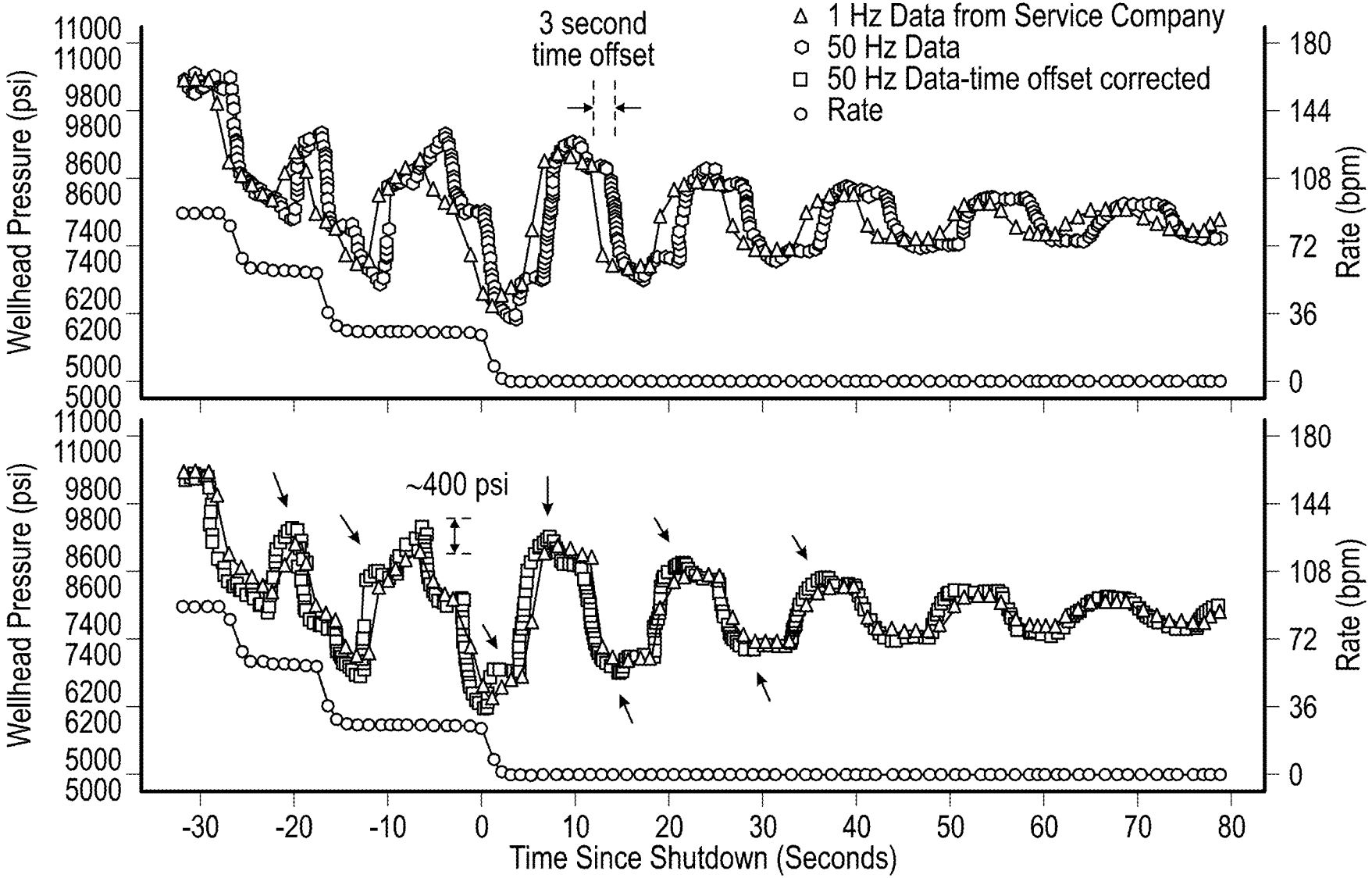

FIG. 12 is a comparison of high frequency versus one-hertz service company data.

Figure 13:
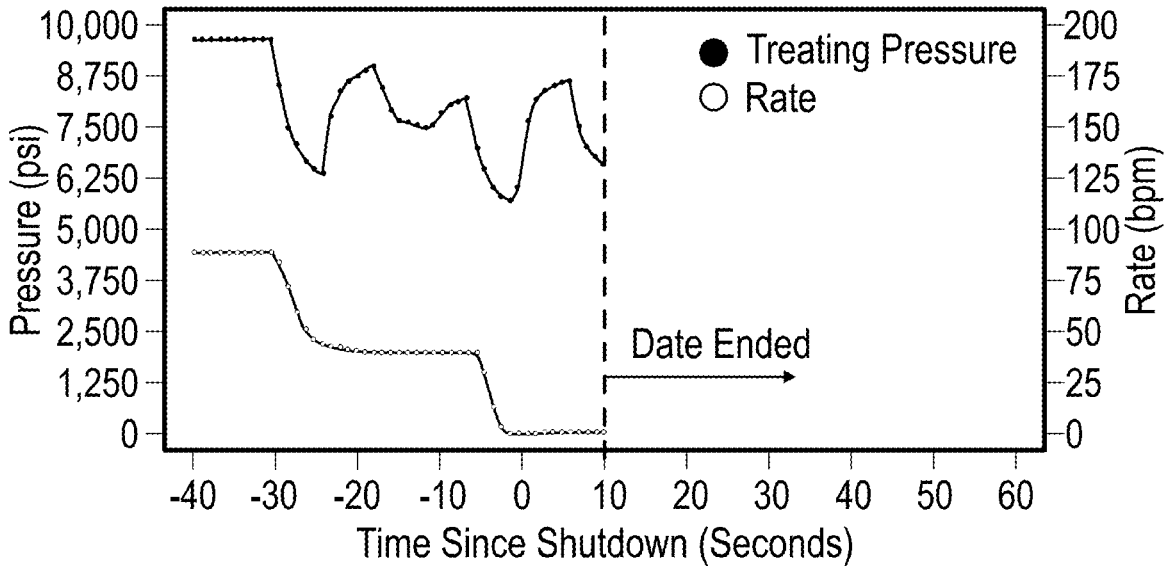

FIG. 13 shows that provided data stops before water hammer ends.

Figure 14:
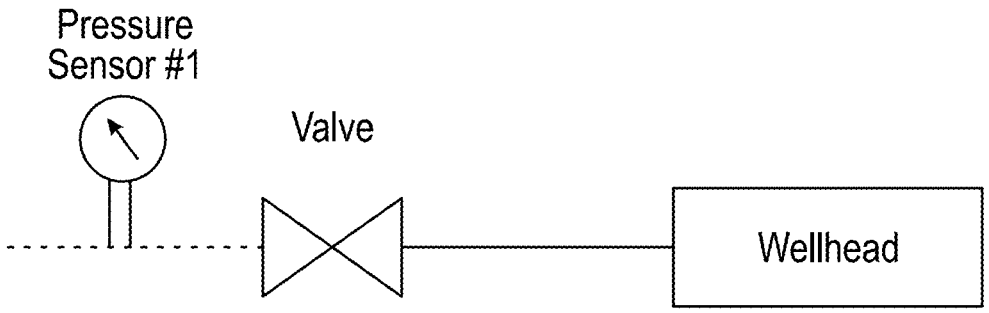

FIG. 14 illustrates the configuration of Pressure Transducer, Valve and Wellhead.

Figure 15:
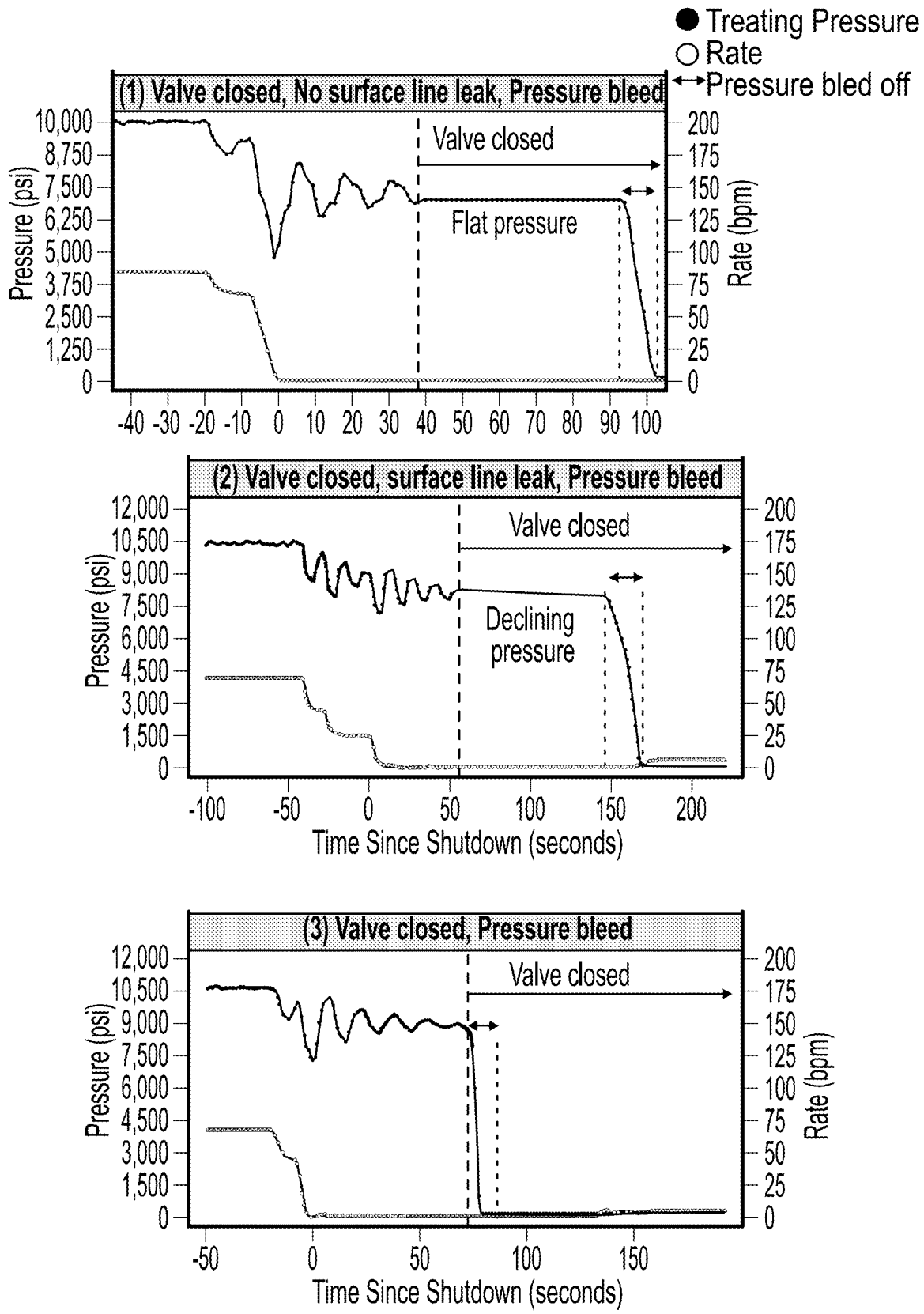

FIG. 15 demonstrates the incorrect representation of wellhead pressure with the valve closed.

Figure 16:
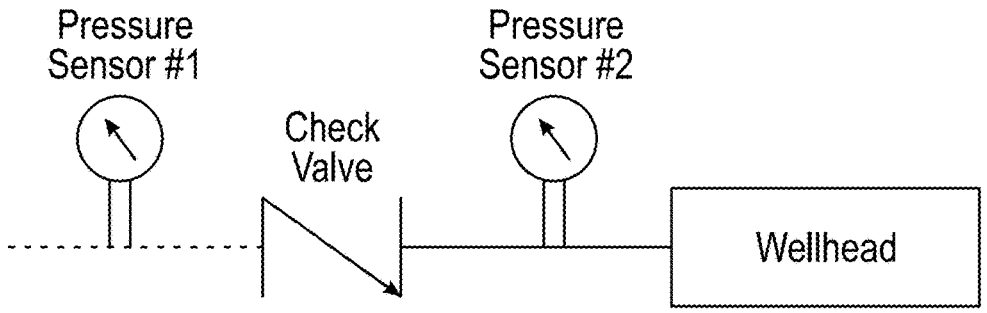

FIG. 16 illustrates the configuration of a pressure transducer, check valve and wellhead.

Figure 17:
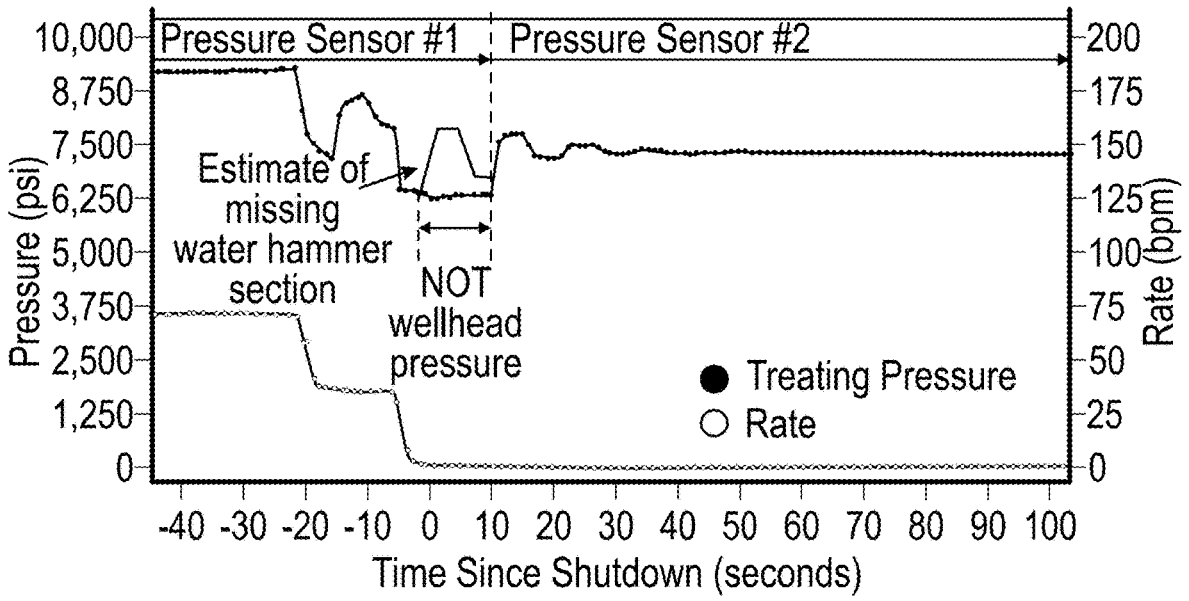

FIG. 17 demonstrates selection of an incorrect transducer.

Figure 18:
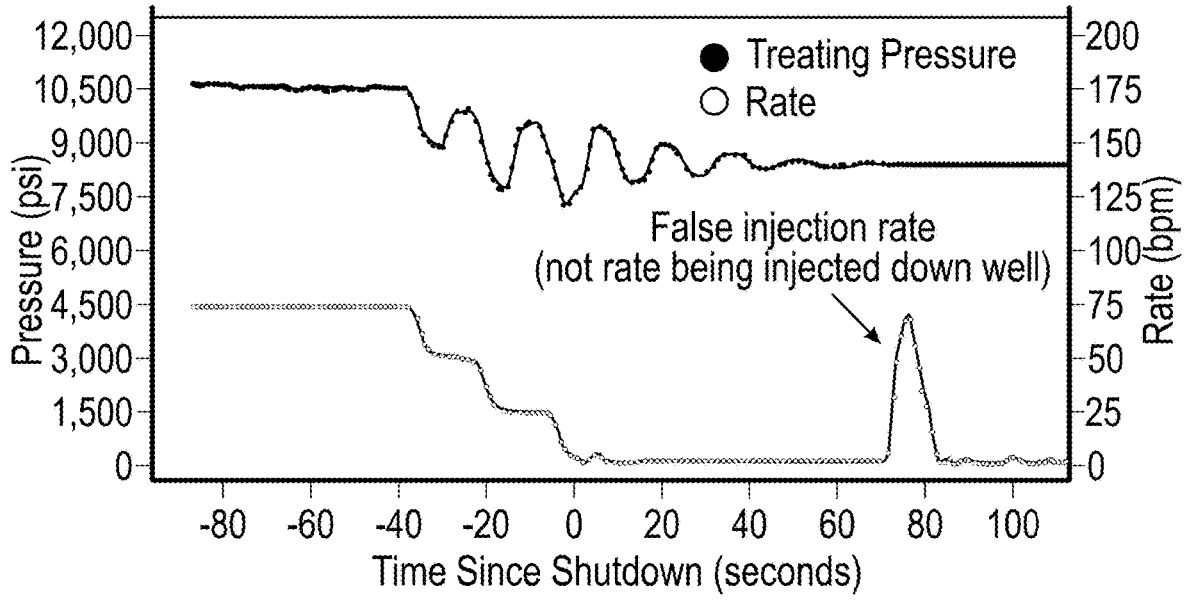

FIG. 18 demonstrates a false injection rate.

Figure 19:
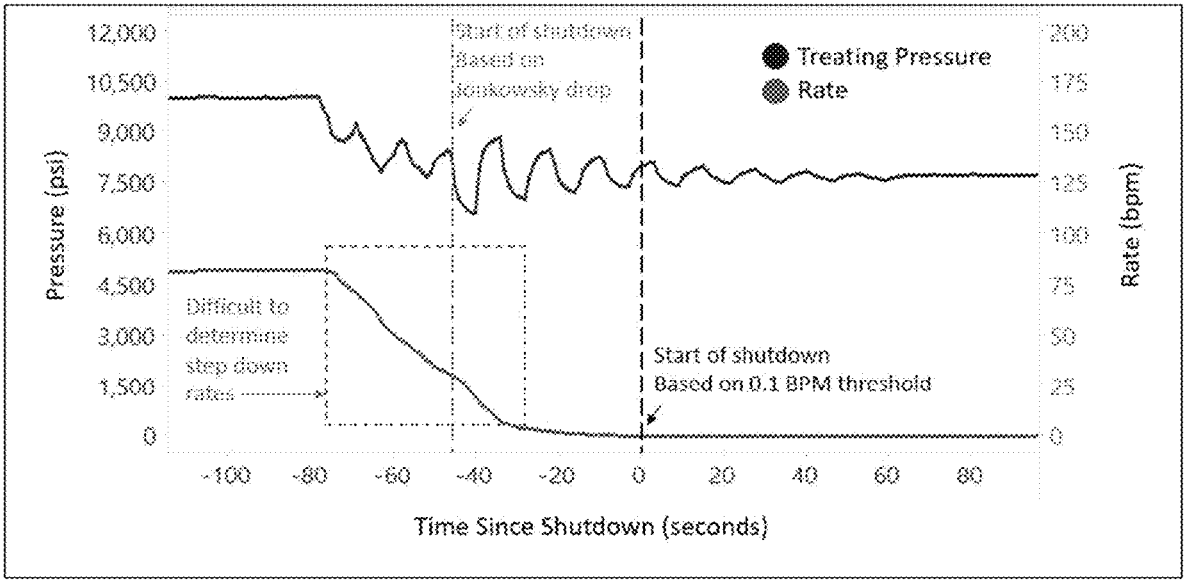

FIG. 19 demonstrates a smoothed injection rate.

Figure 20:
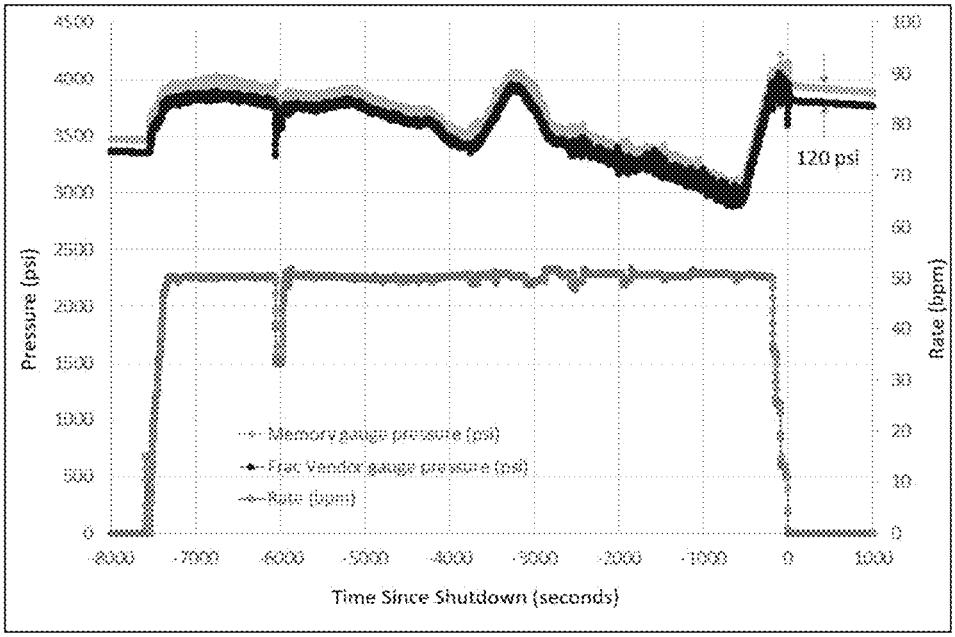

FIG. 20 compares memory gauge versus service company gauge data.

Figure 21:
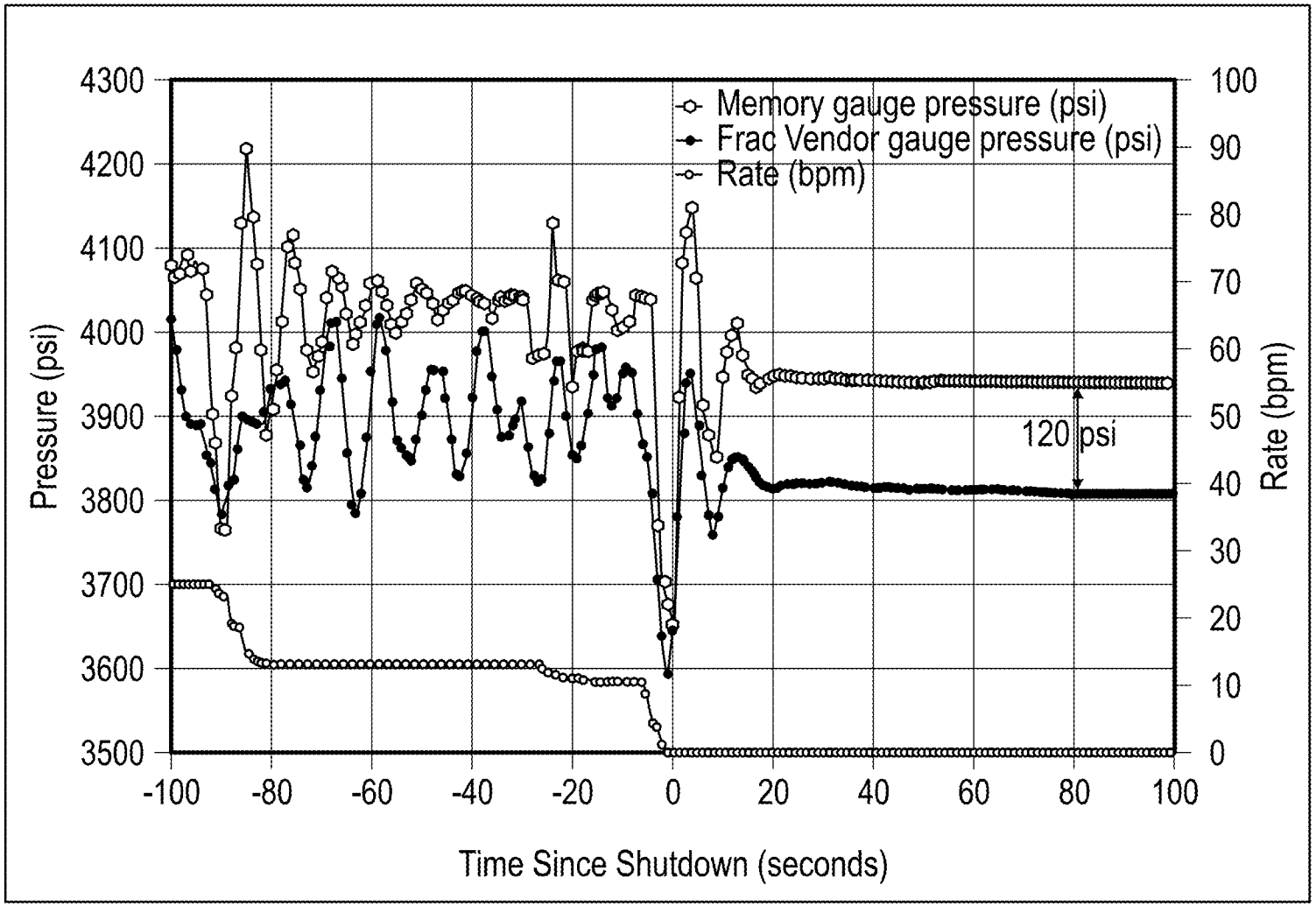

FIG. 21 compares an expanded subset of memory gauge versus service company gauge data.

Figure 22:
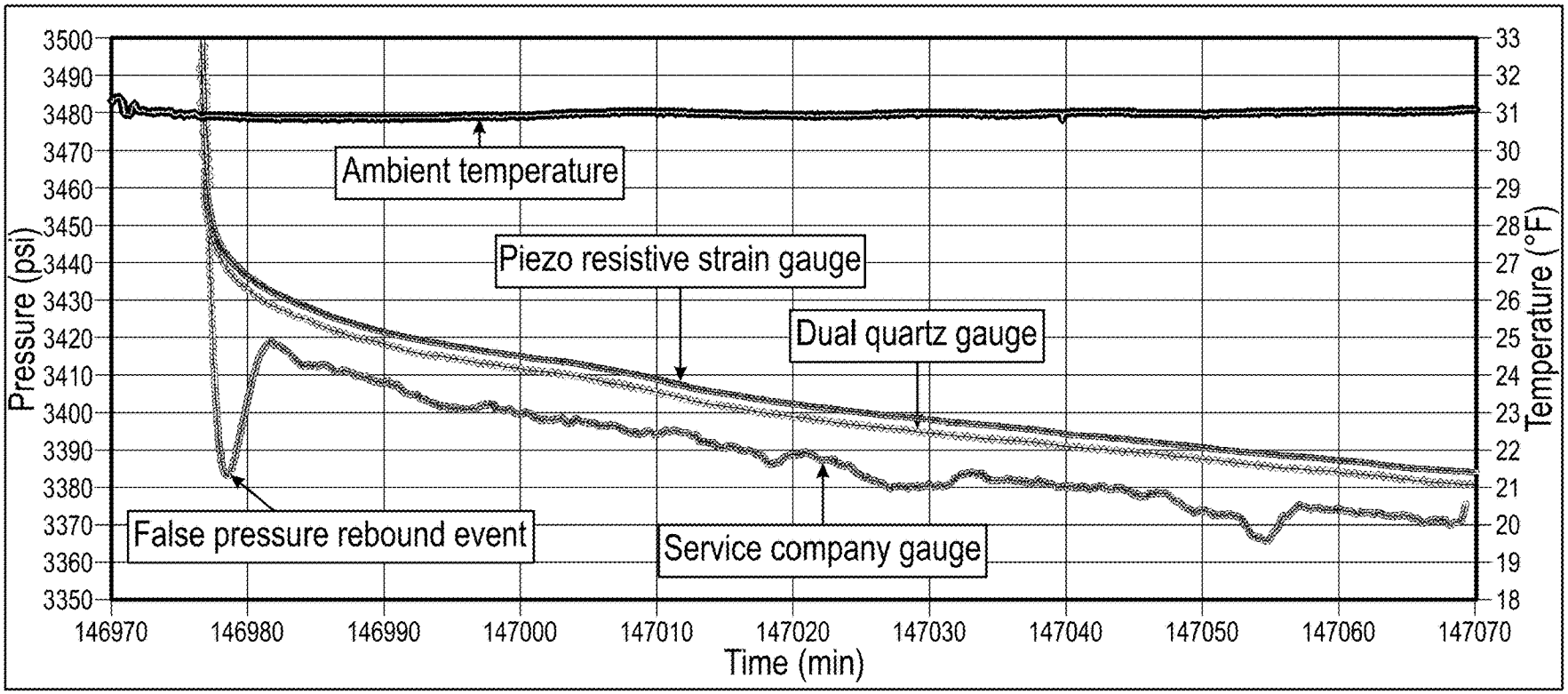

FIG. 22 compares memory gauge versus service company gauge during post injection shut-in period.

Figure 23:
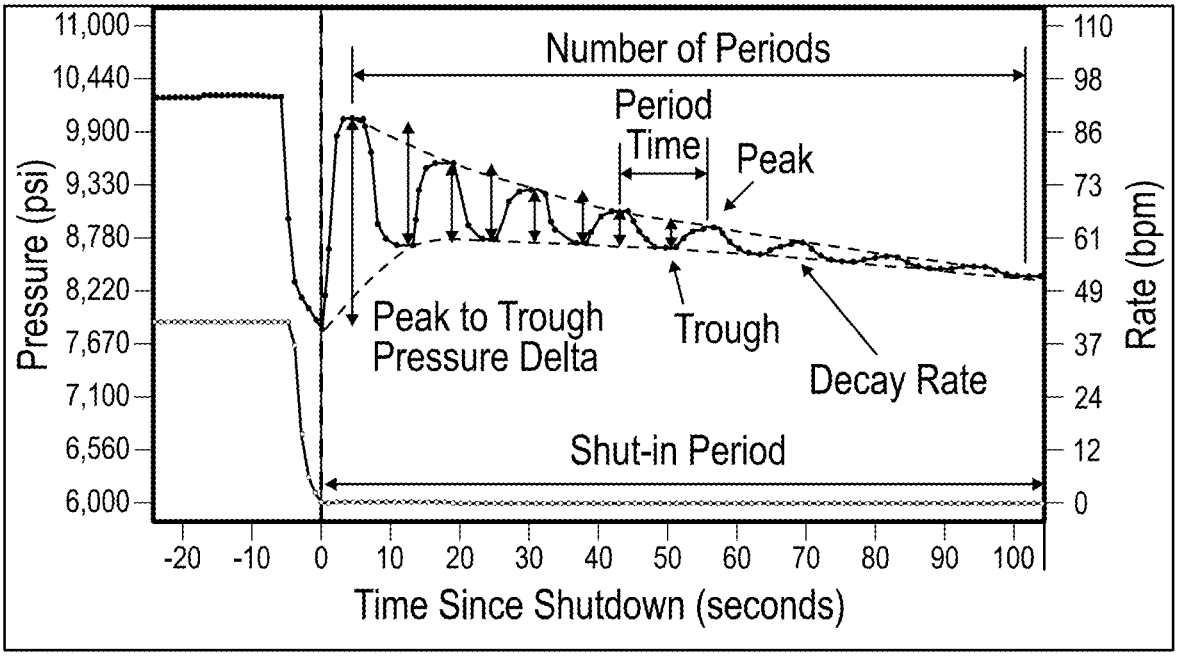

FIG. 23 illustrates water hammer nomenclature.

Figure 24:
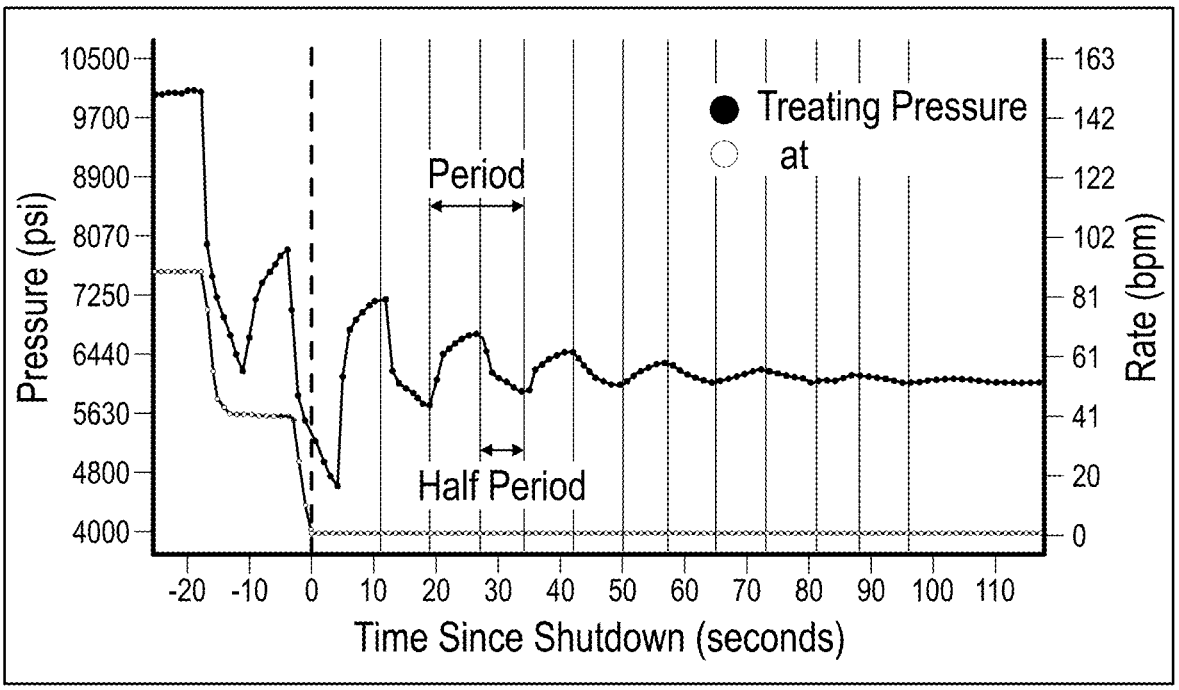

FIG. 24 illustrates picking peaks and troughs.

Figure 25:
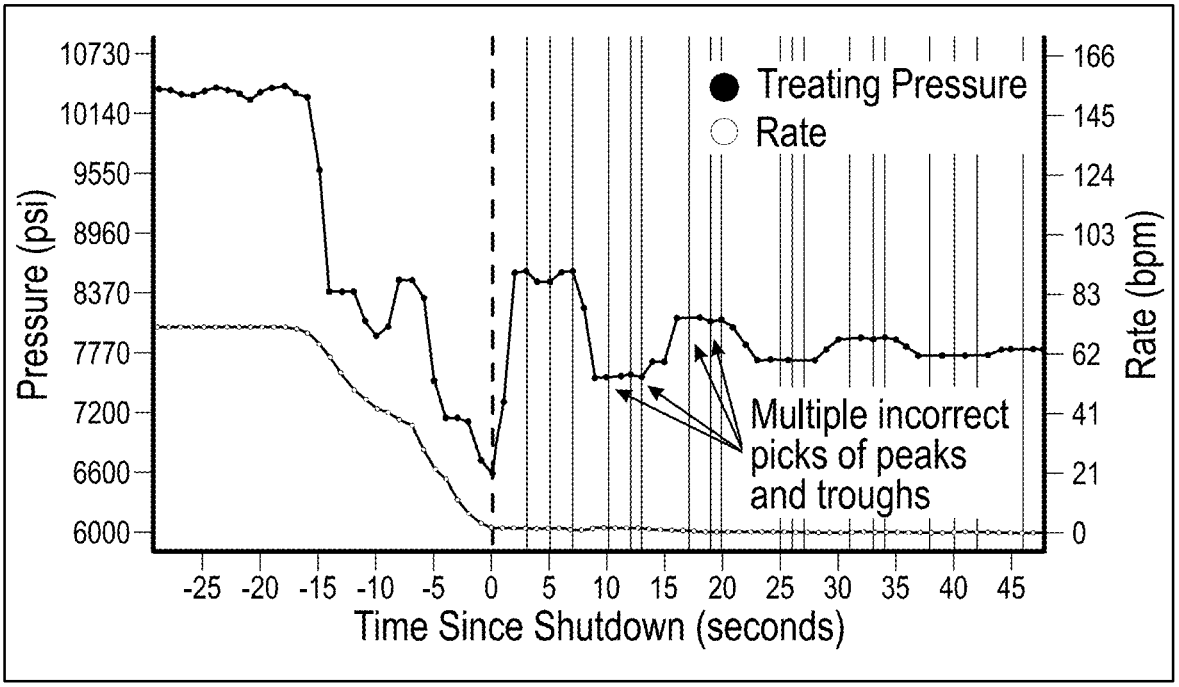

FIG. 25 illustrates picking incorrect peaks and troughs.

Figure 26:
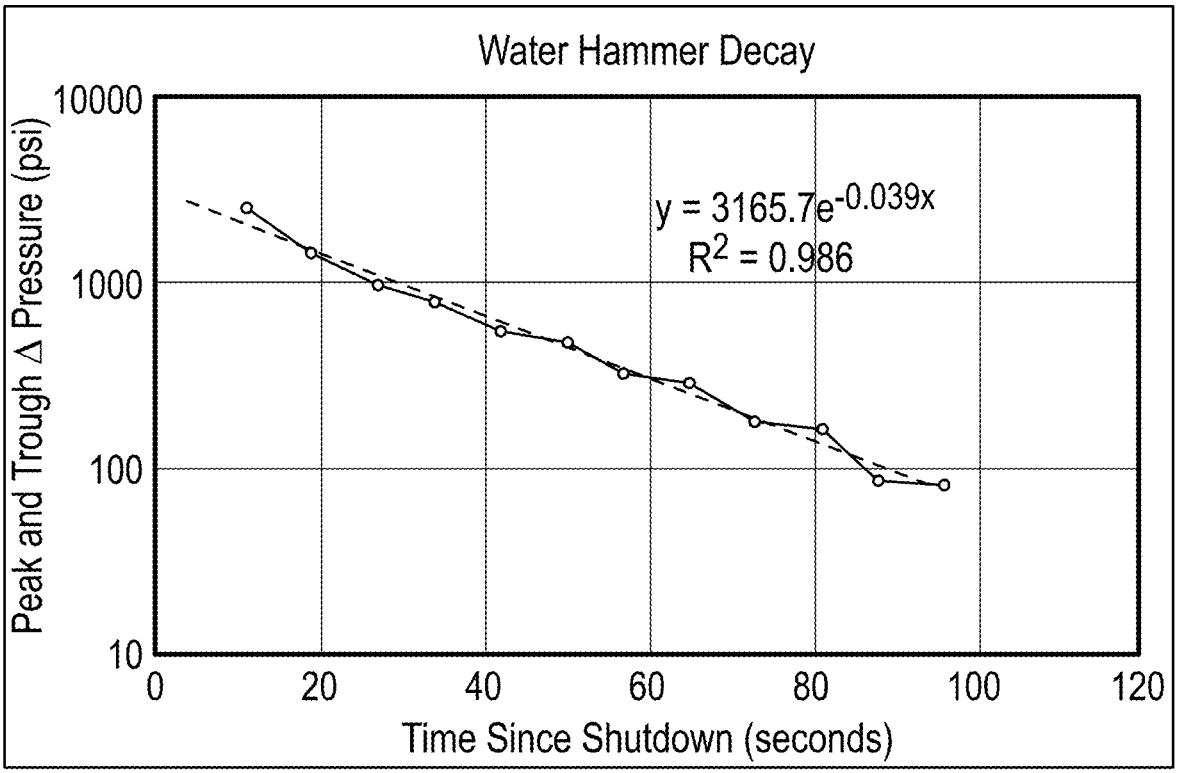

FIG. 26 shows a water hammer decay for the case depicted in FIG. 24.

Figure 27:
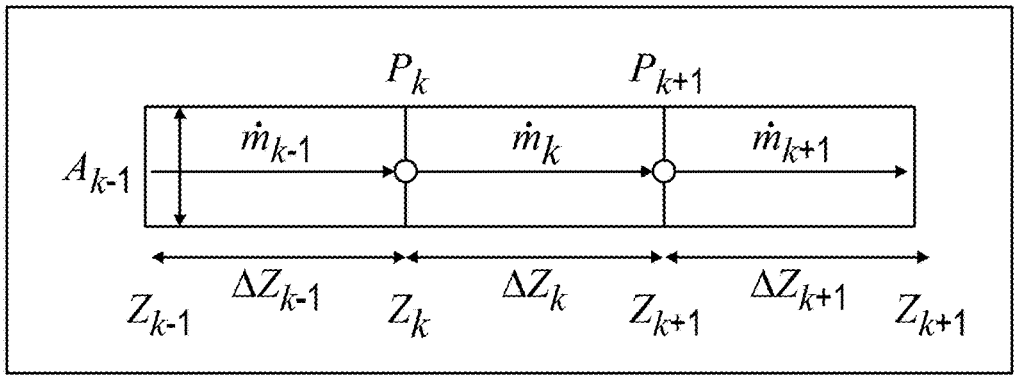

FIG. 27 is a grid for one dimensional momentum equation

Figure 28:
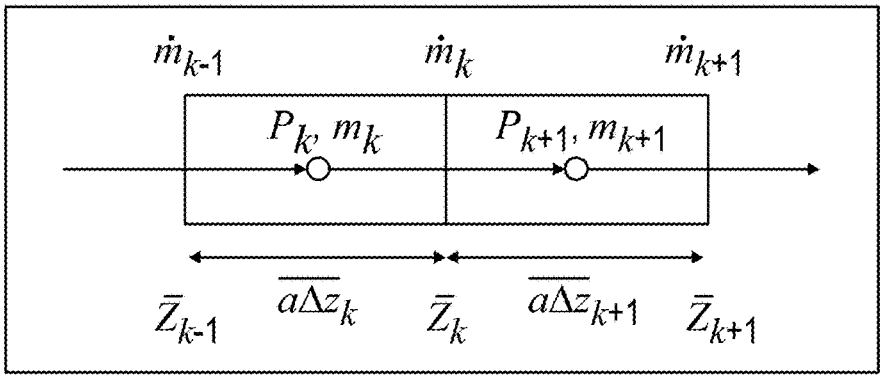

FIG. 28 is a grid for mass conservation equation

Figure 29:
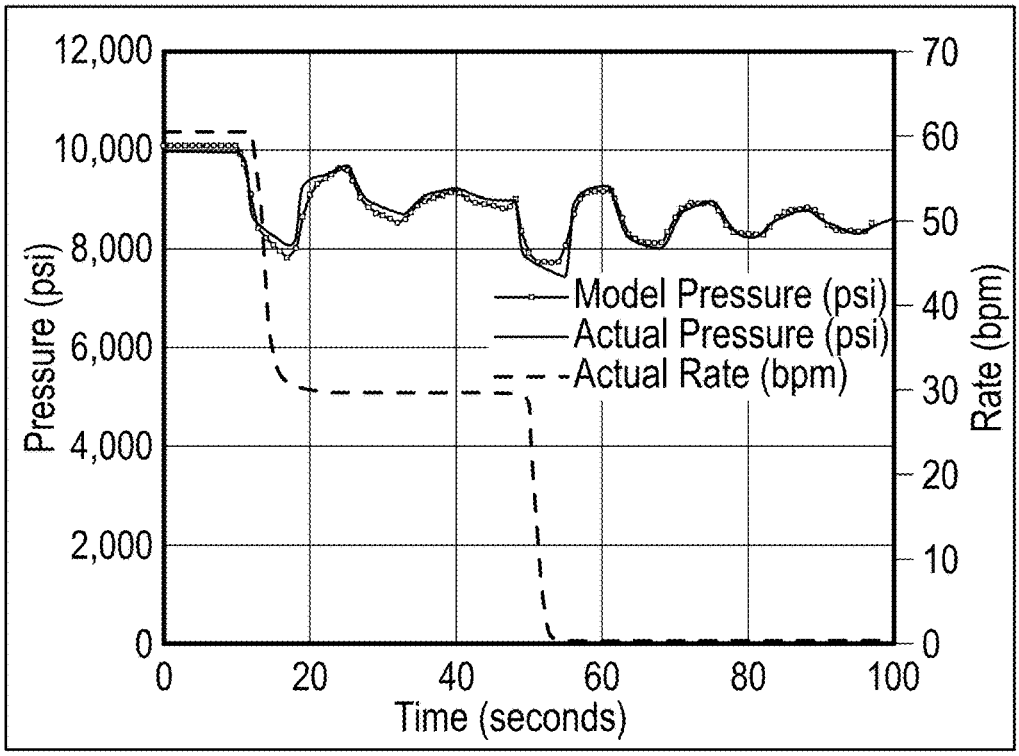

FIG. 29 captures fitting of water hammer model to field data.

Figure 30:
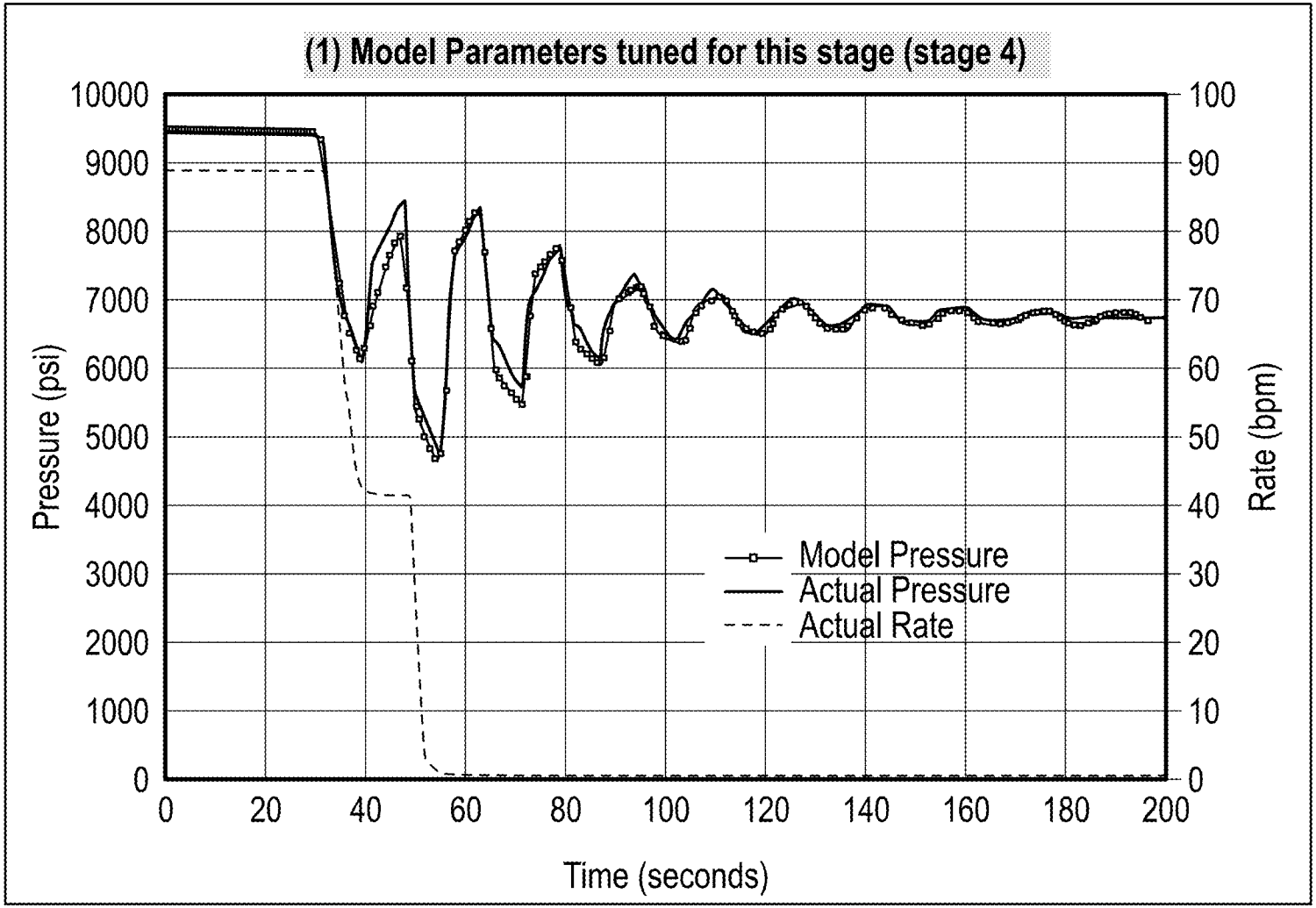

FIG. 30 shows model tuning.

Figure 31A:
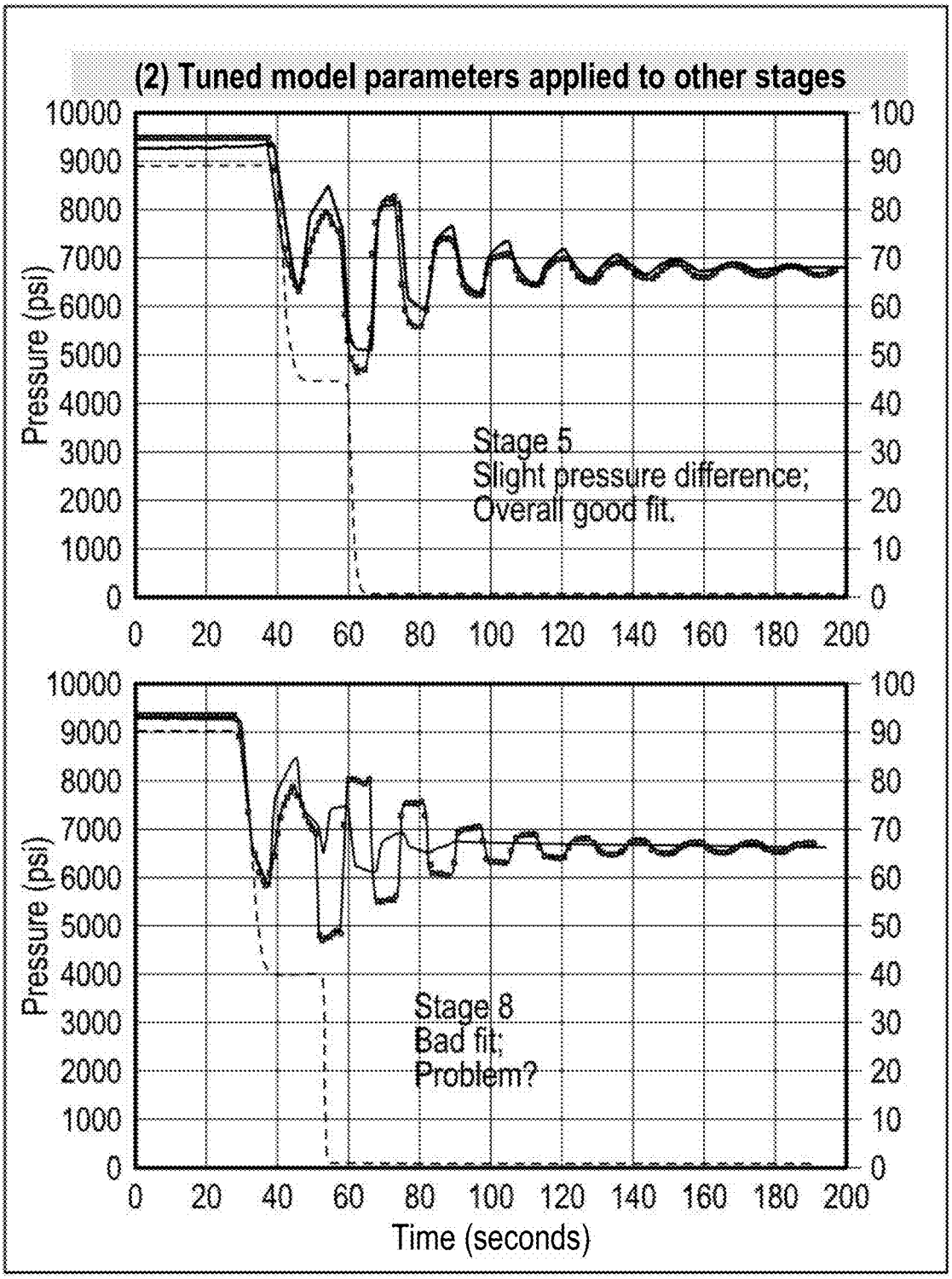
Figure 31B:
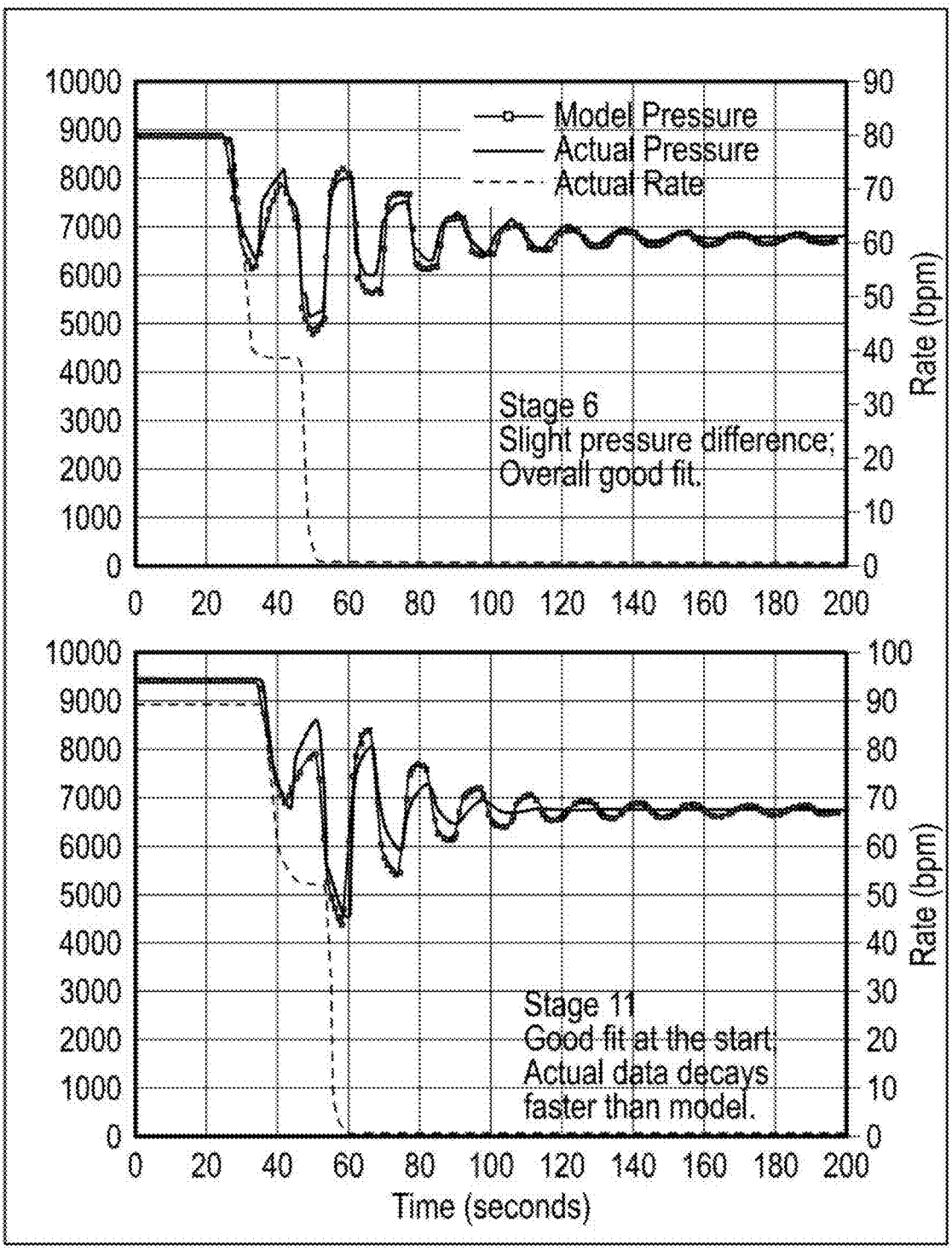

FIG. 31A and FIG. 31B compare a tuned model applied to other stages.

Figure 32:
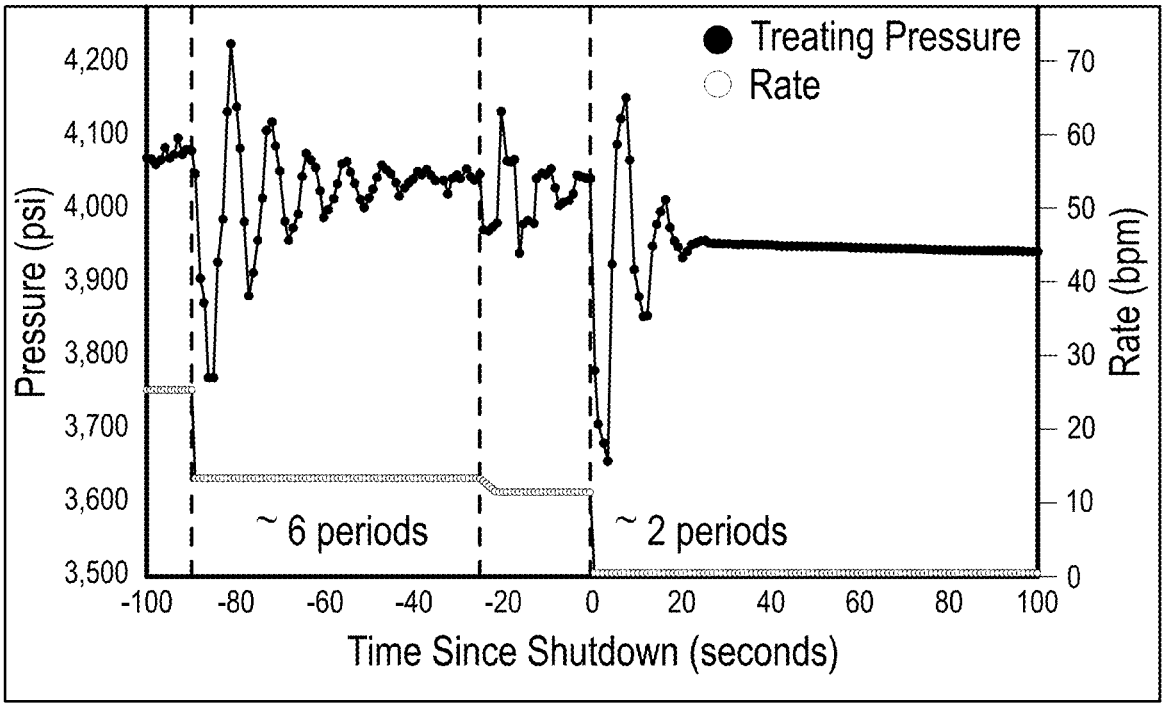

FIG. 32 demonstrates the effect of eliminating shear on fluid viscosity, yield point and water hammer signature.

Figure 33:
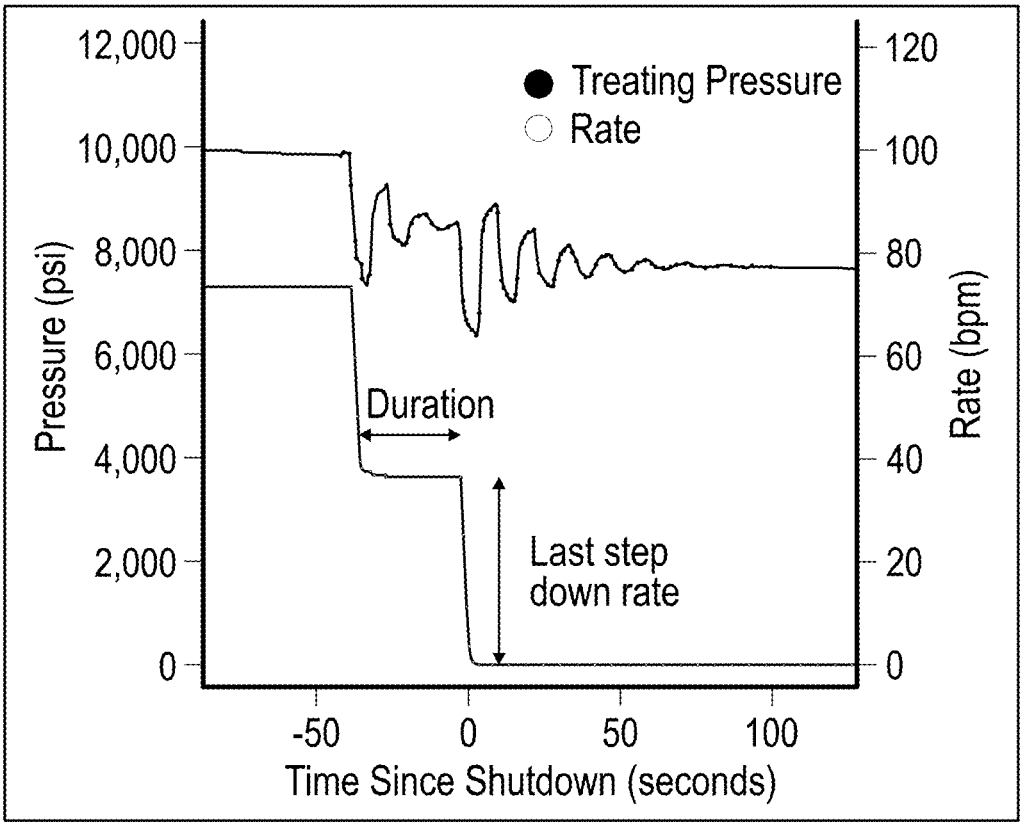

FIG. 33 illustrates step-down rate and duration.

Figure 34:
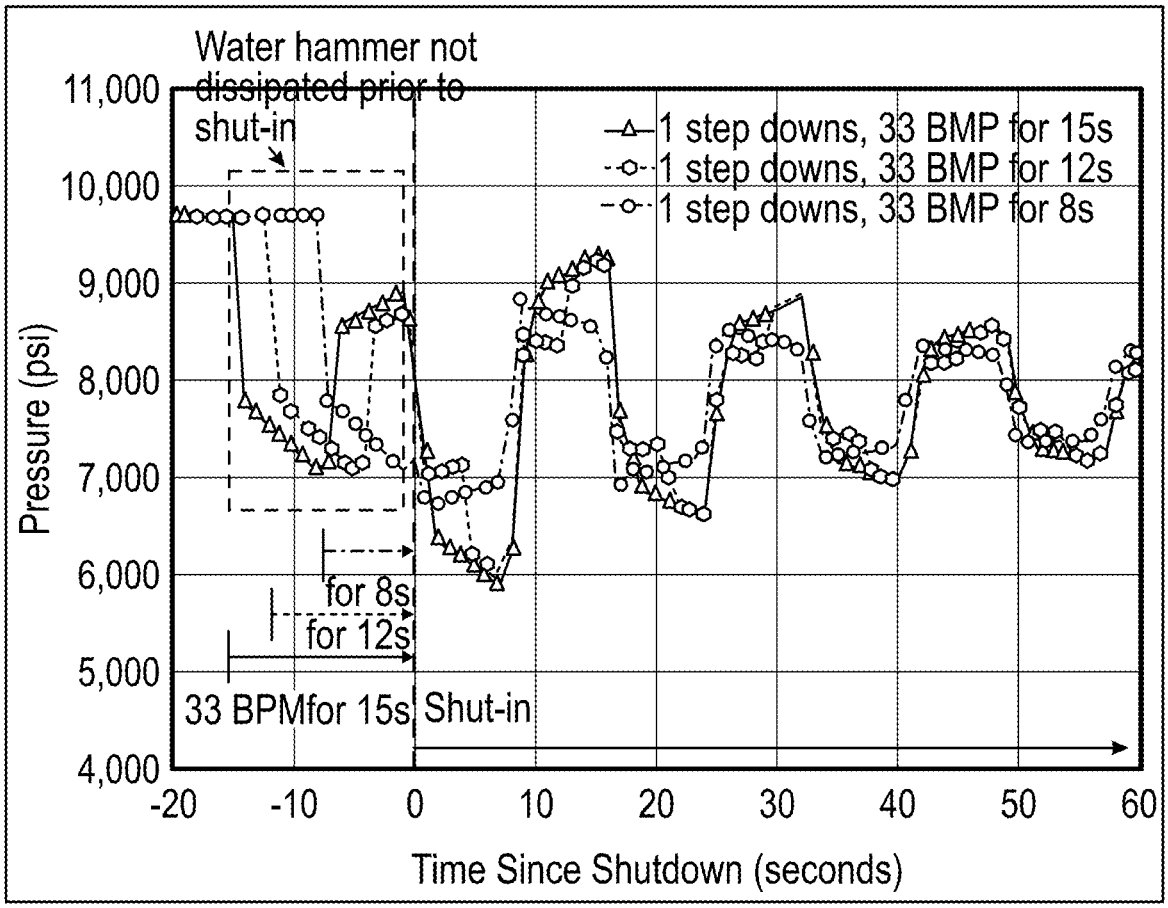

FIG. 34 model comparison results of step-down durations when less than period.

Figure 35:
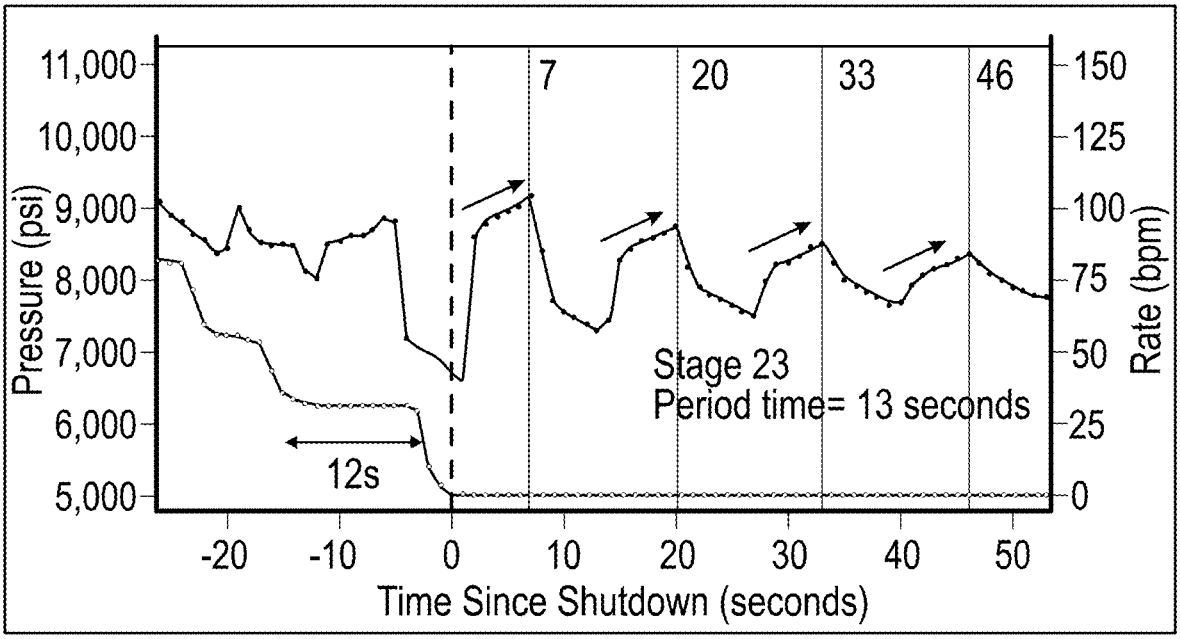

FIG. 35 shows actual data with an upward slope related to step-down duration equal to period.

Figure 36:
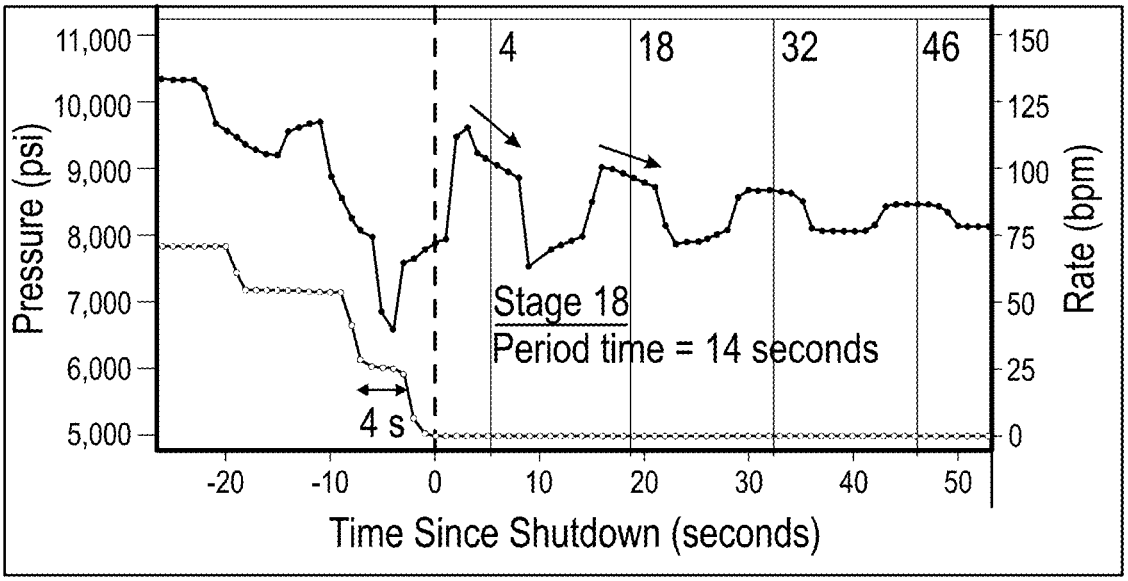

FIG. 36 shows actual data with a downward slope related to step-down duration less than half the period.

Figure 37:
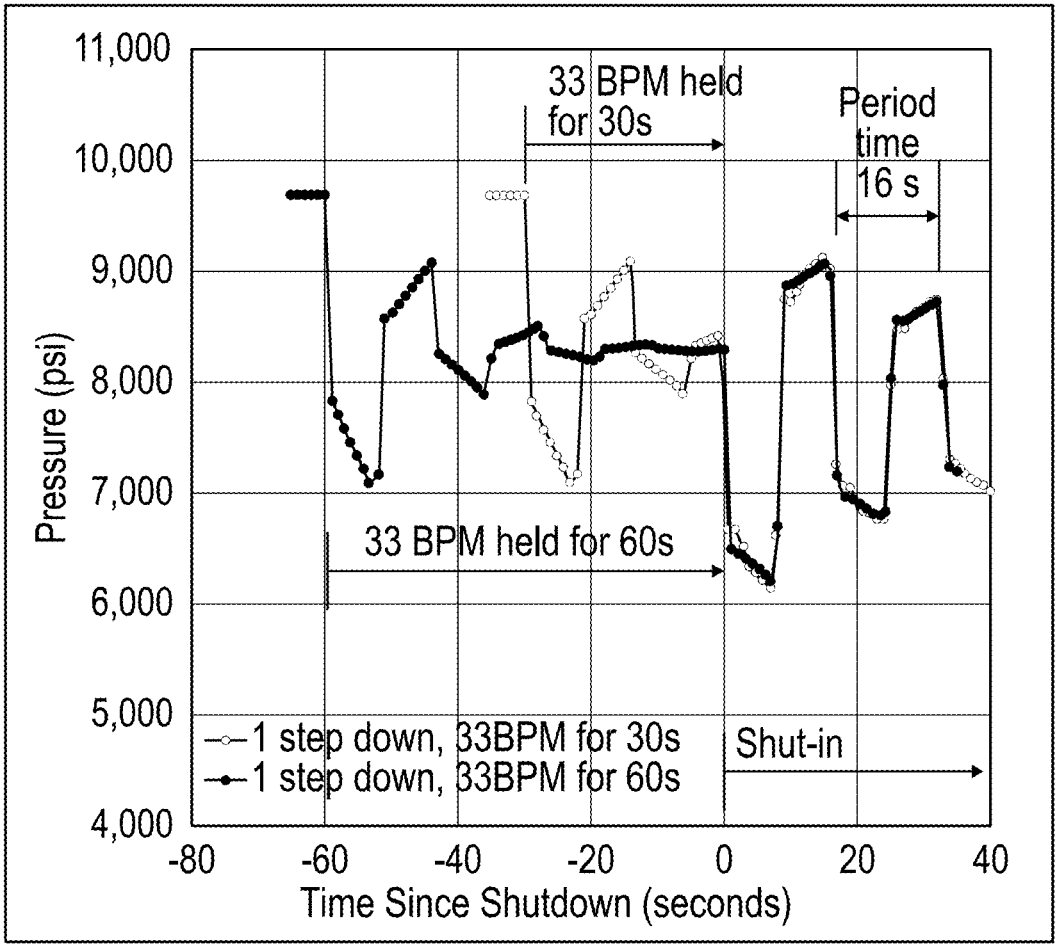

FIG. 37 model comparison of rate step-down duration when greater than period.

Figure 38:
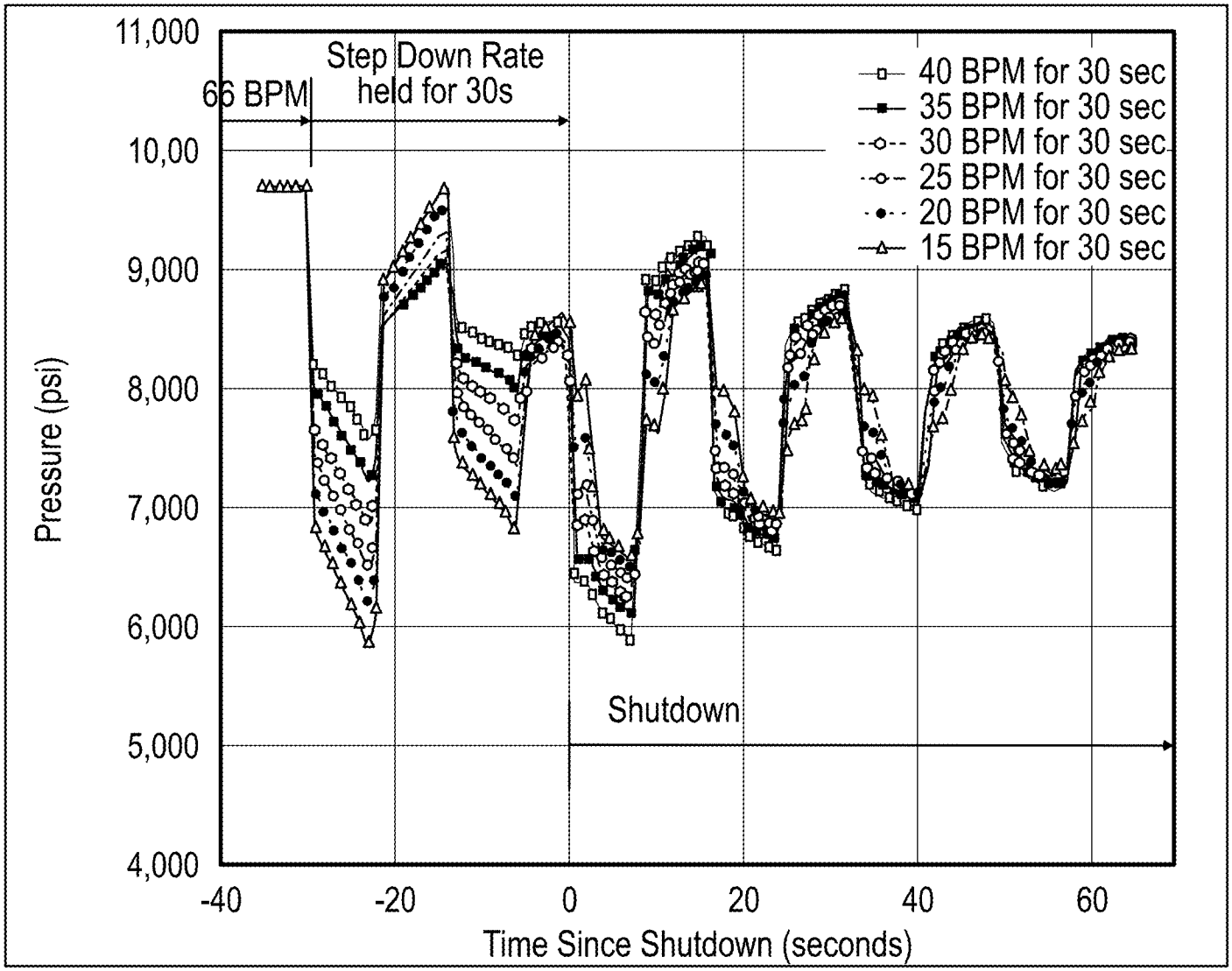

FIG. 38 model comparison of variable step-down rates, each held for 30 seconds.

Figure 39:
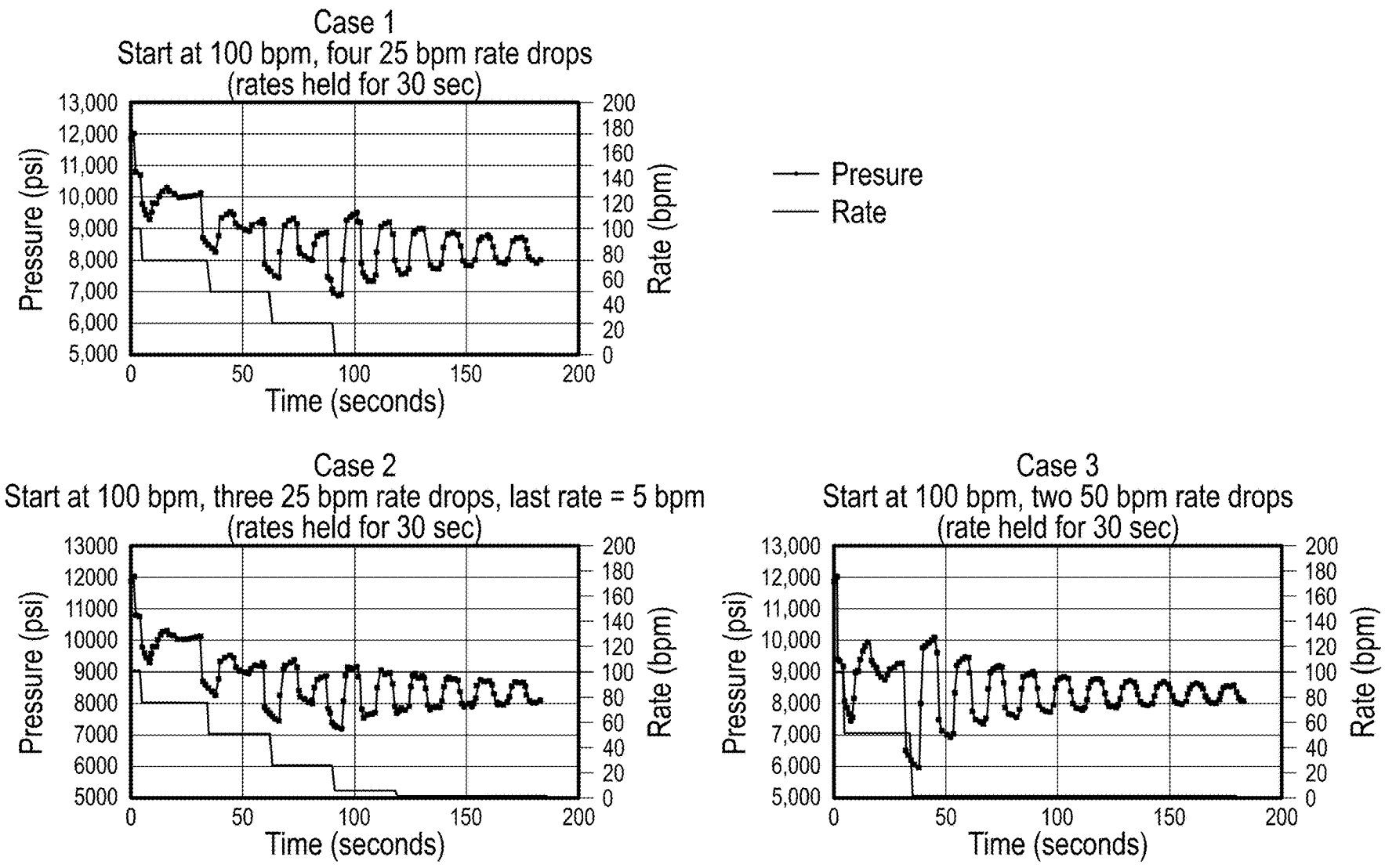

FIG. 39 evaluates sensitivity on the number of step-downs and step-down rate.

Figure 40:
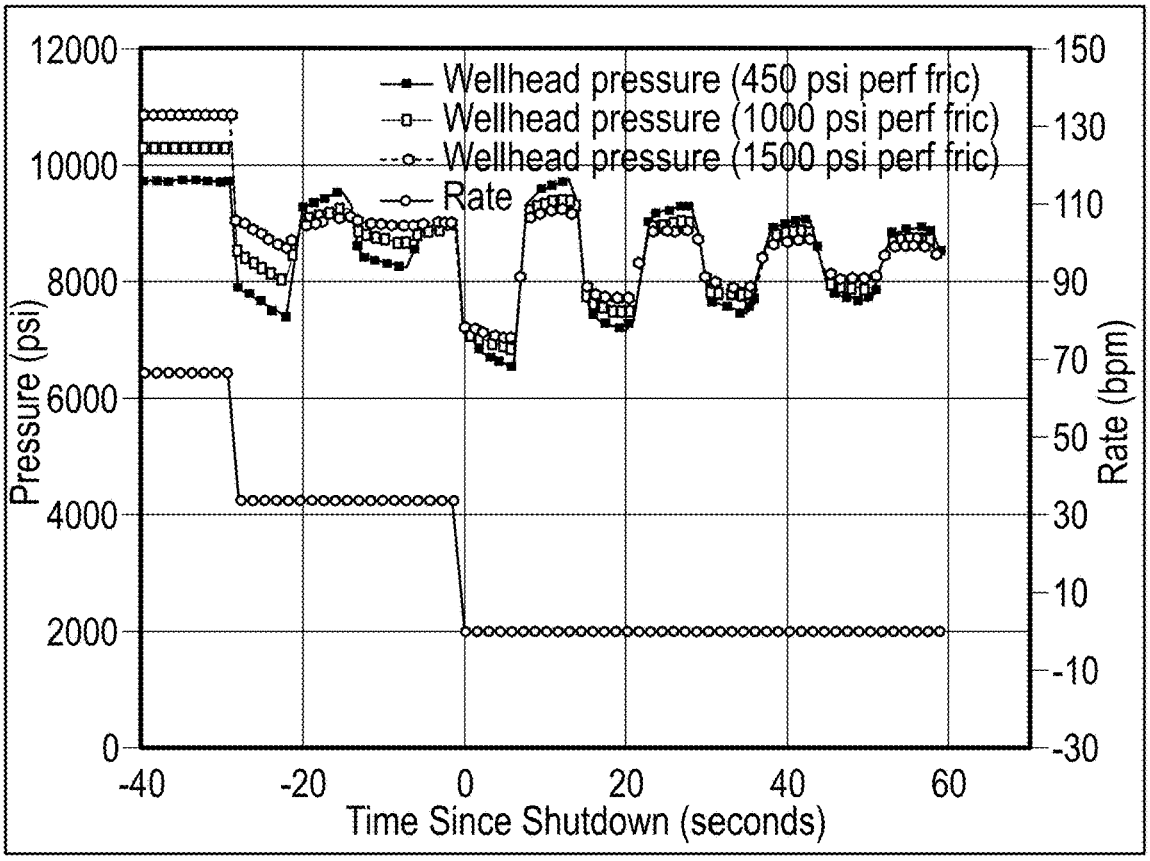

FIG. 40 is a simulated perforation friction sensitivity analysis.

Figure 41:
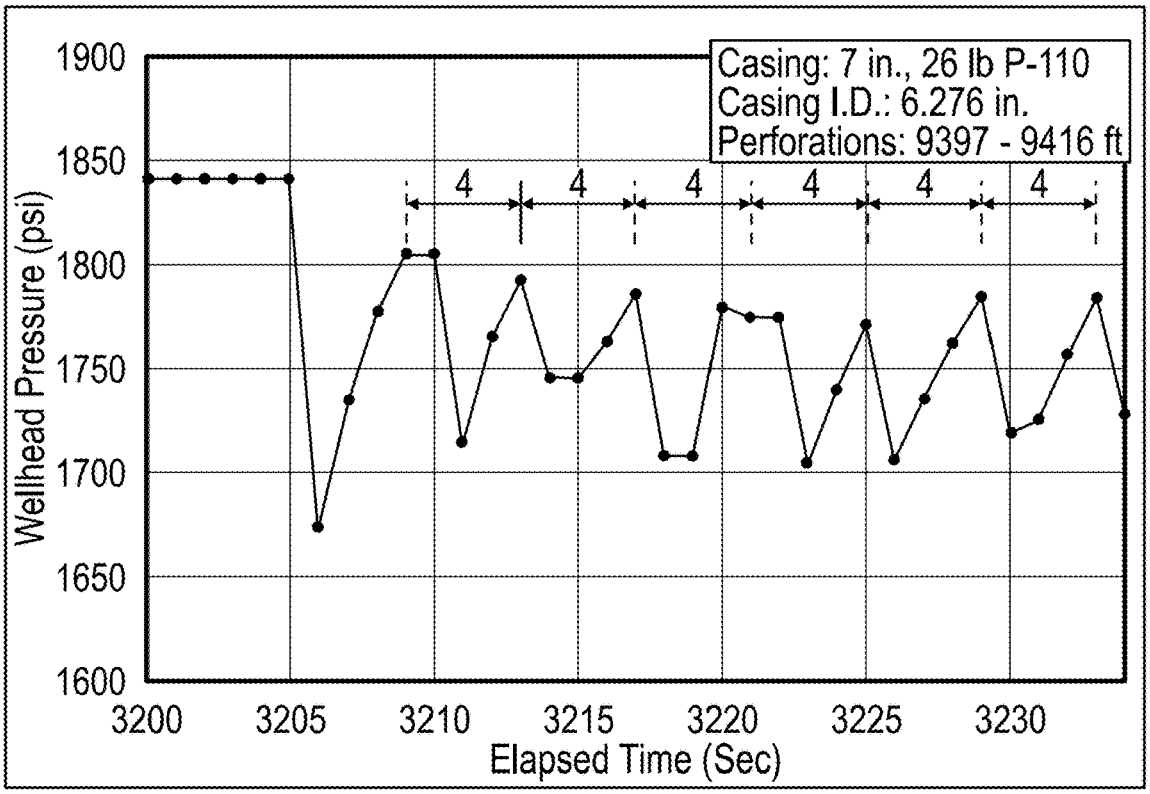

FIG. 41 shows a water hammer after perforation detonation event.

Figure 42:
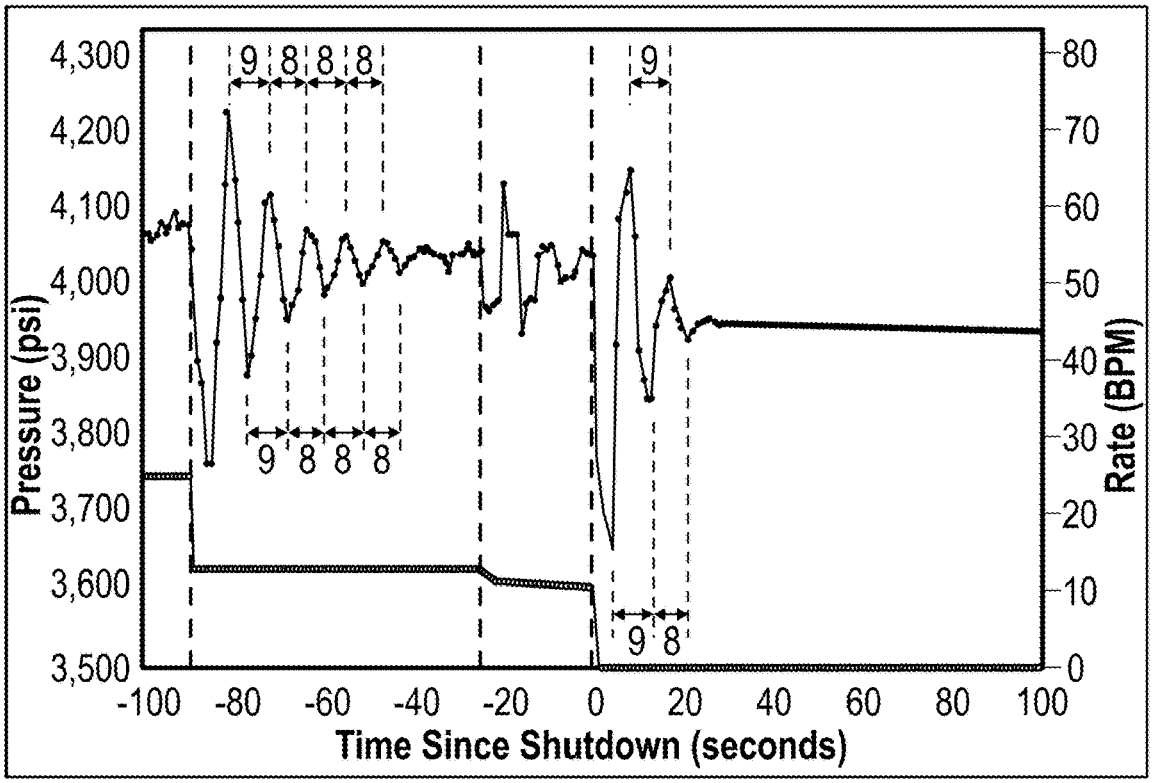

FIG. 42 shows a water hammer after hydraulic fracturing treatment.

Figure 43:
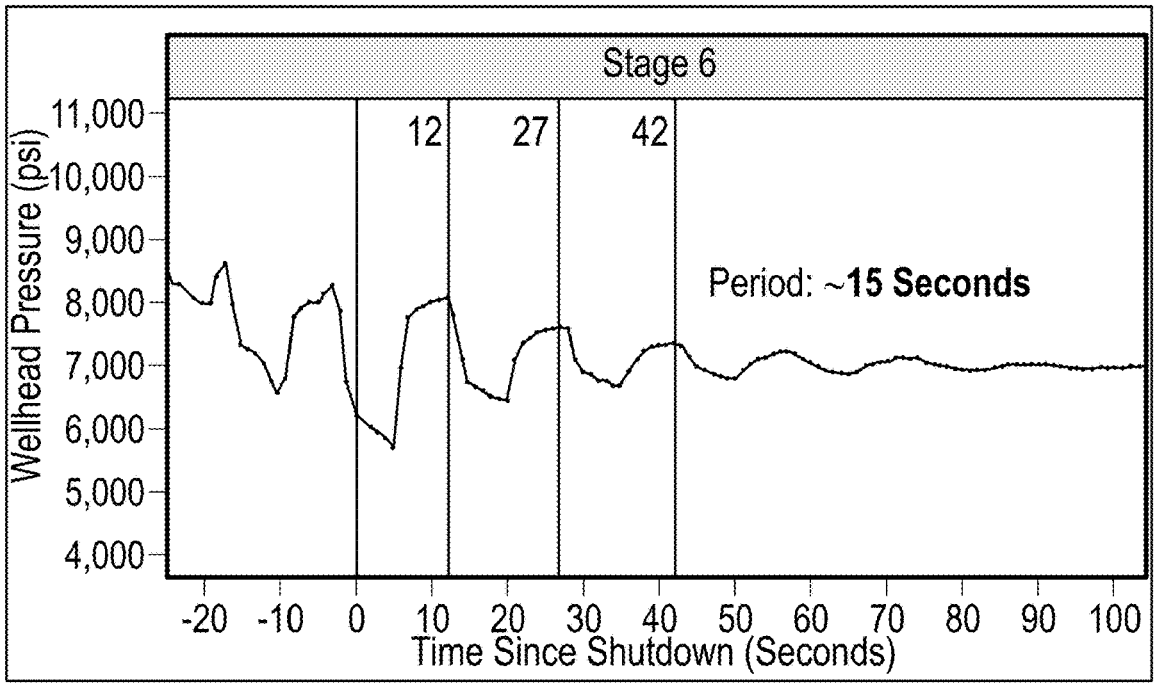

FIG. 43 shows the corresponding water hammer of a treatment with no operational issues (Stage 6).

Figure 44:
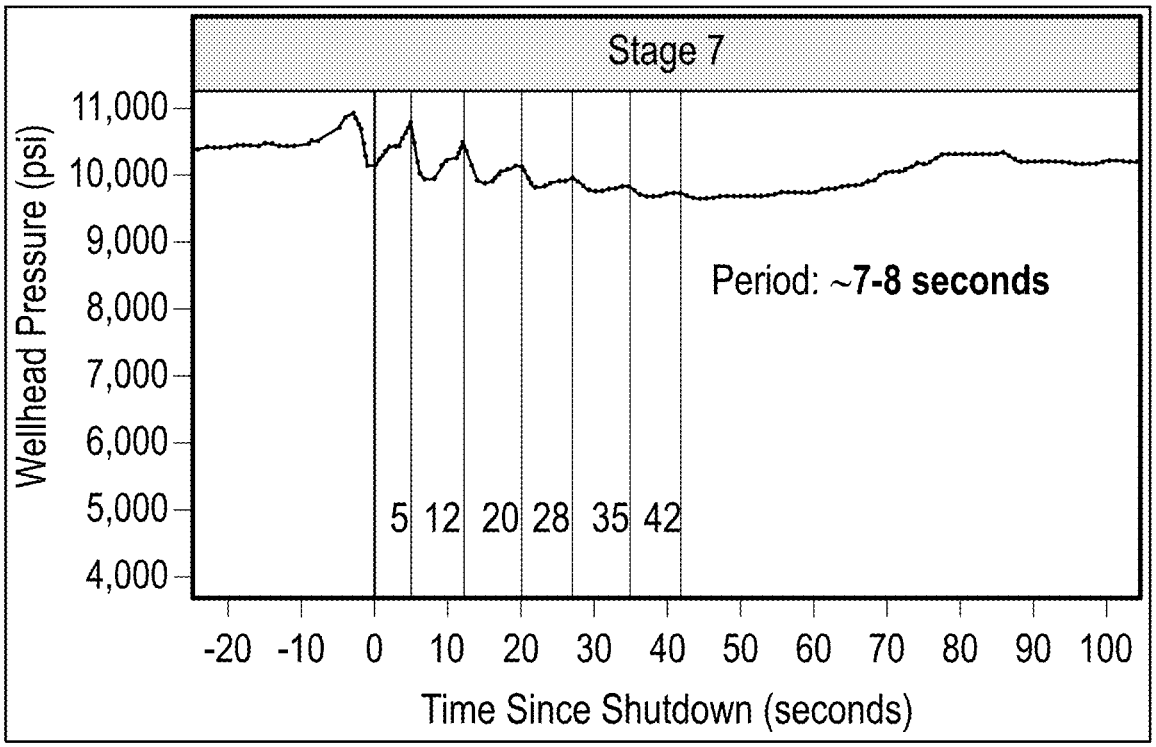

FIG. 44 shows the corresponding water hammer of a treatment with a screen out event (Stage 7).

Figure 45:
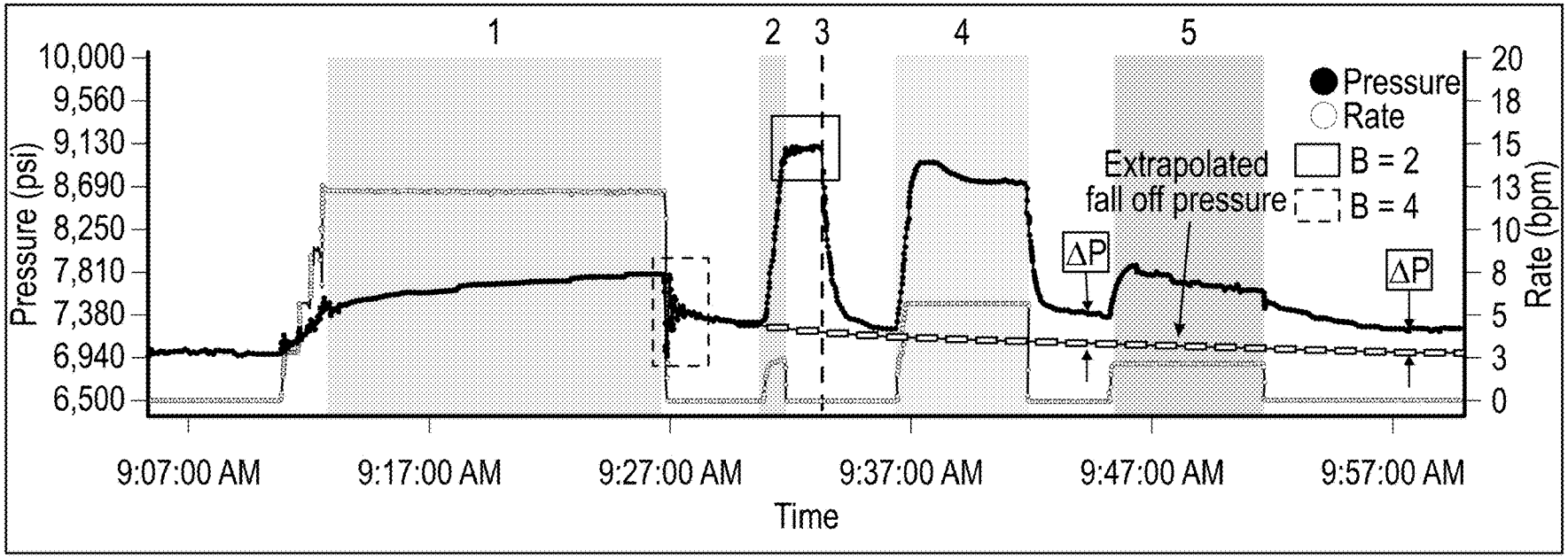

FIG. 45 illustrates pumpdown diagnostics showing stage isolation.

Figure 46:
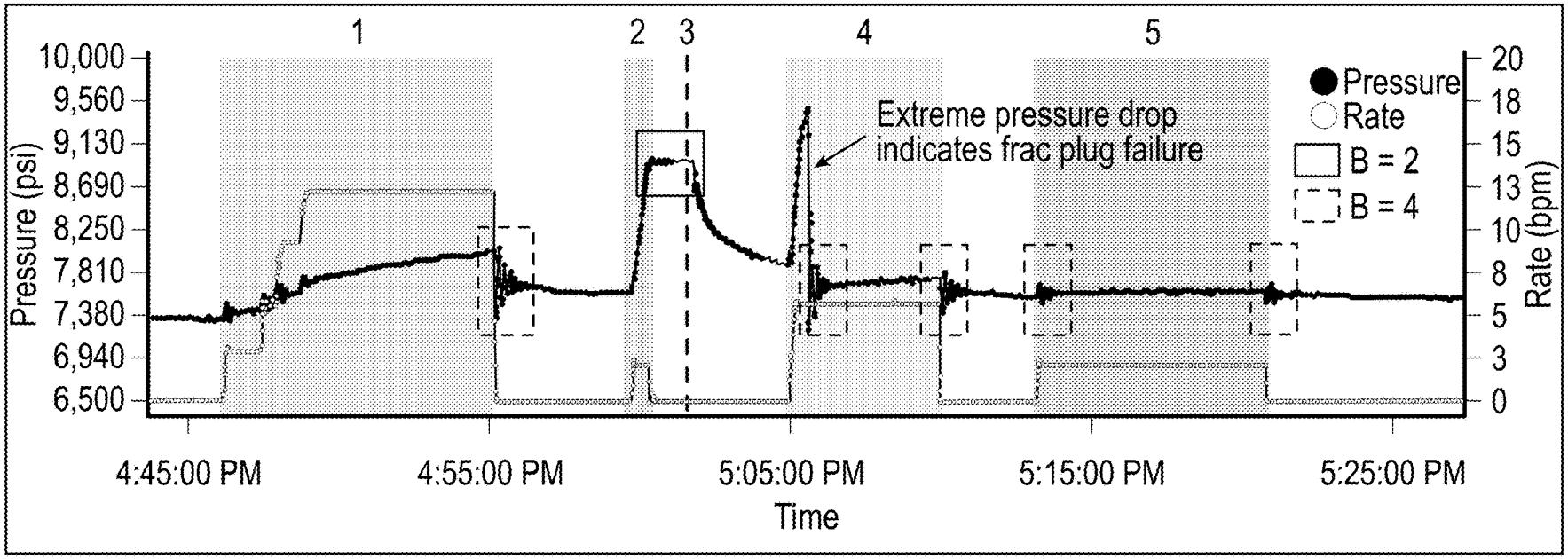

FIG. 46 illustrates pumpdown diagnostic testing showing frac plug failure (loss of stage isolation).

Figure 47:
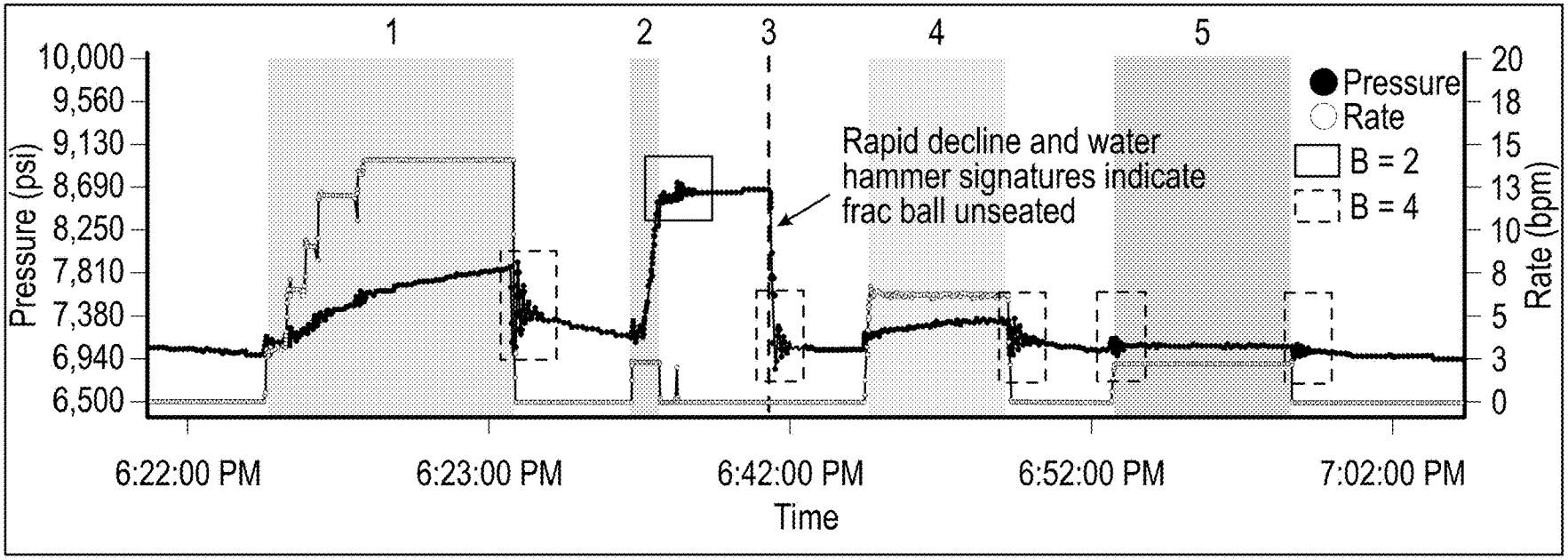

FIG. 47 illustrates pumpdown diagnostics showing an unseated frac ball (loss of stage isolation).

Figure 48:
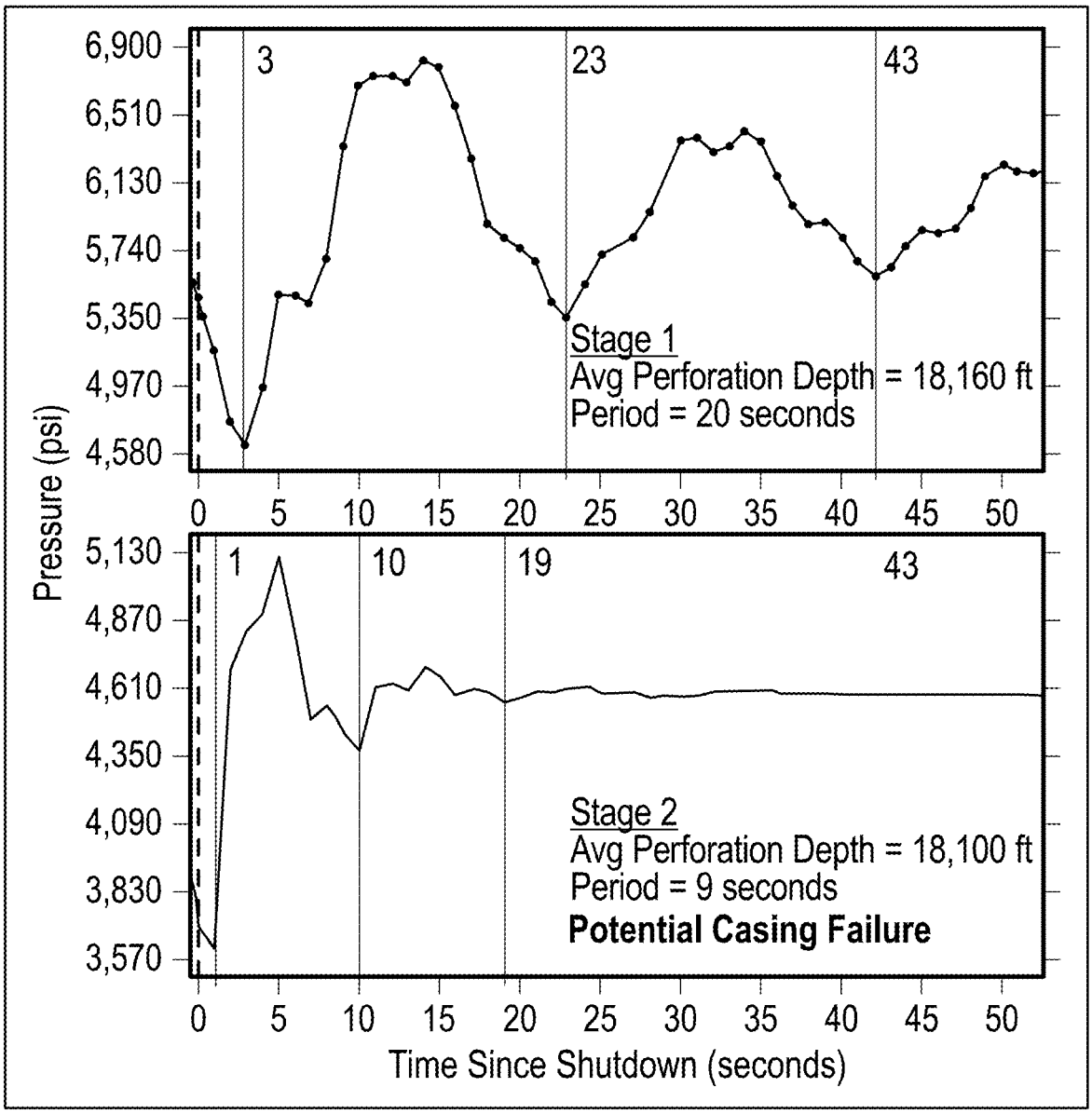

FIG. 48 is a comparison of stage 1 and stage 2 water hammer period.

Figure 49:
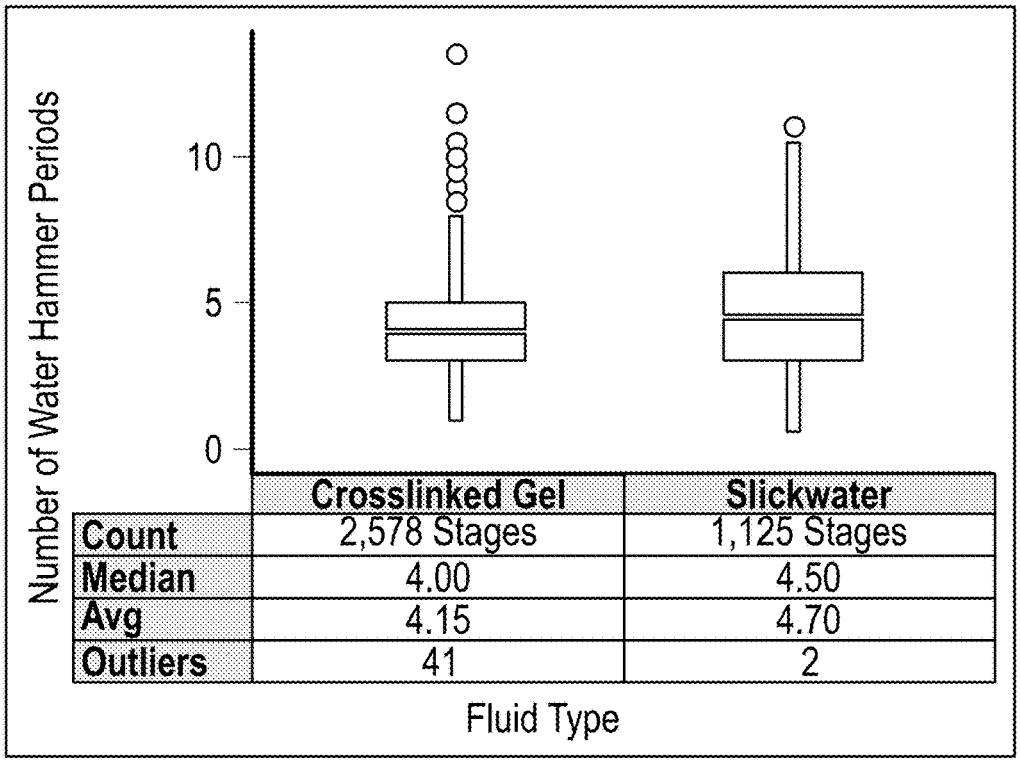

FIG. 49 compares completions fluid type versus number of water hammer periods.

Figure 50:
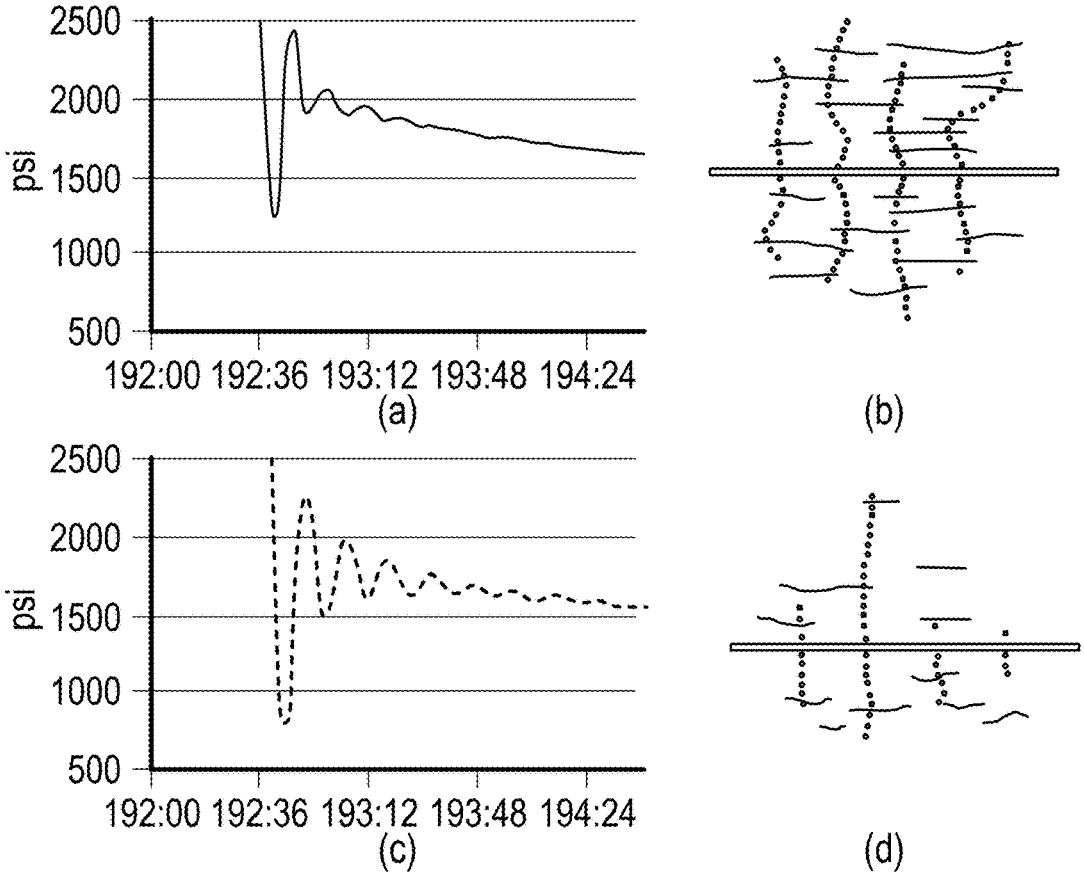

FIG. 50 illustrates the proposed relationship of water hammer decay rate with contacted fracture area (Iriarte et al. 2017)

Figure 51:
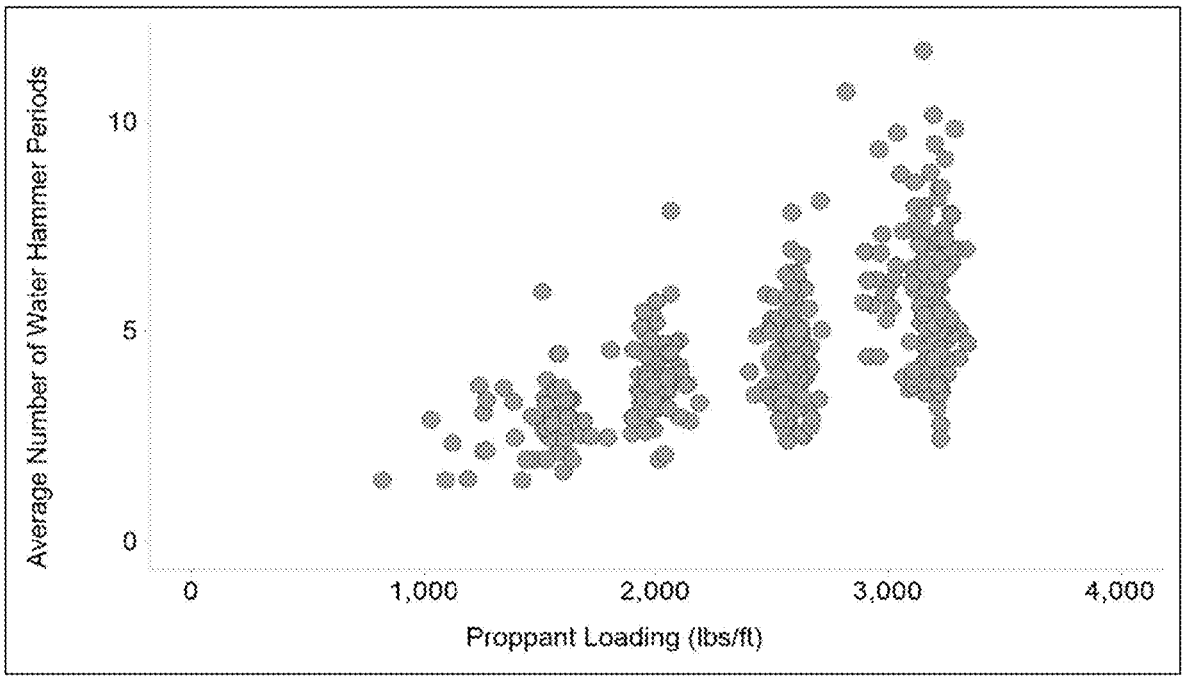

FIG. 51 demonstrates the average number of water hammer periods per well versus proppant volume.

Figure 52:
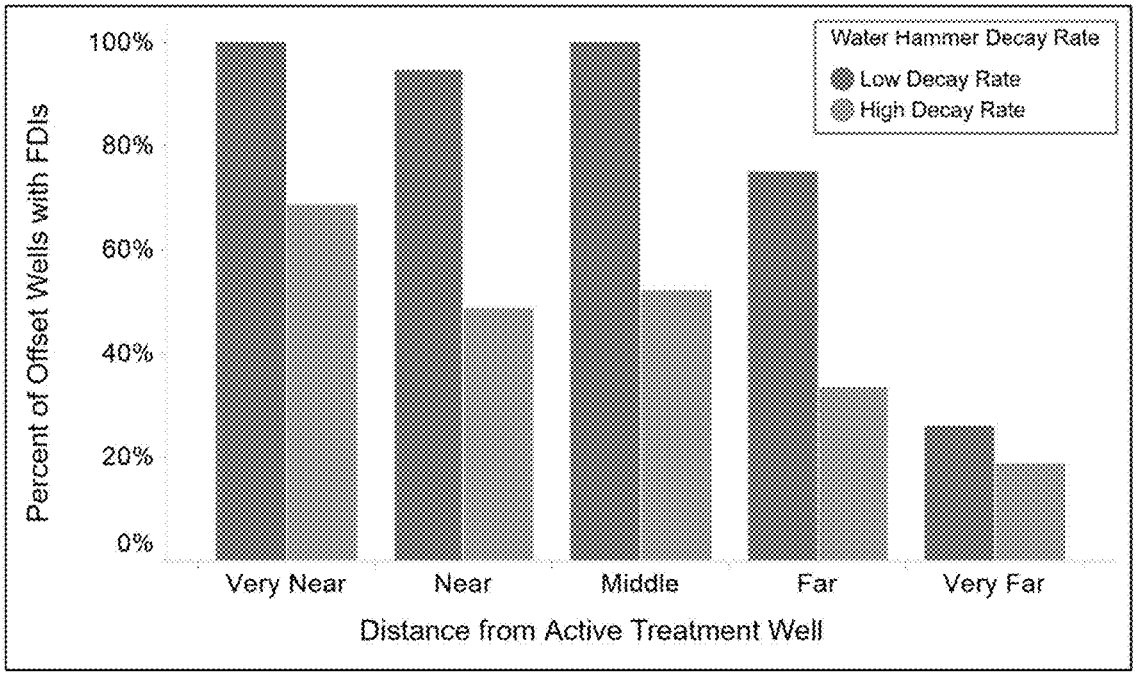

FIG. 52 compares FDI's versus distance from the well being actively treated.

Figure 53:
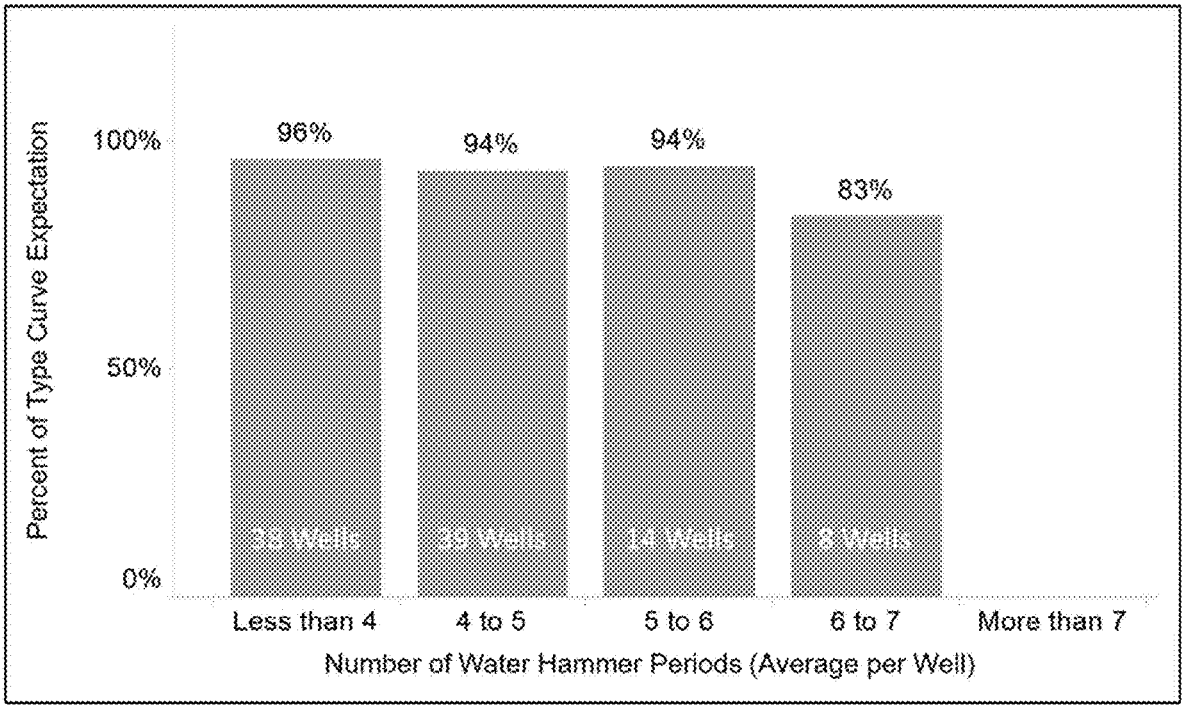

FIG. 53 characterizes well performance versus average number of water hammer periods for wells with 2600 lbs/ft proppant.

Figure 54:
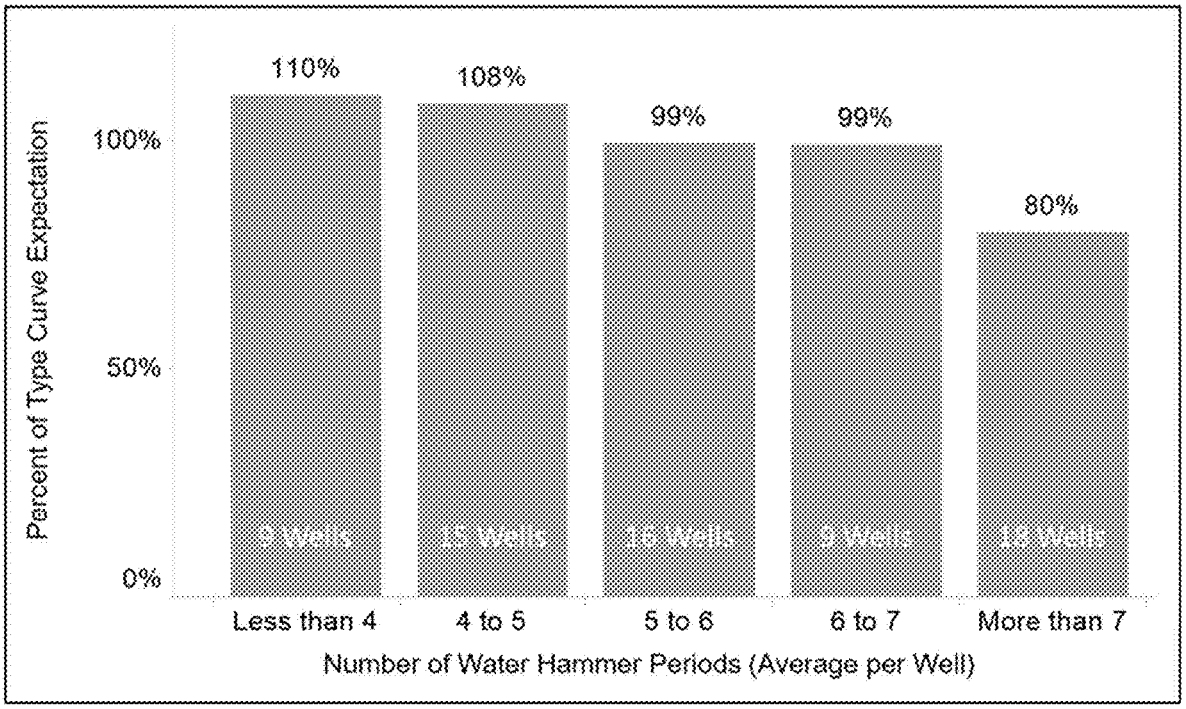

FIG. 54 characterizes well performance versus average number of water hammer periods for wells with 3200 lbs/ft proppant.

Figure 55:
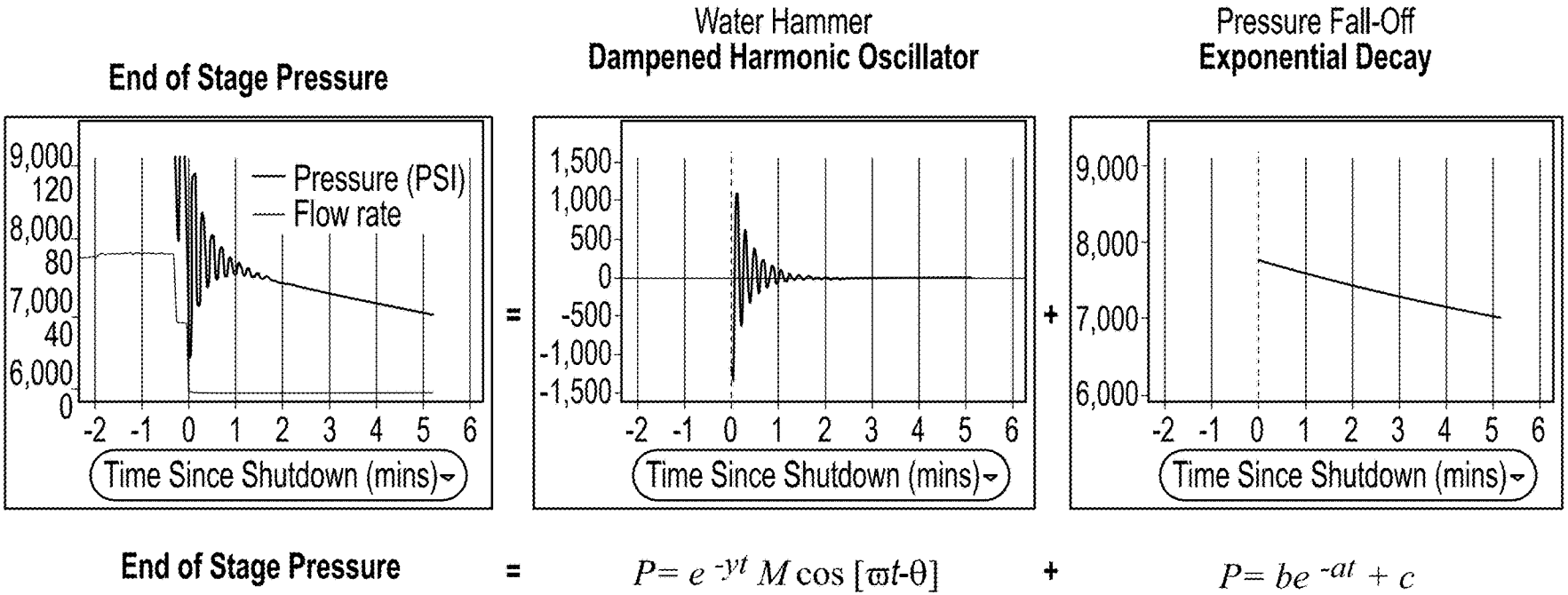

FIG. 55 provides a typical pressure response after the end of a stage

Figure 56:
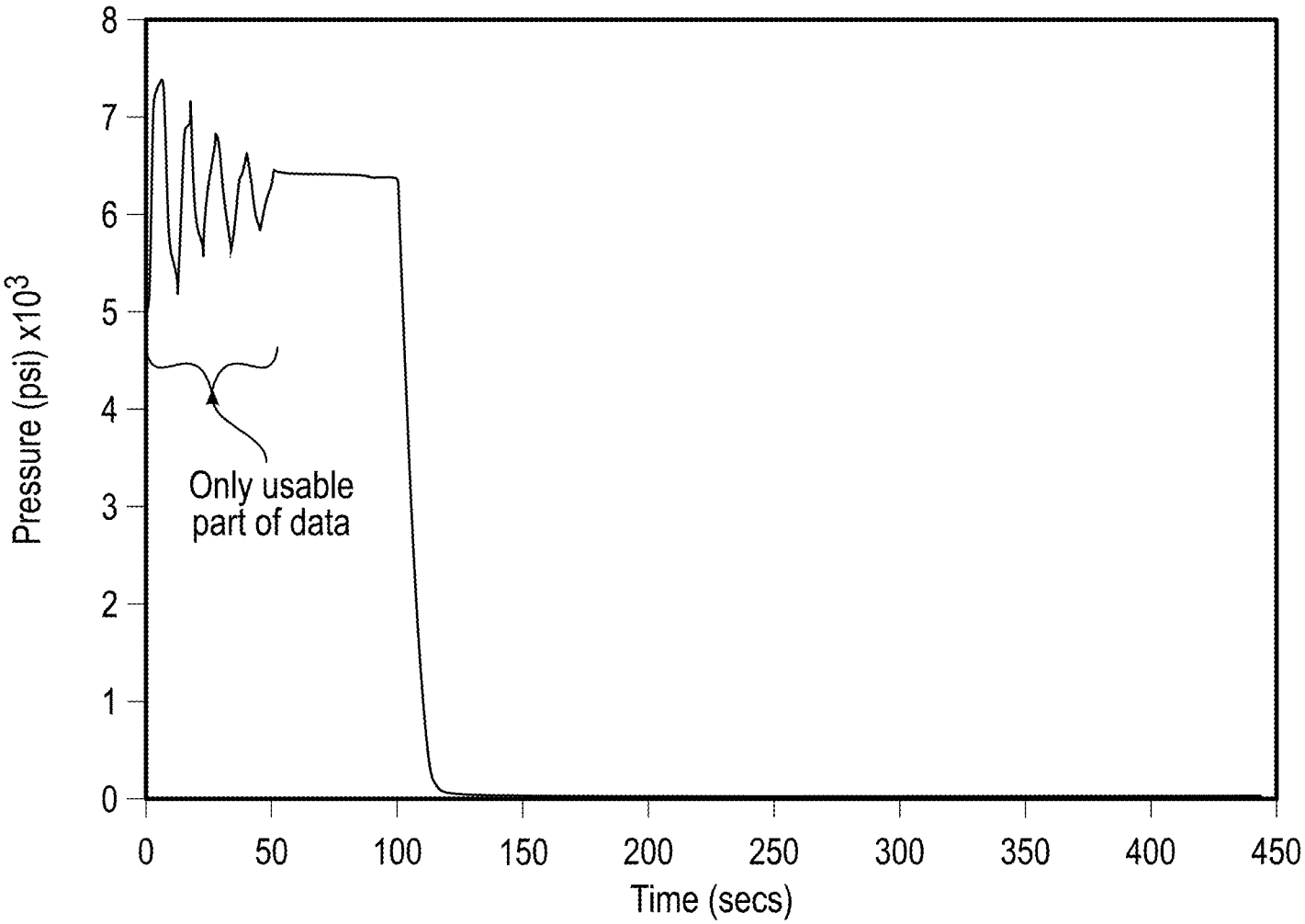

FIG. 56 demonstrates a premature disconnect of sensor.

Figure 57:
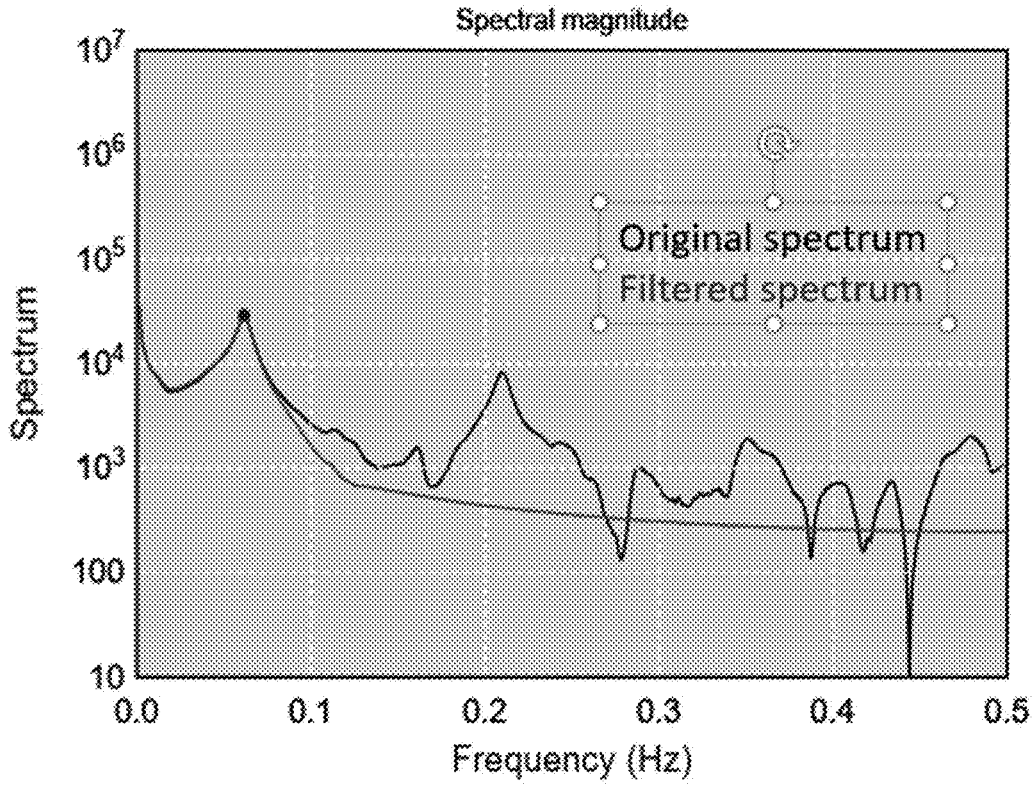
Figure 57:
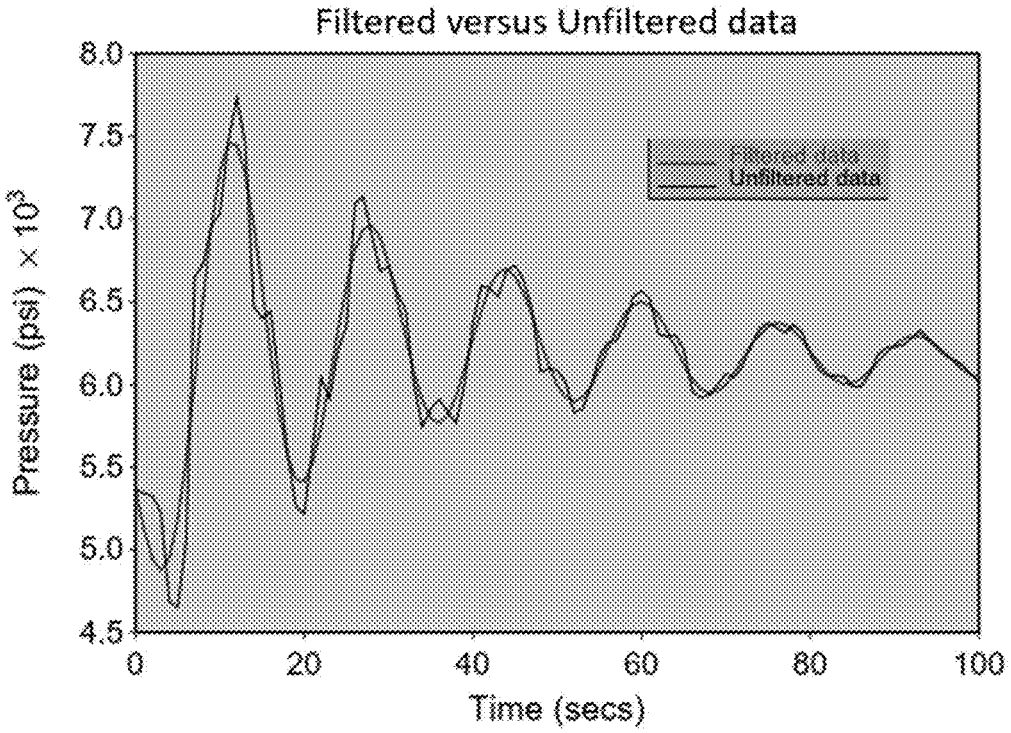

FIG. 57 is a comparison between unfiltered and filtered data in (a) the frequency domain and (b) the time domain.

Figure 58:
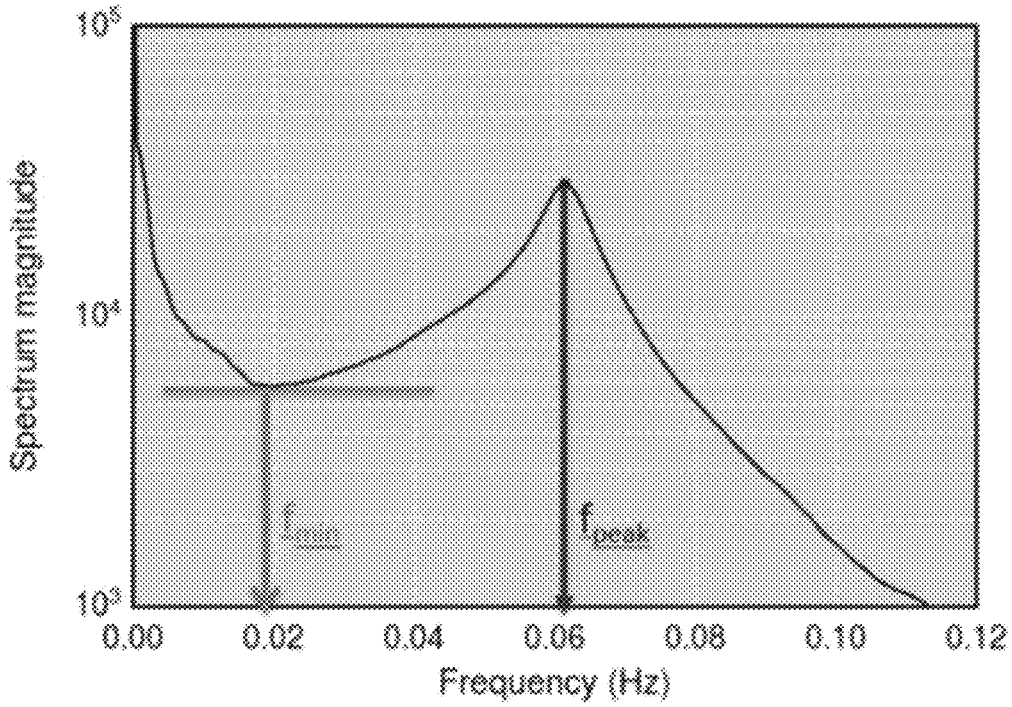
Figure 58:
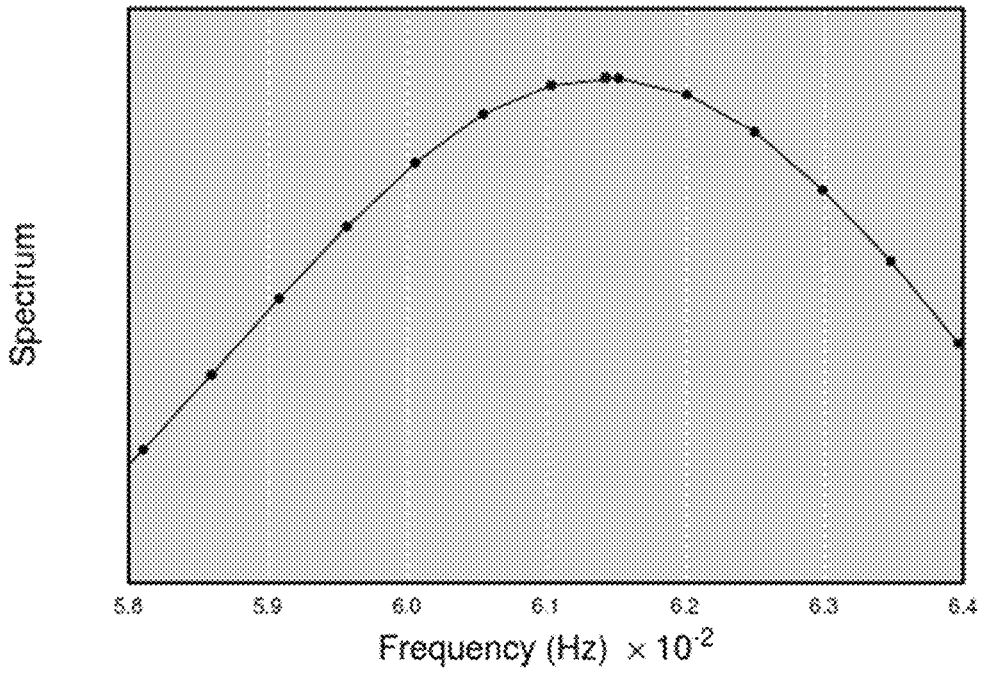

FIG. 58 illustrates how the highest-magnitude DFT sample is located and (b) The interpolated resonant frequency of the water hammer (red dot).

Figure 59:
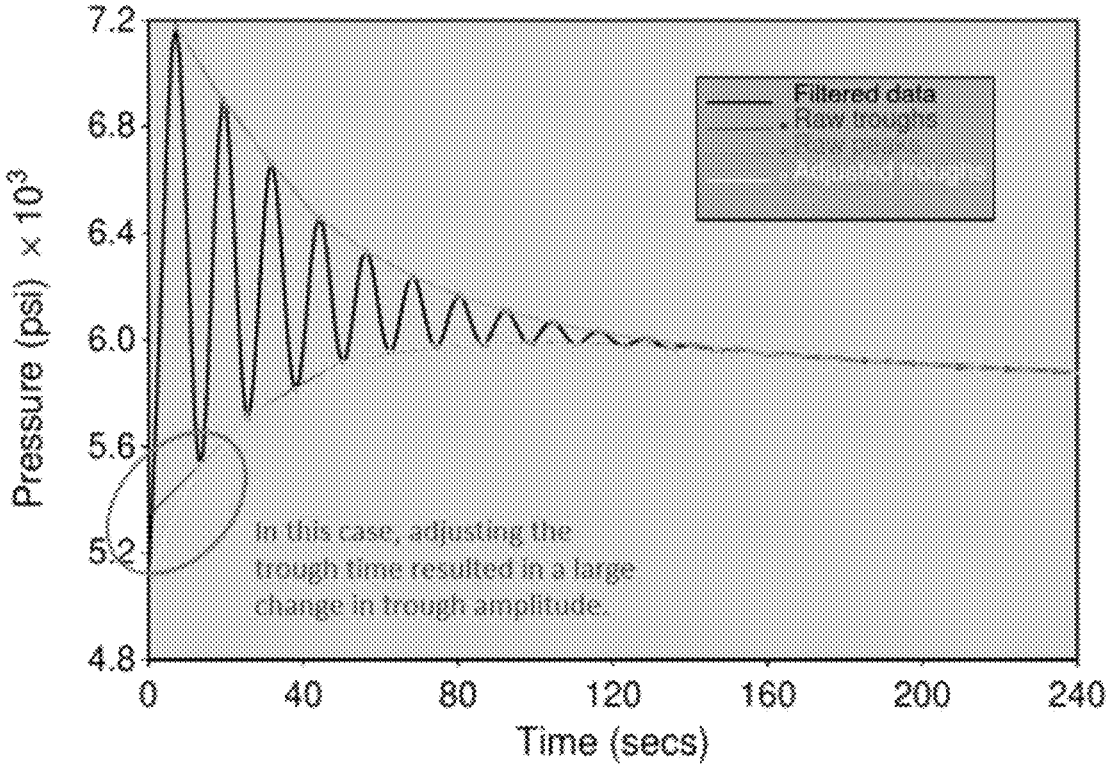

FIG. 59 is a comparison of the filtered data (black) with the raw peaks (orange) and troughs (blue) as computed from the resonant frequency and phase of the water hammer.

Figure 5:
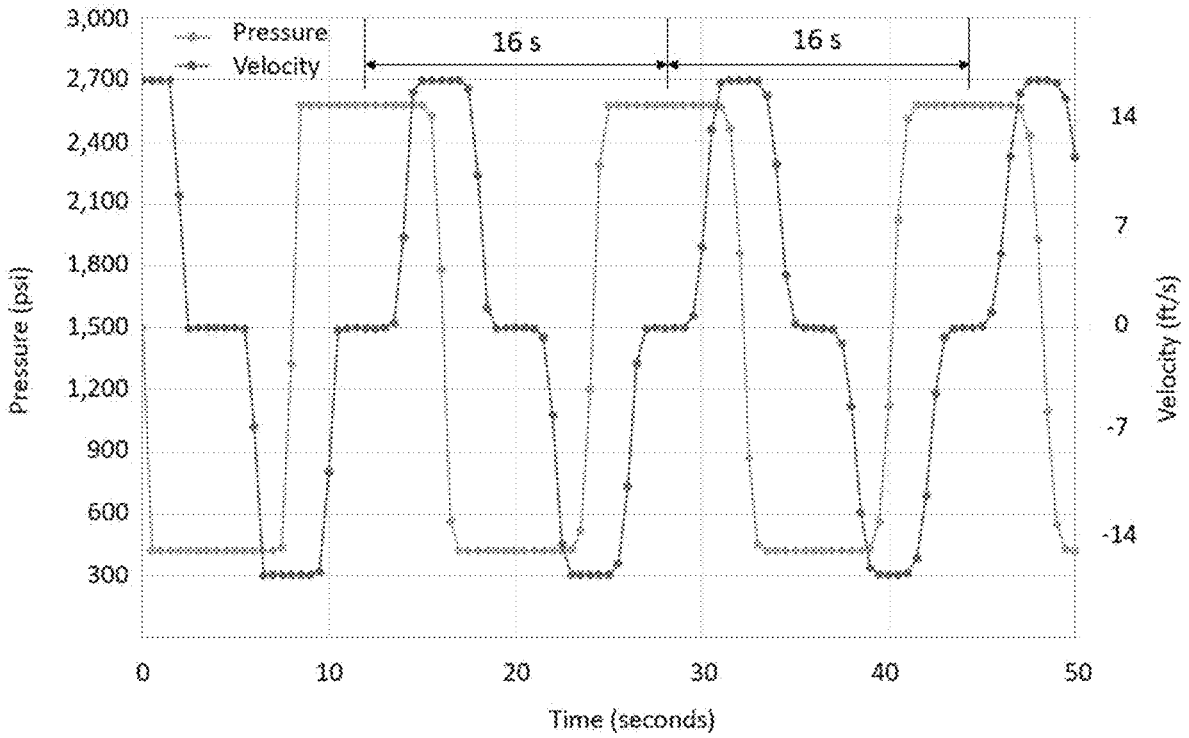
FIG. 5 demonstrates wellhead (inlet) pressure and velocity as a function of time: closed inlet, constant pressure outlet.
Figure 60:
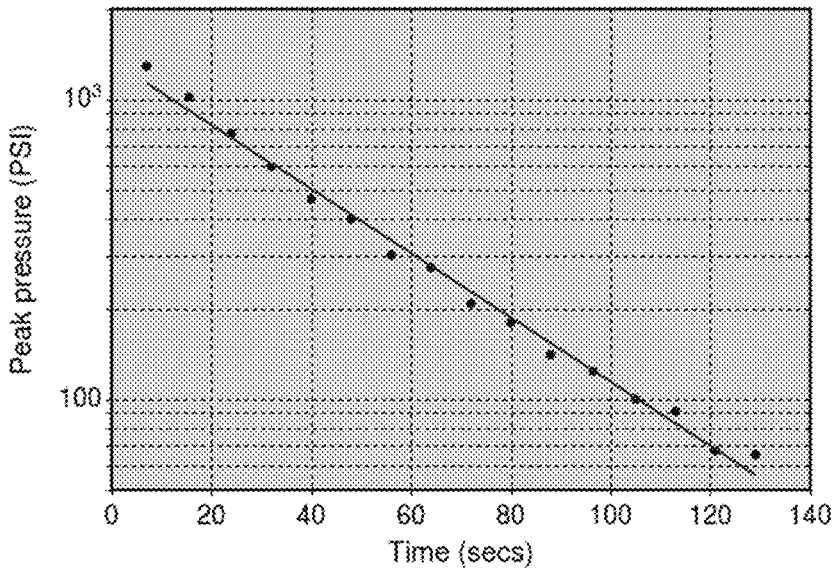

FIG. 60 illustrates magnitudes of peak-trough pressure differences for the water hammer of FIG. 5.

Figure 61:
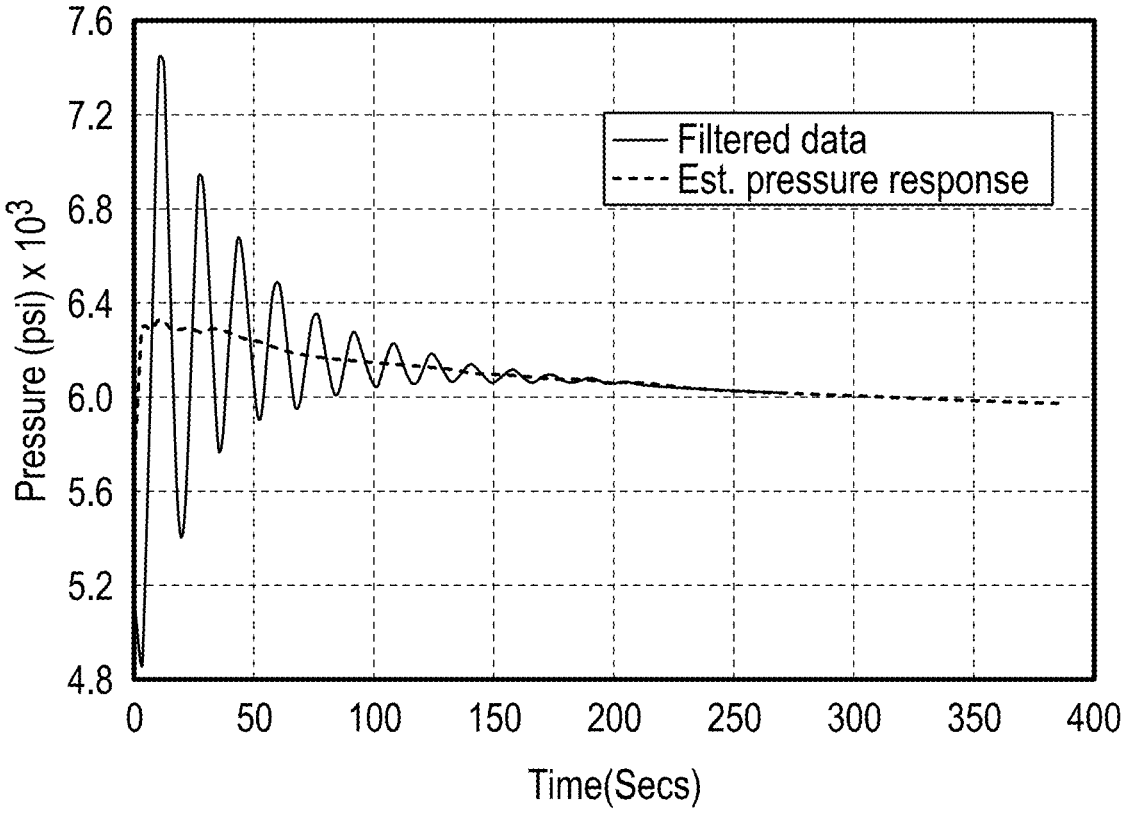
Figure 61:
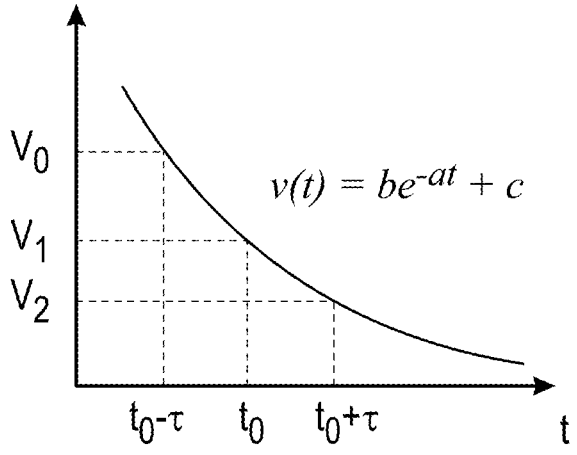

FIG. 61 is a comparison between the filtered pressure data before (black) and after (blue) the modeled water hammer is subtracted.

Figure 62:
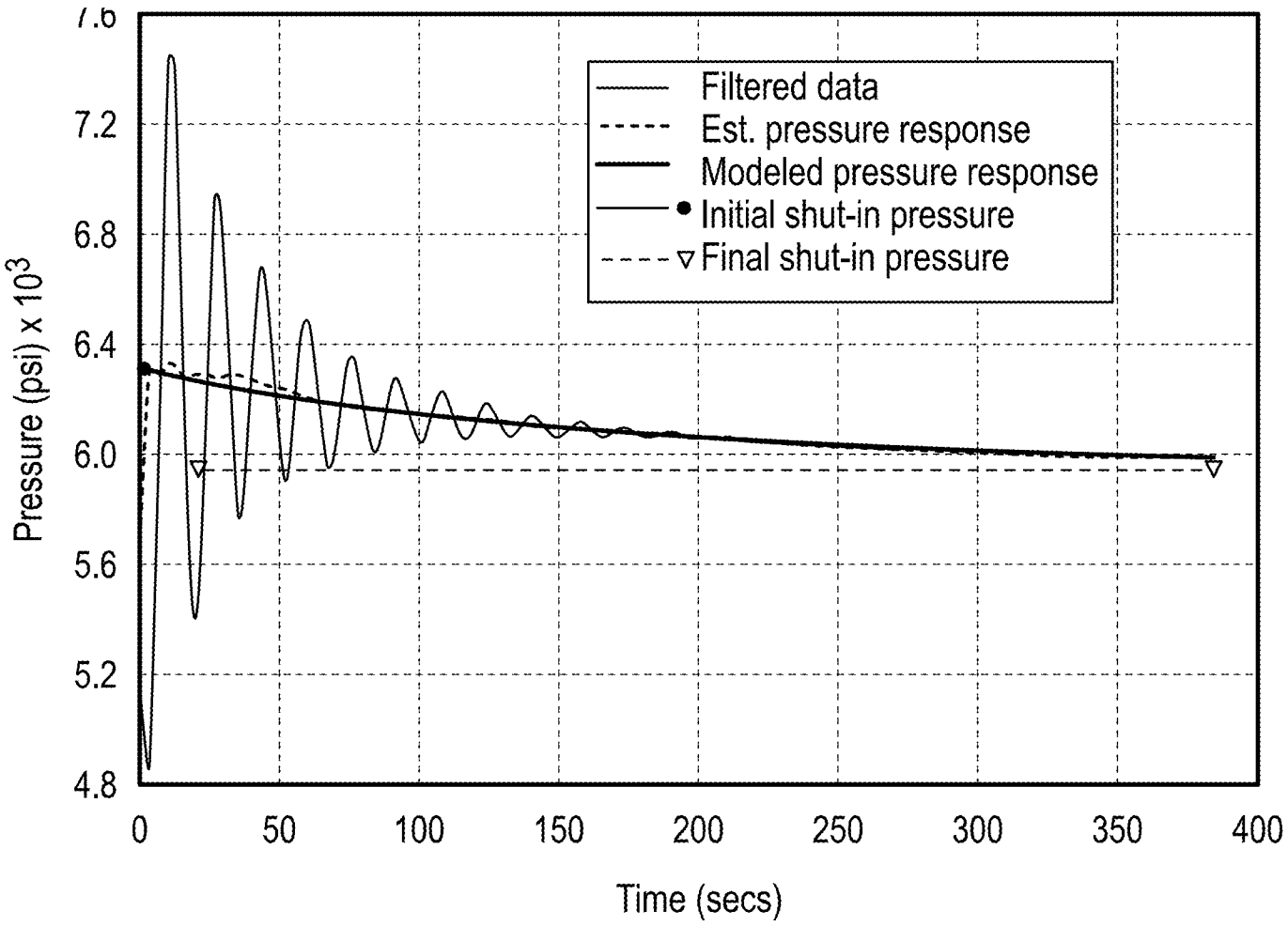

FIG. 62 compares the filtered data (black), the estimated pressure response (blue) and the modeled pressure response (red).

Figure 63:
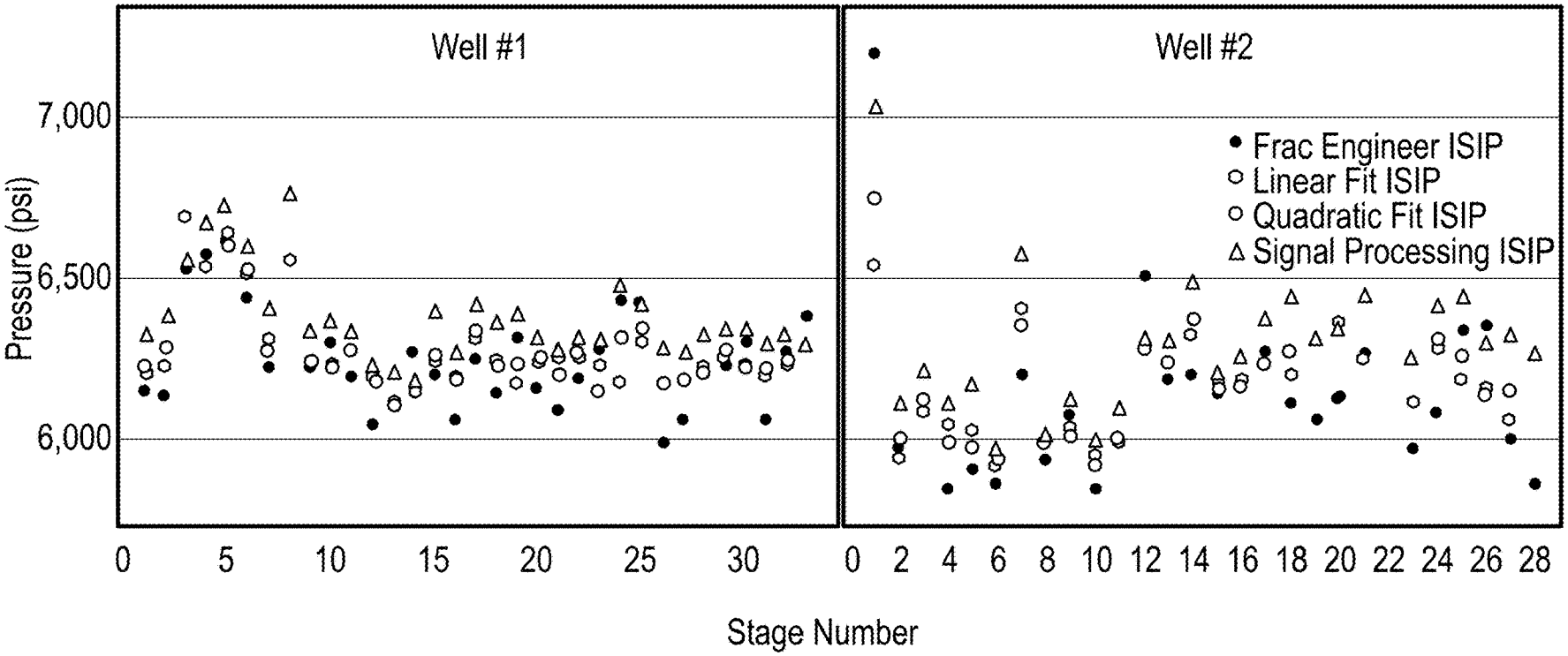

FIG. 63 compares the ISIP pics for two wells based on Frac Engineer, linear fit, quadratic fit and signal processing.

Figure 64:
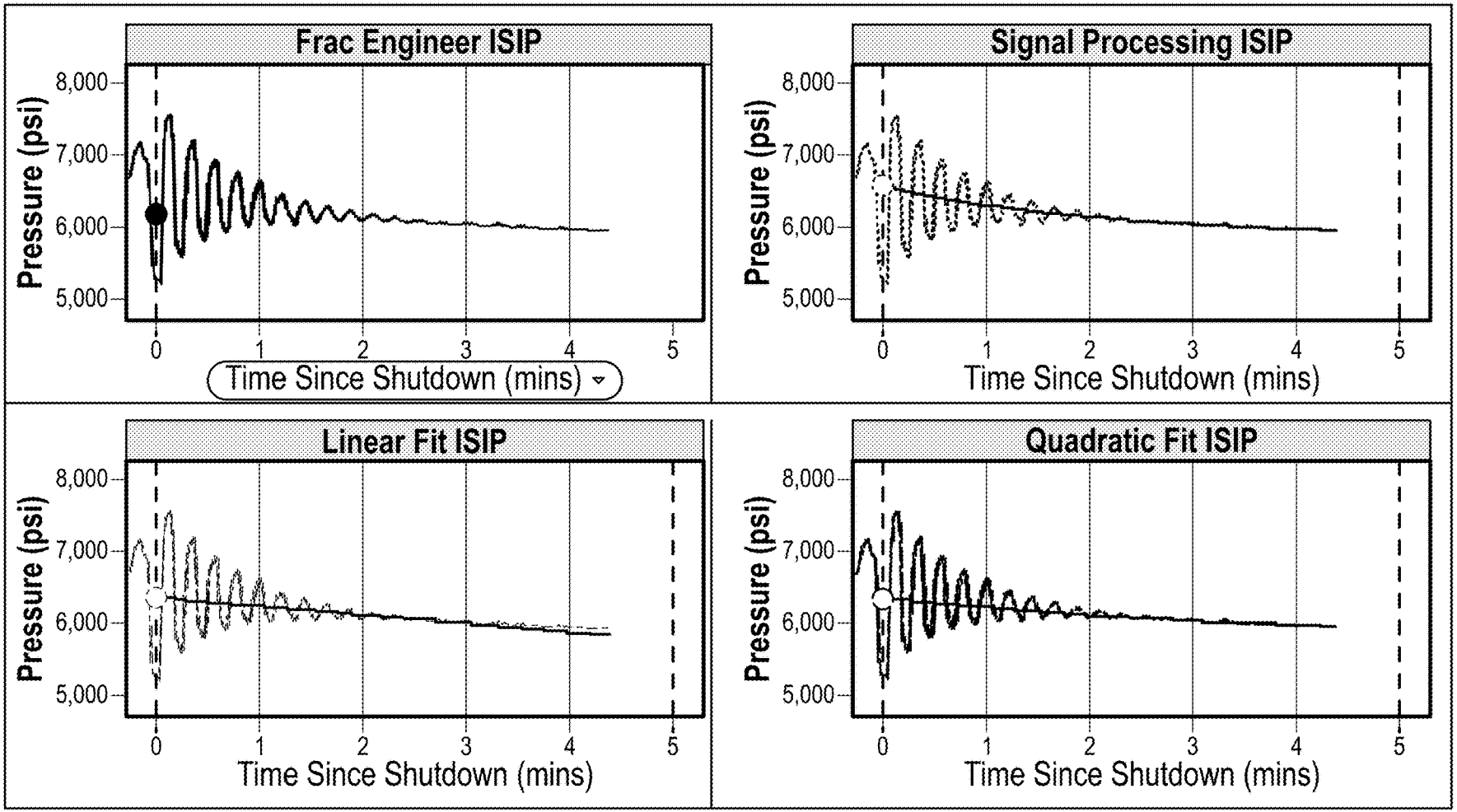

FIG. 64 is the Shut-In Pressure, ISIP Comparison of Well #2 Stage #7

Figure 65:
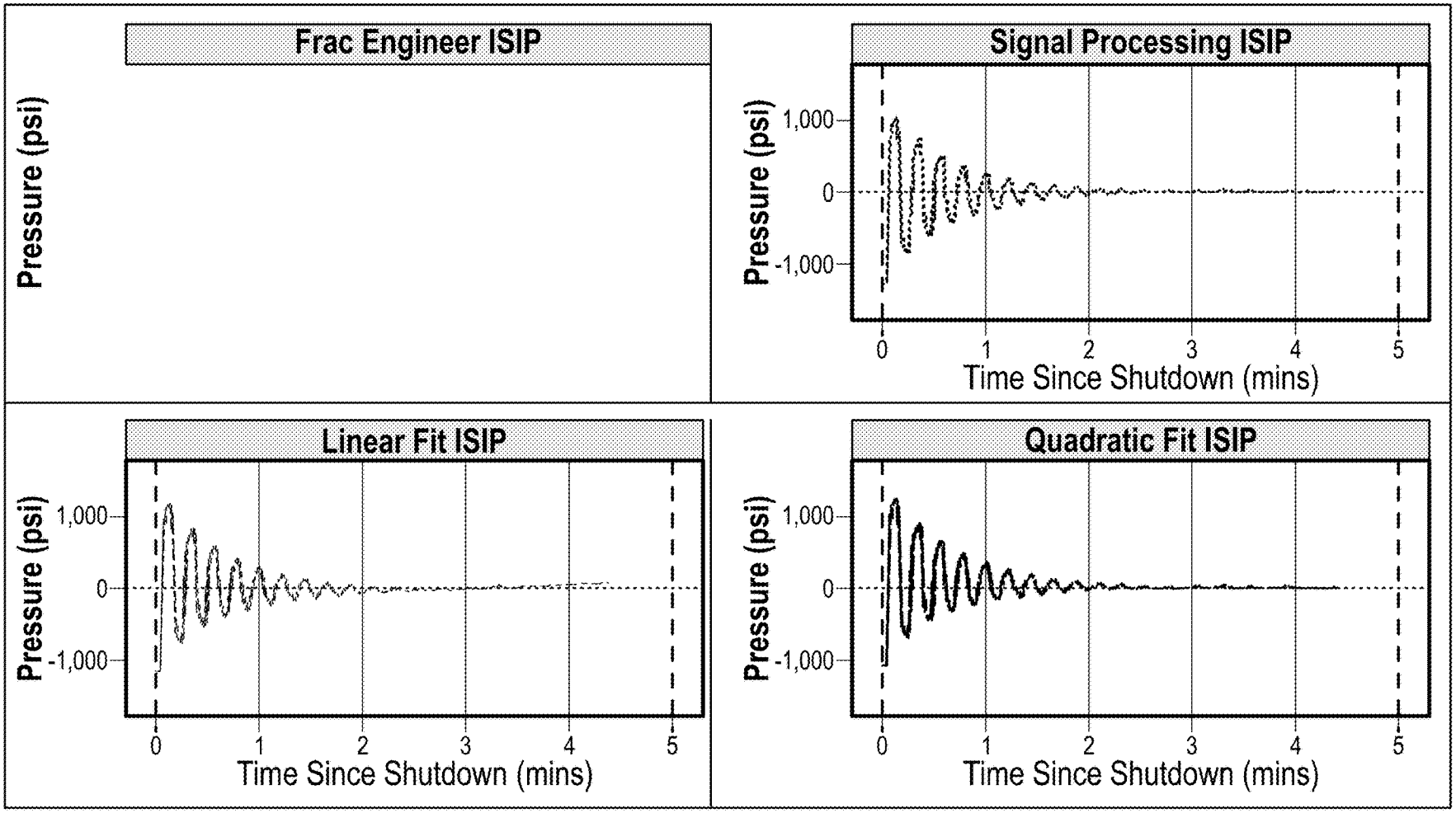

FIG. 65 is the Flattened Water Hammer Pressure of Well #2 Stage #7

Figure 66:
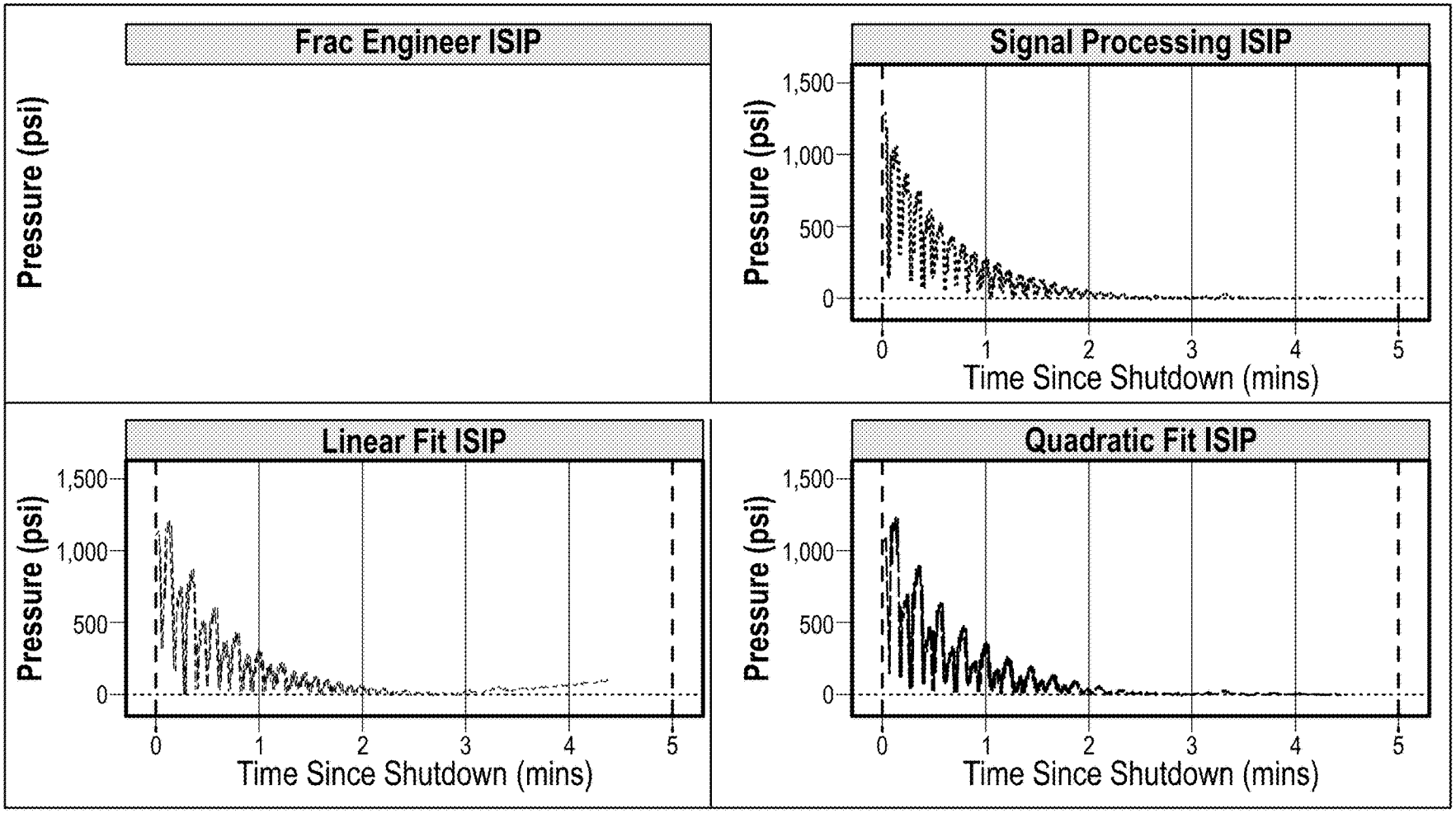

FIG. 66 is an absolute Value of Flattened Water Hammer Pressure of Well #2 Stage #7

Figure 67:
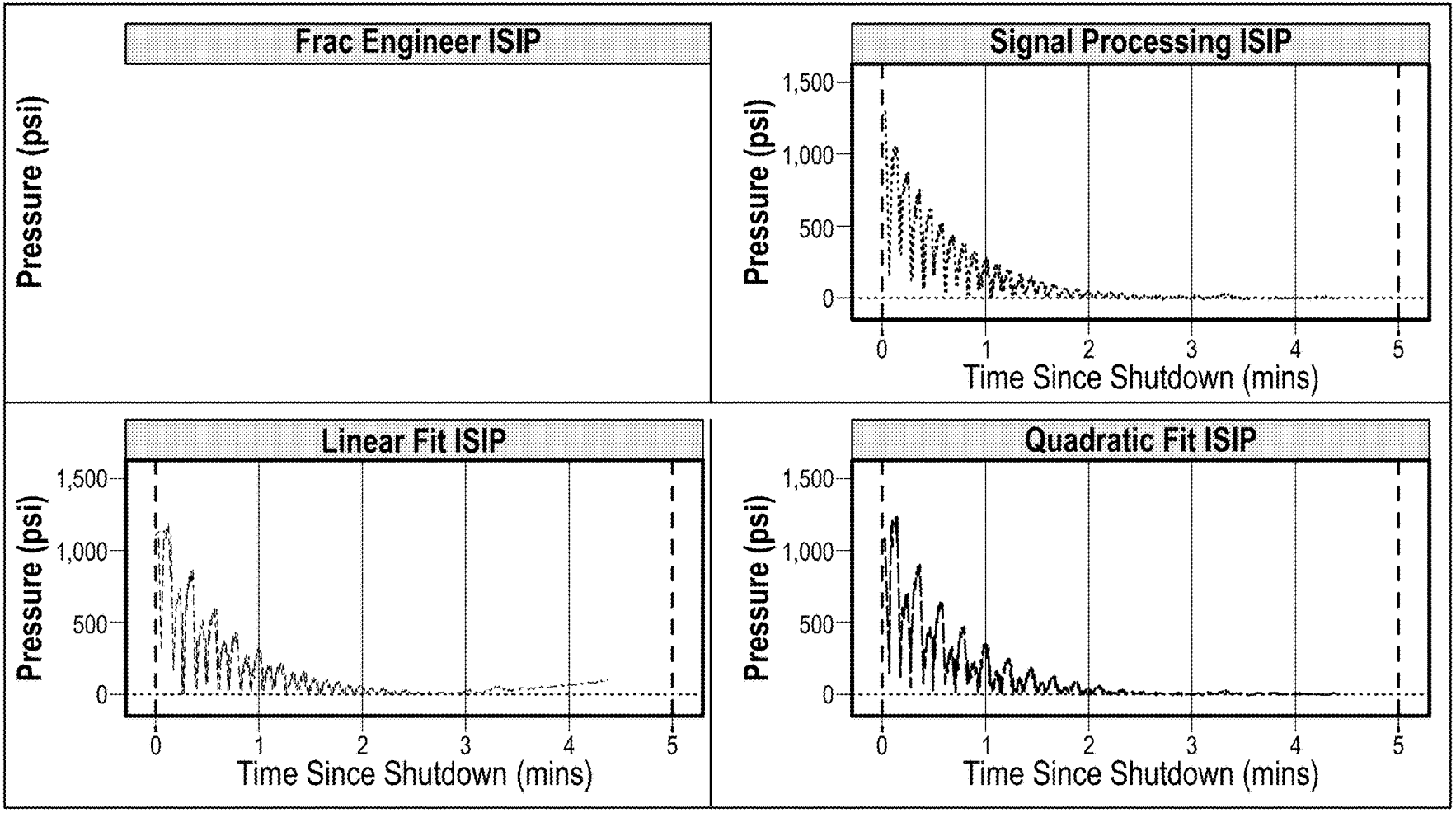

FIG. 67 shows Shut-In Pressure, ISIP Comparison of Well #2 Stage #1

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Water hammer is oscillatory pressure behavior in a wellbore resulting from the inertial effect of flowing fluid being subjected to an abrupt change in velocity. It is commonly observed at the end of large-scale hydraulic fracturing treatments after fluid injection is rapidly terminated. Factors affecting treatment-related water hammer behavior are disclosed and field studies are introduced correlating water hammer characteristics to fracture intensity and well productivity.

A simulator based on fundamental fluid-mechanics concepts was developed to model water hammer responses for various wellbore configurations and treatment characteristics. Insight from the modeling work was used to develop an optimal process of terminating fluid injection to obtain a consistent, identifiable oscillatory response for evaluating water hammer periodicity, decay rate and oscillatory patterns. A completion database was engaged in a semi-automated process to evaluate numerous treatments. A screening method for enhancing interpretation reliability was developed. Derived water hammer components were correlated to fracture intensity, well productivity and in certain cases, loss of fracture confinement to the intended treatment interval.

Figure 1:
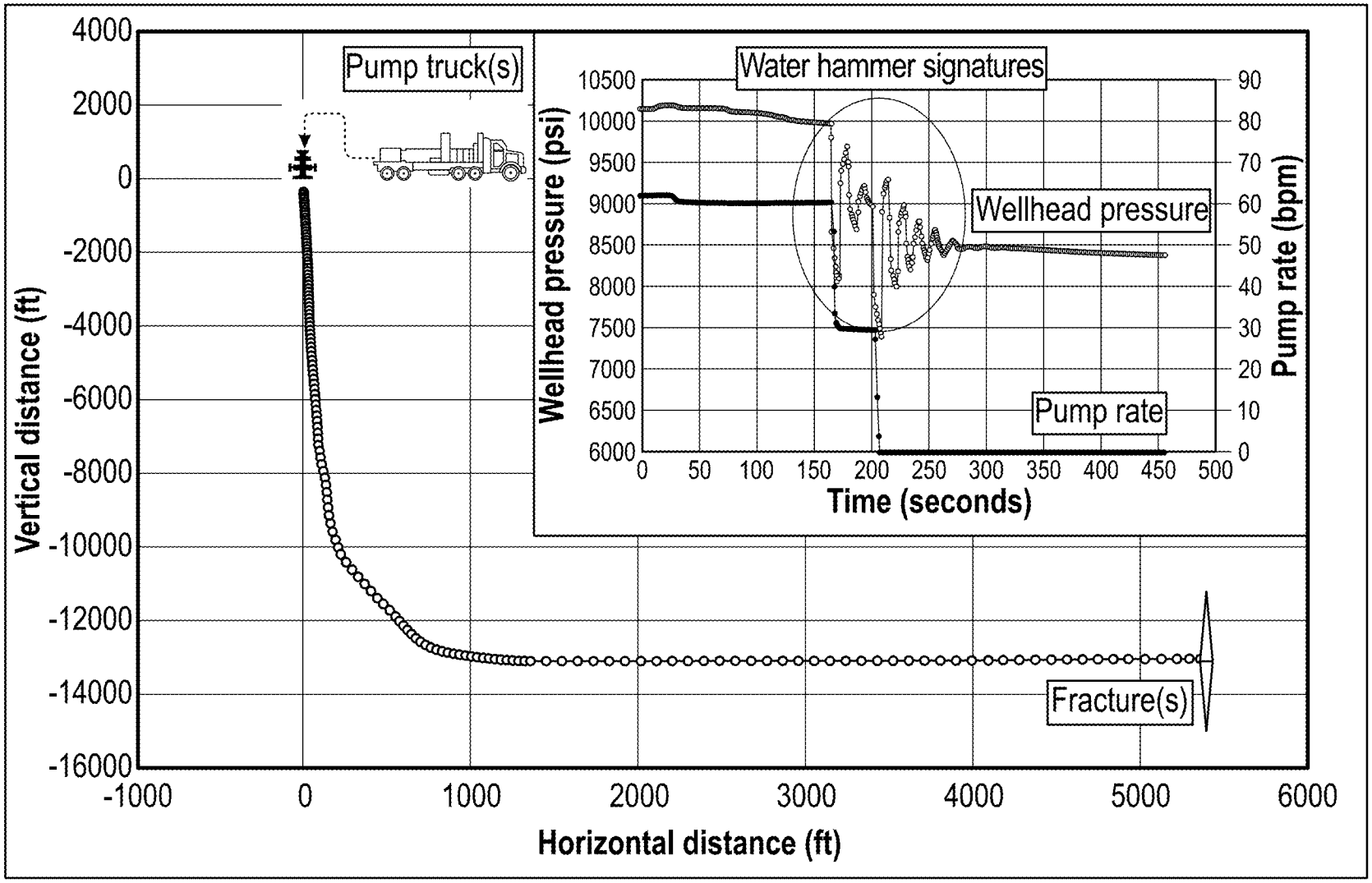
FIG. 1 is a schematic of a well, hydraulic fracture treatment, and water hammer signature.

Water hammer is oscillatory pressure behavior in a wellbore resulting from the inertial effect of flowing fluid being subjected to an abrupt change in velocity. It is commonly observed at the end of large-scale hydraulic fracturing treatments after fluid injection rate is rapidly reduced or terminated. Water hammer occurs when there is a fast change in operating conditions for a well or pipeline. This may involve the sudden closing of a valve or change in injection or production rate. In this paper, the focus is for rate step-downs or termination (shut-in) conducted near the end of fracturing treatments. For routine hydraulic fracturing applications, different processes during completion may result in a water hammer signature (see FIG. 1) including pump trucks inject fracturing fluid and proppant into the well or a sudden rate reduction and/or pump shutoff, a pressure pulse is measured at the wellhead. For FIG. 1, two rate reductions were conducted. The first was to half rate; the second was to zero rate. With each rate reduction, separate water hammer signatures resulted. This pulse moves from the surface down through the wellbore, interacts with the created hydraulic fractures, and is reflected up the wellbore. This process will repeat periodically until energy is drained from the pulse.

Figure 2:
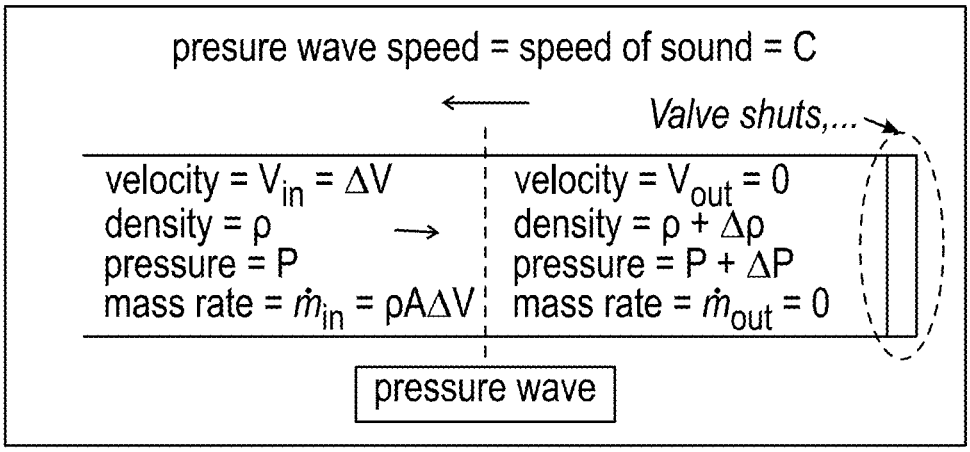
FIG. 2 shows a pipe carrying fluid with a fast closing valve (fixed frame).

The water hammer pressure signature is the result of the conversion of the kinetic energy of the fluid to potential energy when the surface injection rate is sharply reduced or terminated. The potential energy change is expressed as a sudden increase or decrease of fluid pressure. FIG. 2 shows a pipe carrying fluid moving at a speed ΔV with a density of ρ and pressure of P which is stopped by a fast-closing valve from a fixed frame of reference. This sudden closure leads to a velocity decrease to 0, a density increase of p+Δρ, a pressure increase of P+ΔP upstream of the valve, and the creation of a pressure wave (indicated by the dashed line) moving from right to left at the fluid speed of sound, C.

Figure 3:
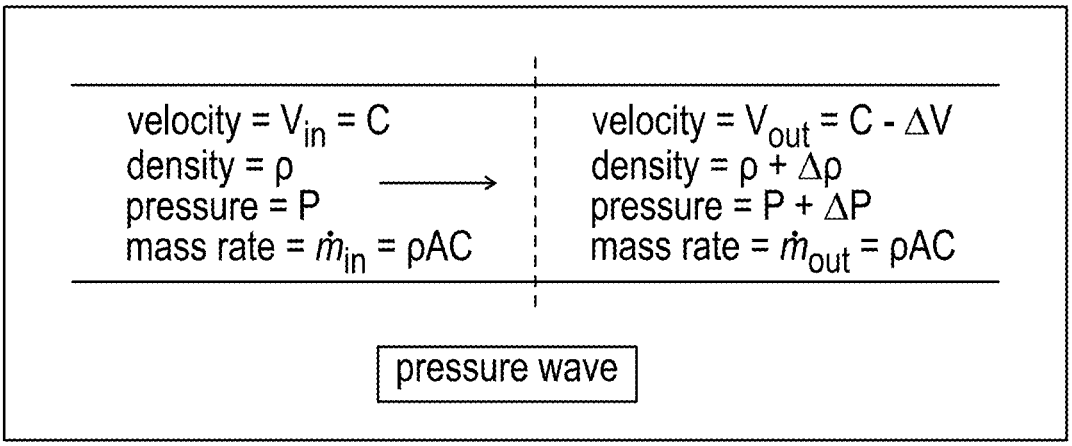
FIG. 3 shows a pipe carrying fluid with a fast closing valve (moving frame).

FIG. 3 shows the same concept as FIG. 2, but the difference is the frame of reference. FIG. 2 is a fixed frame of reference while FIG. 3 is a moving frame of reference where the coordinate system moves with the pressure wave at the speed of sound. The pressure wave is indicated by the dashed vertical line. For the modeling concept of using a moving frame reference, the mass rate is the same upstream and downstream of the pressure wave.

Applying a force balance across the pressure wave in the moving frame:

$$F=\dot{m}(V_{out}-V_{in})=(\rho AC)(C-AV-C)=-\rho AC\Delta V \quad \text{(Eq. 1)}$$

$$\Delta P=F/A=-\rho C\Delta V \quad \text{(Eq. 2)}$$

The equation above is the Joukowsky equation, which relates the pressure change ΔP in response to a change in velocity ΔV. The pressure change ΔP can be either positive or negative, depending on how it was created. For example, for a sudden valve closure in the middle of a wellbore where fluid was being pumped down the wellbore, there will be a pressure increase upstream of the valve as pressure 'piles up' against the closed valve. There will also be a corresponding pressure decrease downstream of the valve as fluid moving downstream of the closed valve 'pulls' on the fluid that has been stopped by the closed valve. The resultant pressure wave created by the water hammer event moves at the speed of sound of the fluid through the wellbore (adjusted to accommodate wellbore and multiphase effects as necessary). This pressure wave then reflects off wellbore diameter reductions, leaks, perforations, and ultimately the hydraulic fracture system.

The following examples of certain embodiments of the invention are given. Each example is provided by way of explanation of the invention, one of many embodiments of the invention, and the following examples should not be read to limit, or define, the scope of the invention.

Depending on the nature of the boundary condition imposed at the bottom of the well, the periodicity of the water hammer signature at the top of the well induced by the injection pump step-down will change significantly. For unconventional reservoirs characterized by low and ultra-low permeability, the following are examples of the two boundary condition scenarios. For Scenario 1 & Scenario 2: Well length is 6,000 m (19,694 ft); Well diameter is 11.86 cm (4.67 inch); The fluid density is 1,000 kg/m3 (8.34 lb/gal); Fluid speed of sound: 1,500 m/s (4,920 ft/s); and, for simplification, hydrostatic pressure variations within the wellbore are not considered.

Figure 4:
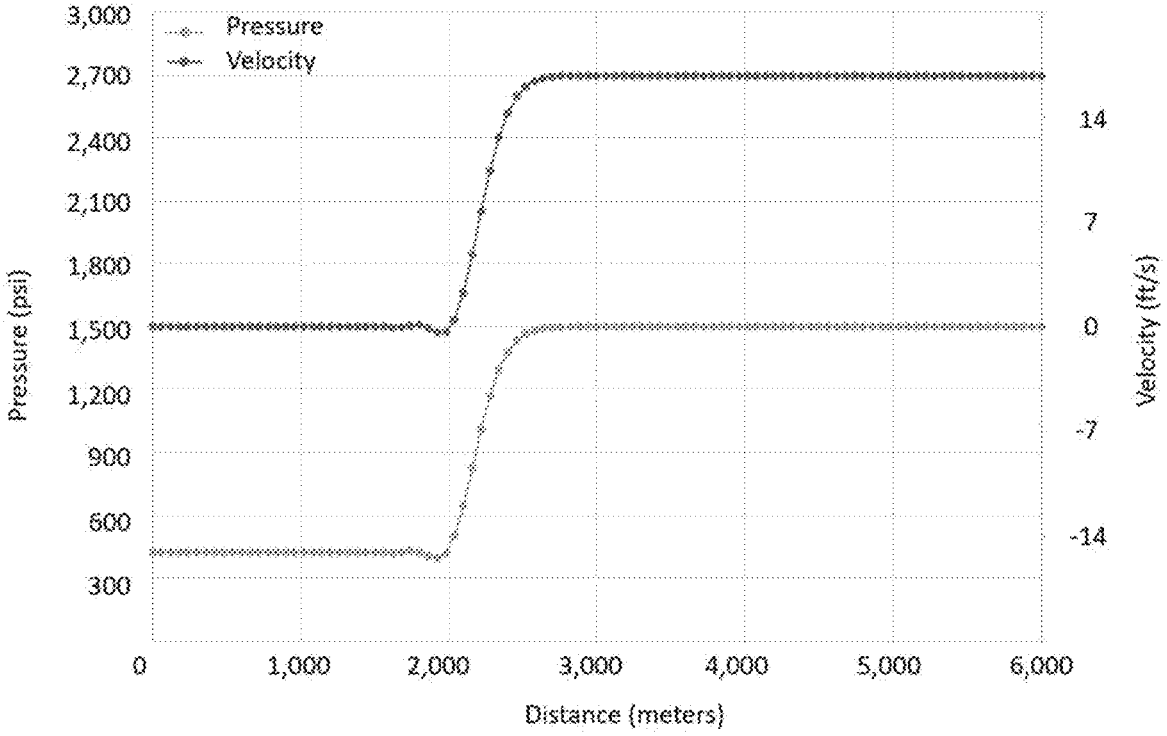
FIG. 4 demonstrates pressure and velocity vs. wellbore length from inlet, 1.5 seconds into the shut-in: closed inlet, constant pressure outlet.
Figure 6:
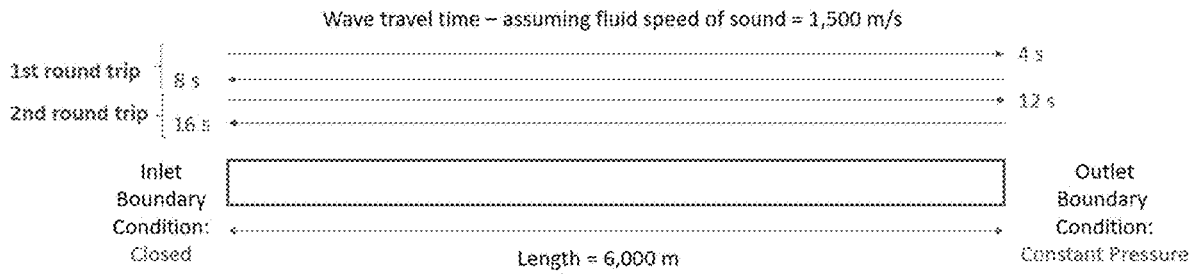
FIG. 6 provides a schematic of wave travel time for one water hammer cycle (period): closed inlet, constant pressure outlet.

Scenario 1—Closed Inlet and Constant Pressure Outlet:

The closed inlet/constant pressure condition exists during shut-in at the end of a treatment, where hydraulic fractures were created thereby having large fracture capacity (closed inlet=shut-in of well at the surface; constant pressure outlet=large fracture capacity at the bottom of the wellbore). FIG. 4 shows the behavior of a well which is closed at the inlet while maintaining a constant pressure at the outlet. After 1.5 seconds into the shut-in, a pressure deficit is created at the inlet of the well. The fluid has stopped near the inlet (velocity equals zero) but is moving elsewhere further down from the inlet. As indicated in FIG. 5, the wave pattern repeats itself every 16 seconds, meaning that a pressure wave moving at 1,500 m/s will make two round trips back and forth through the wellbore per cycle (per period). FIG. 6 provides a visual to further explain the relationship between this boundary condition (closed inlet and constant pressure outlet) and the water hammer period. The time for the pressure wave to travel the distance of the 6,000 m pipeline would be the length of the wellbore divided by the fluid speed of sound (6,000 m/(1,500 m/s)=4 seconds). Two round trips equal four times the length of the pipeline. The cycle or period is equal to four times the wave travel time for the length of the pipeline. (For this example, 4×4 s=16 seconds.)

Figure 7:
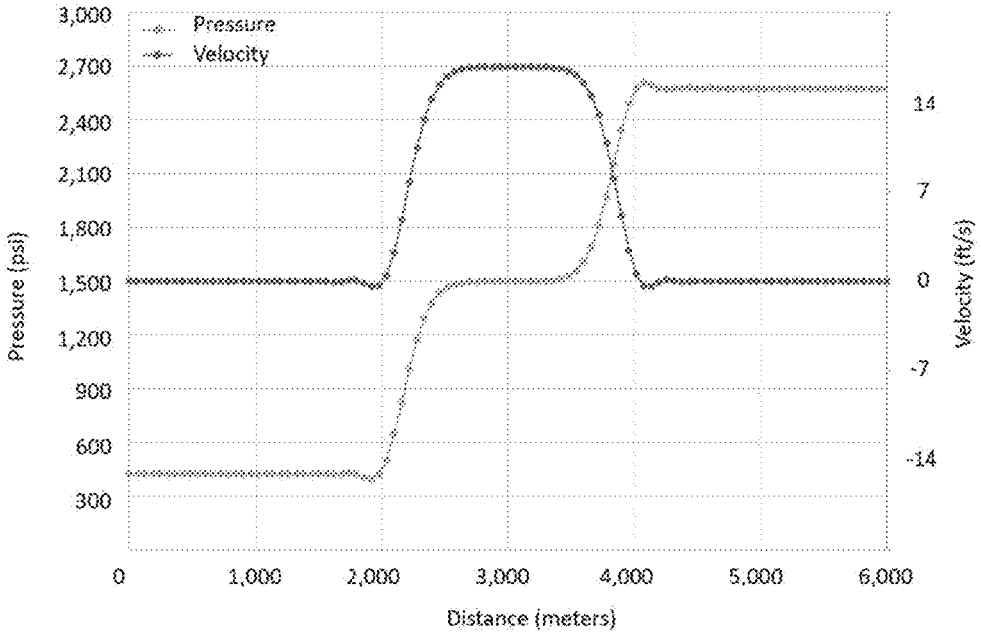
FIG. 7 shows pressure and velocity vs. wellbore length from inlet, 1.5 seconds into the shut-in: closed inlet, closed outlet.
Figure 8:
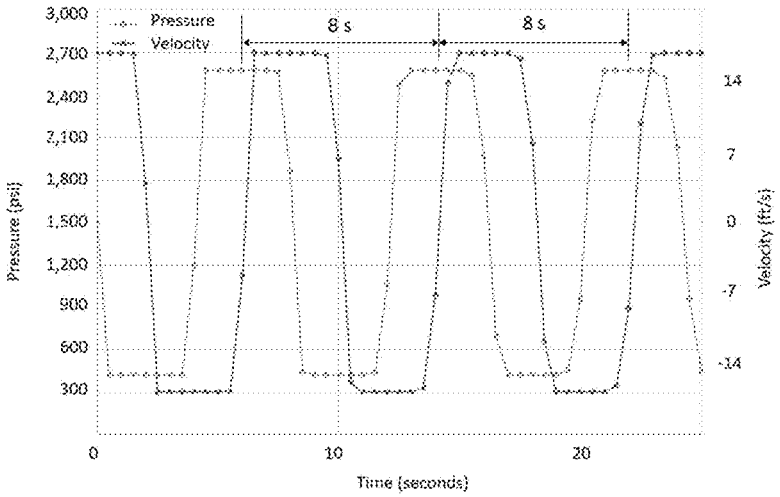
FIG. 8 shows wellhead (inlet) pressure and velocity as a function of time.

Scenario 2—Closed Inlet and Closed Outlet.:

Field examples of the closed inlet/closed outlet condition include shut-in as the result of a screen out event (closed inlet=shut-in of well at the surface; closed outlet=screen out at the bottom of the wellbore) and generated shock waves (e.g., perforating event) when there is nil fracture capacity at the wellbore outlet. FIG. 7 shows the behavior of a well that is closed at the inlet and the outlet. After 1.5 seconds into the shut-in, a pressure deficit is created at the inlet of the well. The fluid has stopped near the inlet and the outlet (velocity equals zero) but is still moving forward in the middle of the pipe. As indicated in FIG. 8, the wave pattern repeats itself every 8 seconds, meaning that a pressure wave moving at 1,500 m/s will make one round trip back and forth through the pipeline per cycle (per period).

FIG. 9 provides a visual to further explain the relationship between this boundary condition (closed inlet and closed outlet) and the water hammer period. The time for the pressure wave to travel the distance of the 6,000 m pipeline would be the length of the wellbore divided by the fluid speed of sound (6,000 m/(1,500 m/s)=4 seconds). One round trip equals two times the length of the pipeline. For the boundary conditions of closed inlet and closed outlet, the pressure period is equal to two times the wave travel time for the length of the pipeline. (For this example, 2×4 s=8 seconds.)

The following equation can be used to calculate the expected period for a water hammer signature:

$$\text{Period (sec)}=B\times MD/C \quad \text{(Eq. 3)}$$

Where: B is the boundary condition factor, B is 4 for closed inlet and constant pressure outlet while B is 2 for closed inlet and closed outlet; MD is measured depth to flow exit (such as the perforation depth) in ft or m; and C is the fluid speed of sound in the wellbore in ft/s or m/s.

Using the above process, hundreds of hydraulic fracturing treatments were evaluated, and the results of that work are included in this study. The treatments were performed in wells based in Texas, South America and Canada and completed in low permeability and unconventional reservoirs. Water hammer decay rate was determined to be a reliable method of determining the system friction (friction in the wellbore and hydraulic fracture network) that drains energy from the water hammer pulse. In unconventional reservoirs characterized by small differences in the minimum and maximum horizontal stress, high system friction correlated positively with fracture intensity/complexity and well performance. Results were constrained with instantaneous shut in pressure (ISIP) and pressure falloff measurements to identify instances of direct communication with offsetting, previously treated wellbores. The resulting analyses provided identification of enhanced-permeability intervals, indications of hydraulic fracture geometry and assessment of treatment modifications intended to enhance fracture complexity. Additionally, it was sometimes possible to identify loss of treatment confinement to the intended interval and locate associated points of failure in the wellbore.

Shut-In Pressure Model:

FIG. 10 provides an example of a water hammer signature that was induced at the end of a treatment stage when the injection rate was shut down rapidly. The x-axis is the time in seconds since the rate shutdown. The red series is the treating pressure; the green series is the rate. Using a completion database with over 1,200 wells with over 40,000 stages of one-second treatment data. The capability to iteratively develop and improve the analysis method/modeling and to efficiently use the treatment data from the completions database facilitated our learning in respect to the shut-in process and the subsequent water hammer signature. The data considerations/requirements, the data analysis methods, and modeling are provided herein.

Treatment pressure data is typically recorded at a frequency of 1 Hz (1 data point per second). A high frequency pressure gauge was used to determine if 1 Hz was an acceptable sampling frequency to adequately capture the characteristics of the water hammer that is induced by sharply reducing or terminating the treatment injection rate.

Pressure data was recorded at a sampling frequency of 50 Hz, and the resulting data was edited to lower sampling frequencies to compare the resulting quality of the water hammer signature. A key assumption for this exercise is that the specifications (e.g., accuracy, resolution, frequency response) for the high frequency pressure transducer would be similar to the pressure transducer being provided by the service company for the standard one-second frequency treatment data. The water hammer pressure data shown in FIG. 11 is from a treatment with an average perforation depth of 17,370 ft MD with the original sampling frequency of 50 Hz and edited sampling frequencies of 2 Hz, 1 Hz, and 0.5 Hz. While the data recorded at 50 Hz shows more detail, the sampling frequency of 1 Hz captures the overall characteristics of the water hammer signature. For this data set, 2 Hz was the lowest sampling frequency that appeared to show the full shape of the water hammer signature. At 1 Hz and 0.5 Hz, the water hammer signature becomes much more smoothed with less character. Therefore, a sampling frequency of 1 Hz is adequate to characterize the water hammer period and decay rate. Higher sampling frequencies could be beneficial for performing more detailed analysis.

For the same operation noted in the prior section, two transducers recorded wellhead pressure. One was the 50 Hz pressure transducer (non-standard for our normal hydraulic fracturing treatments); the other was the service company pressure transducer which provides one-second frac data (an industry standard for hydraulic fracturing treatments). The two data sets are compared in FIG. 12. the comparison of the 50 Hz pressure transducer versus the 1 Hz service company transducer:

The top chart in FIG. 12 compares the 50 Hz pressure data set (blue series) against the 1 Hz service company pressure data (red series). A 3 second offset between the two data sets was identified. On the bottom chart in FIG. 12, the 50 Hz pressure data was corrected with a time offset (yellow series) to line up with the 1 Hz service company pressure data. One data consideration/requirement is time synchronization of sensors during operations to minimize time offset corrections for analysis. Overall, the water hammer signature corresponds between the two transducers. Both data sets have the same water hammer period and general shape. The 1 Hz service company pressure data seems to be more smoothed (captures less of the water hammer character) and has lower peaks/higher troughs compared to the 50 Hz transducer. This is due to differences in pressure transducer specifications. The 50 Hz transducer has a faster frequency response to pressure changes compared to the 1 Hz service company transducer. For water hammer modeling and pressure matching, pressure transducer specifications should be considered. The 1 Hz service company transducer measurement is adequate to characterize the water hammer period and decay rate. Higher sampling frequencies and improved pressure transducer specifications could be beneficial for performing more detailed analysis and water hammer modeling.

The water hammer period is a function of the speed of sound in fluid and the measured depth of the stage. On very shallow stages, the water hammer peaks will return to surface much faster and a sampling frequency of 1 Hz may not be adequate to fully capture the shape of the water hammer. The expected water hammer period can be calculated by using a rough estimate of 1 second per every 1,200 ft MD (4,000 m MD) of stage depth. It is recommended to use a sampling frequency that will collect at least 8 data points per water hammer period to ensure that the water hammer signature is adequately sampled.

TABLE 1

Perforation depth and water hammer period for closed inlet and constant pressure outlet.

| Perforation Depth (ft) | Perforation Depth (m) | Water Hammer Period Time (s) |
|---|---|---|
| 5,000 | 1,524 | 4 |
| 10,000 | 3,049 | 8 |
| 15,000 | 4,573 | 12 |
| 20,000 | 6,098 | 16 |

The input assumptions for Table 1 is that the fluid speed of sound is 5,000 ft/s (1,500 m/s), and the boundary condition for the well is a closed inlet and a constant pressure outlet. For the boundary condition of closed inlet and closed outlet, the water hammer period is half of the values listed below.

Over the course of evaluating shut-in pressure data, various data issues have been encountered that result in analysis issues. From over 15,000 stages analyzed from hydraulic fracturing treatments in Texas, South America, and Canada, approximately 20% of stages had confirmed data quality issues. The following are the data quality issues encountered: Data stops before water hammer ends; Incorrect representation of wellhead pressure; False injection rates; Smoothed data; and Data accuracy. There are operational considerations and data requirements that can be implemented to reduce these data quality issues. Data quality requirements can further to referenced in the Data Quality Assurance Contract Addendum posted on the Operators Group for Data Quality web site (www.OGDQ.org).

Currently, the predominant method of acquiring treatment data from service companies is through CSV (comma-separated values) files. After the end of a treatment stage, an engineer from the treatment service company provides a post job report and a CSV file containing 1 Hz data for the hydraulic fracturing treatment. The data includes time, pressure, and rate. For the treatment stage, the engineer manually selects the start and end time of the data to be exported into the CSV file. As third-party aggregation services further develop and improve in the completions space, these same data quality issues will need to be reviewed and addressed.

FIG. 13 shows an example of a treatment stage where only 10 seconds of data was provided for the shut-in period. This is insufficient time to evaluate the water hammer signature. FIG. 14 shows the equipment configuration where a valve is shut isolating the treating pressure transducer from the wellhead. When the valve is closed, Pressure Sensor #1 measures the pressure in the surface lines upstream of the valve (blue colored line) and not in the surface lines downstream of the valve (black colored line) which would be the wellhead pressure. Three examples of Scenario 1 are provided in FIG. 15. Pressure Sensor #1 (in FIG. 14) is providing the Treating Pressure noted in FIG. 15. The dashed blue vertical line represents the time at which the valve was closed. Once the valve is closed, the Treating Pressure no longer represents the wellhead pressure. For first and second example, after the valve was closed, the pressure was not bled off immediately. The pressure trend between the valve closure and the pressure bleed off represents the pressure in the surface line upstream of the closed valve. This pressure trend does not represent the wellhead pressure. A flat pressure trend means the pressure is holding, a declining pressure trend means there is a loss of pressure (like a leak), and an inclining pressure trend means there is an increase in pressure (due to pumping or temperature fluid expansion). For the third example, after the valve was closed, the pressure in the upstream surface lines was bled off immediately.

Multiple pressure transducers may be installed in the surface treating lines. The service company engineer selects which are to be viewed and recorded in the Treating Pressure channel during the treatment operation. If the pressure sensor selected as the Treating Pressure channel is located on the injection pump side and upstream of check valves, and the injection rate is terminated, the pressure transducer could become isolated from the wellhead pressure. The basic configuration is shown in FIG. 16. Pressure Sensor #1 and Pressure Sensor #2 are two transducers on the surface line from which the service company engineer can select to represent the Treating Pressure. Pressure Sensor #1 is upstream of the check valve; Pressure Sensor #2 is downstream of the check valve. Check valves allow flow in one direction, from left to right as indicated by the arrow on the check valve symbol. If the pressure is greater downstream of the check valve than upstream, the check valve will prevent flow going back upstream thereby isolating Pressure Sensor #1 from Pressure Sensor #2. Afterward, the two pressure sensors will have different readings.

The example shown in FIG. 17 indicates that initially Pressure Sensor #1 was selected as the Treating Pressure channel. The Treating Pressure channel properly represented the wellhead pressure until the rate dropped to zero. At this time, wellhead pressure dropped due to the Joukowsky effect. Eventually the wellhead pressure increased due to rebound of the water hammer pulse. The associated reverse flow up the wellbore caused the check valve to close, resulting in the pressure upstream of the check valve being lower than the pressure downstream of the check valve. At this point, Pressure Sensor #1 was isolated from Pressure Sensor #2 by the check valve. Around 10 seconds into the shutdown, the service company engineer recognized the wellhead pressure was not reading correctly, then switched to Pressure Sensor #2 for the Treating Pressure channel. An estimate of the missing water hammer pressure is drawn in blue.

FIG. 18 shows an example where there is an indication of rate during the shut-in period. As there is no associated pressure increase related to the rate, this is considered a "false injection rate" as this rate is not representative of rate being injected down the well but indicates pumping for a surface only operation. The issue with the false injection rate is that rate is used to identify the shut-in period. False injection rates may result in the incorrect identification of the shut-in period.

Treatment data may not be instantaneous values but be smoothed by averaging over a set amount of time (e.g., over 10 seconds). This results in difficulty in connecting pressure with rate changes and to identify events such as the start of the shut-in period. An example of the injection rate being smoothed by averaging it over a 40-50 second period is shown in FIG. 19. If shutdown is identified by using a rate threshold (like 0.1 barrels per minute), the start of shutdown may be delayed by 40 seconds. Multiple periods of the water hammer may not be identified correctly. Also due to the smoothing, it is difficult to identify the distinct step-down rates. With smoothing of pressure data, the water hammer signature will be delayed in time and will lose its character.

In the example presented in FIG. 12, two pressure gauges (50 Hz and 1 Hz Service Company) matched overall in respect to the water hammer signature (same water hammer period and general shape) and the average pressure (minimal offset). This was a positive observation for these two pressure gauges. A comparison of two gauges on a different treatment is shown in FIG. 20. One was a recently calibrated memory gauge (blue series); the other was the service company gauge (red series). Although the pressure of the two gauges have similar trends, there is a pressure offset between the gauges of about 120 psi as determined during the shut-in period. Data for the step-down and shut-in part of this treatment stage is expanded in FIG. 21. At the stepped down injection rate of ~12 bbl/min, the service company gauge exhibited an erratic pressure pattern rather than the expected decaying pattern for the induced water hammer. For the shut-in period, the two gauges had the general trend. The service company gauge did not capture accurately the detail of the water hammer signature compared to the memory gauge. FIG. 22 shows data from the same service company gauge compared against two other pressure gauges (piezo resistive strain gauge, dual quartz gauge). The application was a diagnostic fracture injection test (DFIT) which requires high accuracy and resolution pressure data. The service company gauge registered false pressure drops and spikes. In respect to accuracy, there may be a measurement offset (120 psi offset); a device artifact/issue (false pressure drops and spikes); and/or a measurement responsiveness difference (difference in capturing slight characteristics of the water hammer) depending upon the application, instrumentation specifications should be considered. For the case of the service company gauge (FIG. 20-22), this gauge is adequate for overall pressure trends but is not suited for water hammer analysis or more precise pressure analysis (ex: DFIT).

There are three levels of actions to address the noted data quality issues including file corrections, algorithm corrections, and frac data requirements. For file corrections, request that the service company provide a corrected CSV file by re-exporting the treatment stage data and include more shut-in data. This will correct situations where more shut-in data was recorded, but the frac engineer did not select sufficient shut-in data for the CSV file. Additionally, request that the service company provide a corrected CSV file by re-exporting the treatment stage data and correcting the Treating Pressure channel to the appropriate sensor. Finally, manually correct the received CSV file to remove the false injection rates. Algorithm corrections/improvements include developing algorithms to address smoothed injection rates for the identification of the shut-in period. Developing algorithms to address false injection rates for the identification of the shut-in period.

Frac data have several unique requirements. A minimum of 3 minutes is required for the shut-in period. This data requirement may conflict with goals for reducing time between operations. The operator will need to determine the priority of the requirements. Installation of a pressure gauge to record wellhead pressure downstream of valves used to isolate multiple wells being treated sequentially. This will allow sufficient data to be acquired without delaying sequencing operations. The continuous recording of wellhead pressures can also facilitate data acquisition. Request service company to ensure that all injection rate channels accurately reflect what is being injected into the well. This may require a process to zero-out the injection rate during the shut-in period. Set instrumentation and data collection system requirements on time synchronization, reading accuracy, reading resolution, data collection frequency, and data transformations (instantaneous versus smoothed readings).

Water Hammer Analysis:

The water hammer analysis consists of 4 parts: Identification of the shut-in period; Identification of water hammer peaks and troughs; Calculation of water hammer period and the number of periods; and Calculation of water hammer decay rate (based on peak and trough pressure differences). See FIG. 23 for the parts of the water hammer nomenclature.

The shut-in period is identified using the total injection rate. At the end of the treatment stage, the start of the shut-in period is based on a rate threshold considered to be zero rate. Due to potential noise in the rate sensor, values of zero may not be recorded so data is reviewed for an appropriate rate threshold (e.g., reading less than 0.1 barrels per minute is considered zero). As noted in the Data Issues and Requirements section, additional conditions/adjustments are required to handle false injection rates or smoothed rate data.

The next step is to identify the peaks and troughs of the water hammer signature as shown in FIG. 24. Peaks and troughs are identified with yellow vertical lines. A simple algorithm to select peaks and troughs is the following. A point is a peak if the adjacent points on either side of it have values lower than it. A point is a trough if the adjacent points on either side of it have values higher than it. For water hammers of this shape, this simple algorithm can be used to identify the peaks and troughs, and their values and respective times. Due to varying water hammer shapes or potentially noisy pressure data, the simple peak/trough algorithm is not sufficient in all cases. This is exemplified in FIG. 25. Additional conditions and/or signal processing is required to handle more water hammer cases automatically.

The next step is to calculate period and the number of periods. A period is from peak to peak or trough to trough. A half period is from peak to trough or trough to peak. As shown in FIG. 24, once the water hammer signature decays to a point where the difference between peak and trough pressures are below a specified differential pressure threshold, half period are no longer identifiable. The values tabulated for the case depicted in FIG. 24 are shown in Table 2.

TABLE 2

Water Hammer Calculations for the Case Depicted in FIG. 24

| # Half Periods | # Periods | Start Time (sec) | Half Period Δ Time (sec) | Peak/Trough Value (psi) | Peak and Trough Δ Pressure (psi) |
|---|---|---|---|---|---|
| 0 | 0 | 4 | | 4,671 | |
| 1 | 0.5 | 11 | 7 | 7,214 | 2,543 |
| 2 | 1 | 19 | 8 | 5,751 | 1,463 |
| 3 | 1.5 | 27 | 8 | 6,734 | 983 |
| 4 | 2 | 34 | 7 | 5,945 | 789 |
| 5 | 2.5 | 42 | 8 | 6,494 | 549 |
| 6 | 3 | 50 | 8 | 6,022 | 472 |
| 7 | 3.5 | 57 | 7 | 6,345 | 323 |
| 8 | 4 | 65 | 8 | 6,059 | 287 |
| 9 | 4.5 | 73 | 8 | 6,239 | 180 |
| 10 | 5 | 81 | 8 | 6,076 | 163 |
| 11 | 5.5 | 88 | 7 | 6,161 | 85 |
| 12 | 6 | 96 | 8 | 6,079 | 82 |
| Average= | | | 7.7 | | |

The total number of periods is the count of half periods divided by two. For this case, there are 12 half periods, so the number of periods is 6. To calculate the period, the differential time between the half periods are calculated. The average of the half period differential time is calculated. For this case, the average is 7.7 seconds for the half periods. The period is twice the half period average which is 15.4 seconds. With more half periods, the average period becomes more accurate as issues with properly picking the start and end times of the half periods get averaged out.

The last step is to calculate the water hammer decay rate, as shown in FIG. 26. The log of peak and trough differential pressure plotted versus shut-in time (seconds) is linear. The decay rate is represented by an exponential decay. The decay rate for this case is −0.039. The R2 value of 0.986 indicates a good correlation. In the development of the decay rate function, the exponential relationship was found to provide the best correlation. This measurement provides an indication of the friction of the system that may facilitate at least a qualitative understanding of the hydraulic fracture network and its connection with the wellbore.

The water hammer numerical method used in this study is described as follows. A staggered-grid method is used, with the one-dimensional momentum equation solved on the primary grid in FIG. 27 and the mass conservation equation solved on the staggered grid in FIG. 28, where, at position k, $A_k$ is the cross-sectional area in momentum grid; $y_k$ is the elevation in momentum grid; $z_k$ is the distance in momentum grid; $Z_k$ is the distance in mass grid; $\rho_k$ is the density in momentum grid; $\overline{\rho}_k$ is the density in mass grid; $P_k$ is the pressure; $\Delta z_k$ is the length of momentum grid; $\Delta \overline{z}_k$ is the length of in mass grid; $\overline{a\Delta z}_k$ is the volume of in mass grid; and $\dot{m}_k$ is the mass rate. The velocities and mass rates are stored at the cell centers of the primary grid $\overline{z}_k$, and the pressures, temperatures, fluid properties, and masses are stored on the staggered grid 4, i.e., at the boundaries of the primary grid.

The volume of the staggered cell at position k, $\overline{a\Delta z}_k$, is given by:

$$\overline{a\Delta z}_k = \frac{A_k\Delta z_k + A_{k+1}\Delta z_{k+1}}{2} \quad \text{(Eq. 4)}$$

where $A_k$ is the cross-sectional area of cell k, $\Delta z_k$ is the length of cell k. The momentum conservation equation is written as follows:

$$\Delta z_k \frac{d\dot{m}_k}{dt} = (u\dot{m})_{in} - (u\dot{m})_{out} + \sum F_k \quad \text{(Eq. 5)}$$

where the spatial momentum terms are given by a first-order upwind scheme $$(u\dot{m})_{in} = \max(u_{k-1},0)\dot{m}_{k-1} - \min(u_{k+1},0)\dot{m}_{k+1};$$
$$(u\dot{m})_{out} = |u_k|\dot{m}_k \quad \text{(Eq. 6)}$$

and the forces acting on the fluid are given by:

$$\sum F_k = (P_k - P_{k-1})A_k - \frac{f_k|u_k|\Delta z_k}{2D_k}\dot{m}_k + (y_k - y_{k-1})\overline{\rho}_k g A_k \quad \text{(Eq. 7)}$$

where the first term is the pressure force acting on cell k, the second term is the frictional force acting on cell k, and the third term is the gravitational force acting on cell k. The density in this cell is given by:

$$\overline{\rho}_k = \frac{\rho_k A_k \Delta z_k + \rho_{k+1} A_{k+1}\Delta z_{k+1}}{A_k\Delta z_k + A_{k+1}\Delta z_{k+1}} \quad \text{(Eq. 8)}$$

The mass conservation equation is written:

$$\frac{dm_k}{dt} = \dot{m}_{k-1} - \dot{m}_k \quad \text{(Eq. 9)}$$

This equation can be re-written:

$$\frac{\overline{a\Delta z}_k}{c_k^2}\frac{dP_k}{dt} = \dot{m}_{k-1} - \dot{m}_k \quad \text{(Eq. 10)}$$

where $c_k$ is the speed of sound at the boundary of cell k. The mass equation is then solved as follows:

$$P_k = P_k^o + \frac{c_k^2\Delta t}{a\overline{\Delta z}_k}(\dot{m}_{k-1} - \dot{m}_k) \quad \text{(Eq. 11)}$$

$P_k^o$ is the pressure at position k at the beginning of the time step and $P_k$ is the pressure at the end of the time step. Using this relationship, derived from the mass conservation equation, the pressure term in the momentum equation is then replaced as follows:

$$(P_k - P_{k+1})A_k = (P_k^o - P_{k+1}^o)A_k + \frac{c_k^2\Delta t}{a\overline{\Delta z}_k}(\dot{m}_{k-1} - \dot{m}_k) - \frac{c_{k+1}^2\Delta t}{a\overline{\Delta z}_{k+1}}(\dot{m}_k - \dot{m}_{k+1}) \quad \text{(Eq. 12)}$$

This gives the momentum equation of the form:

$$\Delta z_k \frac{d\dot{m}_k}{dt} = a_k\dot{m}_{k-1} + b_k\dot{m}_k + c_k\dot{m}_{k+1} + s_k \quad \text{(Eq. 13)}$$

These equations produce a tri-diagonal matrix which can be inverted directly, without iteration. This matrix allows for an implicit solution of the mass rate vector, $\dot{m}_k$. Once the mass rates at the new time step are determined, they are used to update the pressure vector, $P_k$.

The native speed of sound in a material is related to its density and bulk modulus according to the equation:

$$K = \rho C_o^2 \quad \text{(Eq. 14)}$$

Where ρ is the fluid density, $C_o$ is the native speed of sound of the liquid, and K is the bulk modulus of the liquid.

The native speed of sound in a material is related to its density and bulk modulus according to the equation:

In addition, the speed C of a pressure impulse in a pipe must be modified to accommodate: pipe geometry with inner diameter, D and wall thickness, T; and pipe material with Young's modulus (E), Poisson's ratio (v), and nature of anchoring, (ψ).

The modified speed of sound C in a pipe is given by:

$$\left(\frac{C_o}{C}\right)^2 = 1 + \frac{\psi DK}{TE} \quad \text{(Eq. 15)}$$

where, for a line anchored throughout (casing cemented in):

$$\psi = \frac{2T}{D}(1+v) + \frac{D}{D+T}(1-v^2) \quad \text{(Eq. 16)}$$

The water hammer model is completely general, and can accommodate: complex well geometries, including changing diameter; changing properties through the well, including density, speed of sound, and viscosity; influence of drag reduction chemical on friction factor; pressure drop across the perforations (using a simplified choke model); and bulk modulus of the well casing (including the effects of the steel and cement).

In the event that there is some gas entrained in the liquid, the native speed of sound $C_o$ must be modified still further, as even a small amount of gas will have a very large impact on the speed of sound in the fluid. For a gas-liquid flow, the bulk modulus of the fluid is given by:

$$\frac{1}{K} = \frac{H_L}{\rho_L C_L^2} + \frac{H_G}{\rho_G C_G^2} \quad \text{(Eq. 17)}$$

where $H_L$ and $H_G$ are the liquid and gas volume fractions, and $C_L$ and $C_G$ are the speed of sound in liquid and gas, respectively.

The model has been tested against dozens of wells and hundreds of stages, with good fit to data, sometimes including small details in the pressure signature. FIG. 29 shows a comparison of the wellhead pressure during ramp-down of the slurry injection rate predicted by the water hammer model and measured in the field. This current developed model incorporates wellbore properties including perforations but does not incorporate the fracture network. The model provides the influence of the wellbore to the water hammer signature. Differences between the model and the actual field data can provide insight into the influence of the fracture network on the water hammer signature.

The following are the main levers for history matching the water hammer signature with the model as demonstrated in FIG. 30. Outlet constant pressure condition is set to the ISIP and used to match wellhead pressure. Friction is adjusted to affect the decay rate; Drag reduction factor, which affects the pipe friction; Perforation friction; and Well length plus excess length. The excess length is added to increase the period. This additional length may be an indicator of the extent of the fracture network or fluid/casing property anomalies that reduce the fluid speed of sound. The parameters are tuned for a stage and applied to following stages.

Observations on applied tuned model parameters to other stages, as exemplified in FIGS. 31A & B. The tuned model parameters provide a good match between the model and actual field pressure for stage 5 and 6. This is an indication that stages 4-6 are similar in respect to the wellbore, fluids, and fracture network created. For Stage 8, the actual water hammer signature does not match the model at the start of the shut-in. The difference may be due to data collection issues and/or friction changes which are causing the dampening. For Stage 11, the fit is good at the start; however, for this stage, the actual water hammer signature is dampening quicker than the model. It is uncertain whether the additional friction is due to fluid changes and/or the creation of a larger fracture network.

Water Hammer Signature:

As the injection pumps reduce or terminate rate near the end of the treatment, a water hammer pressure signature will be created at the pump discharge. The nature of this signature depends on: fluid speed of sound in casing; friction in the wellbore/fracture system; the boundary condition at the top and bottom of the well; the nature of the step-down (i.e., step-down rate change and duration); The following water hammer model sensitivity studies were conducted to understand the effect of key parameters on the water hammer signature.

In order from highest to lowest effect, the following fluid properties affect the water hammer signature. Fluid speed of sound in casing (affects the period); turbulence suppression—friction reducers in the fluid affect the development of turbulent eddy currents which thereby reduce friction (affects the water hammer decay rate); shear behavior—can affect friction reducer performance and/or actual fluid in respect to it gelling tendency (affects the decay rate); viscosity—increase in viscosity increases friction (affects the decay rate); density—impacts the speed of sound (affects the period). The fluid speed of sound in casing is affected by fluid properties (e.g., density, bulk modulus) and casing properties (Poisson's ratio, bulk modulus, internal diameter, wall thickness). The fluid speed of sound affects the period.

$$C = \frac{1}{\sqrt{\rho * \frac{1}{K} + \frac{d*(1-\nu^2)}{E*t}}} \quad \text{(Eq. 18)}$$

Where C=fluid speed of sound in casing, m/s; ρ=fluid density, kg/m$^3$, K=fluid bulk, modulus, Pa; ξ=casing Poisson ratio; d=casing internal diameter, m; E=casing bulk modulus, Pa; and t=casing wall thickness, m.

An example of the injection rate being stepped down in multiple steps is shown in FIG. 32. The frac fluid was guar-borate crosslinked gel, and the flush fluid in the wellbore was low viscosity slick water. For the rate step-down to 13 bbl/min, the water hammer signature had up to 6 periods while following the shutdown when injection was completely terminated, there were only 2 periods. At 13 bbl/min, the fluid was subject to shear forces thereby reducing its viscosity and tendency to form a rigid gel structure (characterized by a high yield point). Having greater fluidity resulted in less friction and less decay of the water hammer signature. At shutdown (0 bbl/min), there was no shear forces induced by pumping acting on the fluid. The fluid thickened which resulted in more friction and a quicker decay of the water hammer signature.

Example 1: Water Hammer Sensitivity Analysis #1

The water hammer model described in the above section was used to perform a sensitivity analysis on the effect of step-down rate change and duration on the water hammer signature. The concept of step-down rate change and duration is outlined in FIG. 33. The green series is the injection rate. Near the end of the hydraulic fracturing treatment, the injection rate is ~75 bbl/min. The injection rate is reduced by 35 bbl/min, from 75 bbl/min to 40 bbl/min. The injection rate is held at 40 bbl/min for a duration of about 30 seconds. The injection is completely terminated as rate is reduced from 40 to 0 bbl/min. For the sensitivity cases below, the fixed model inputs are: 20,000 ft from the wellhead to the perforations; Fluid speed of sound through the wellbore is 5,000 ft/s; Boundary conditions: closed inlet and constant pressure outlet, Boundary Condition Factor=4; Injection rate prior to rate step-downs=66 bbl/min. With the above inputs, the calculated period is 16 seconds per Equation 3 (4×20,000 ft/5,000 ft/s=16 seconds). Sensitivity Analysis #1: The results of a sensitivity analysis for three cases in which the initial rate is 66 bbl/min, the rate is reduced to 33 bbl/min with varied step-down duration time less than the period (15, 12, and 8 seconds), and then shut-in are shown in FIG. 34.

For step-down duration equal to 15 seconds, the peaks are showing an upward slope to the right. For step-down duration equal to 12 seconds, the peaks are showing a half downward slope, then a half upward slope. For step-down duration equal to 8 seconds, the peaks are showing a full downward slope. With short step-down duration times, the water hammer signature induced by the first step-down does not have enough time to dissipate. The water hammer signature seen at shut-in is a combination of pressure wave remaining from the first step-down and the pressure wave created by the second step-down (shut-in).

A pressure superpositioning effect is seen with step-down durations less than the period resulting in the gradual change in slope from upward sloping to downward sloping. When the duration is half the period, the slope becomes completely downward sloping. When the step-down duration equals half the period, this results in a 180° phase offset between the water hammer signature induced by the first and second step-downs. 180° phase offset means the peak of one pressure waveform coincides with the trough of the second pressure waveform.

The following are pressure-rate plots of actual treatments on the same well validating the modeling outcomes. For the treatment stage plotted in FIG. 35 (stage 23), the period was 13 seconds, calculated by measuring peak to peak. The last step-down rate was 30 bbl/min which was held for 12 seconds, close to the period. The peaks were upward sloping to the right. For the treatment stage plotted in FIG. 36 (stage 18), the period was 14 seconds. The last step-down rate was 28 bbl/min which was held for 4 seconds or less than half the period. The peaks are downward sloping to the right. This sensitivity analysis and actual treatment data observations indicate that the sloping nature of the water hammer signature is a function of the step-down duration time. It is recommended that step-down duration time is designed so that it is not less than the expected water hammer period.

Example 2: Water Hammer Sensitivity Analysis #2

The results of a sensitivity analysis for two cases in which the initial rate is 66 bbl/min, the rate is reduced to 33 bbl/min with varied step-down duration times greater than the period (30 and 60 seconds), and then shut-in are shown in FIG. 37. For the simulation with a hold duration of 60 seconds, the water hammer signature is mostly dissipated around 30-40 seconds.

The final rate reduction (33 bbl/min to 0 bbl/min, shut-in) exhibited greater peak and trough pressure differentials than the first rate reduction (from 66 bbl/min to 33 bbl/min) even though both had the same 33 bbl/min rate reduction. The magnitude of the water hammer peaks and troughs are affected by continued fluid injection. For injection rate reductions of the same magnitude, zero rate during the water hammer signature will have the greatest peaks and troughs while any rate greater than zero will reduce the water hammer signature. The higher the stabilized injection rate following the step-down, the greater the impact on water hammer signature reduction. Reviewing the 30 second duration hold (case 1), there is a slight superpositioning effect seen during the zero rate section, but it is minimal when compared against the 60 second duration hold (case 2). Based on the above results, it is recommended to hold constant the final rate step for at least 30 seconds to minimize water hammer superpositioning effects when operations require rate step-downs.

Example 3: Water Hammer Sensitivity Analysis #3

The following injection rate sensitivity was conducted to determine the effect of stepped down injection rate and the results are shown in FIG. 38. Maximum injection rate is established at 66 bbl/min. Rate is stepped down to various levels and held for 30 seconds. The rates modeled were 40, 35, 30, 25, 20 and 15 bbl/min. Injection rate is finally terminated, dropping to zero. Maintaining a higher injection rate before shut-in results in higher water hammer peaks and troughs following shut-in (Joukowsky effect). There are greater superpositioning effects on water hammer waveforms for the cases of relatively low injection rate before shut-in since the 1st rate drop is higher than the 2nd rate drop. For these cases, there is more energy from the 1st rate drop persisting through the 2nd rate drop. The rate drops are tabulated in Table 3.

TABLE 3

| Rate Drops | | |
|---|---|---|
| Initial rate (bbl/min) | $1^{st}$ rate drop (bbl/min) | $2^{nd}$ rate drop, at shut in (bbl/min) |
| 66 | 26 | 40 |
| 66 | 31 | 35 |
| 66 | 36 | 30 |
| 66 | 41 | 25 |
| 66 | 46 | 20 |
| 66 | 51 | 15 |

Rows with red font note the scenarios with observable superposition effects caused by the 1st rate drop. The period is the same for all cases. This is expected as the well configuration is the same for all cases. The recommendation is to have equivalent rate reductions or to have the last rate reductions to be higher than the prior rate reduction to minimize the superpositioning effect on the water hammer signature following shut-in.

Example 4: Water Hammer Sensitivity Analysis #4

The following 3 cases evaluate the effect of varying the number of equal-duration rate drops on the water hammer signature. The results are shown in FIG. 39. Case 1 starts at 100 bbl/min, four 25 bbl/min drops, each held for 30 seconds. Case 2 starts at 100 bbl/min, three 25 bbl/min drops, last rate at 5 bbl/min, each held for 30 seconds. Finally, case 3 starts at 100 bbl/min, go half rate (50 bbl/min), hold for 30 seconds. Comparing Case 1 and 2, if a 5 bbl/min step-down is conducted after a larger step-down (20 bbl/min step-down), the prior water hammer signature covers the water hammer signature from the 5 bbl/min step-down. For the water hammer analysis of Case 2, the 5 bbl/min rate slightly reduces the peak/trough magnitude and water hammer shape compared to Case 1. For Case 2, the shut-in water hammer analysis could be considered to start after the 20 bbl/min step-down since the 5 bbl/min step-down had minimal effect on the water hammer signature. For Case 1 and 2, a superpositioning effect is seen for each 25 bbl/min step-down. Both 25 and 50 bbl/min rate reductions with 30 second duration provide clear water hammer signatures. A 25 bbl/min rate drop seems to be sufficient for analysis.

The last rate step should be at least 25 bbl/min to generate a clear water hammer signature. Avoid stepping down the rate to 5 bbl/min. If the service company prefers to use multiple rate step-downs to lessen the impact of shut-down on the pumping equipment, the last step-down should be at a rate of 25 bbl/min or greater. The duration of rate steps should be a minimum of 30 seconds to minimize superpositioning effects of multiple water hammer pulses. Performing the step-down in a consistent way is the most beneficial measure for obtaining meaningful comparisons of water hammer signatures across multiple treatment stages.

Example 5: Perforation Friction

Three cases were simulated for the perforation friction sensitivity analysis (450, 1000, 1500 psi perforation friction). The injection rate starts at 66 bbl/min, is dropped to 33 bbl/min and held for 30 seconds, and then dropped to zero rate to initiate the shut-in period. The results of the evaluation are shown in FIG. 40. As expected, the highest perforation friction case (1,500 psi) had the highest wellhead pressure while pumping at full injection rate. Lower perforation friction equates to higher peaks and deeper troughs as compared to higher perforation friction. During the 30-second hold period of the rate step-down (33 bbl/min), higher perforation friction correlates with greater dampening of the water hammer signature. During the shut-in period, the 1,000 and 1,500 psi perforation friction cases exhibited minimal to no superposition effect from the water hammer signature created from the initial rate reduction. This outcome was the result of signal dampening. For the 450-psi case, there is a slight superposition effect as the water hammer signature from the initial rate reduction was not completely dampened. Initially, the difference between the water hammer peaks and troughs were: 400-500 psi between the 450 and 1,500 psi perforation friction cases. 200 psi between the 1,000 and 1,500 psi perforation friction cases. The pressure difference among the three cases decreases over time with the decay of the water hammer signature. Additional perforation friction dampens the water hammer signature only slightly, and not significantly.

Water Hammer Analysis: Boundary Conditions

A case demonstrating differing boundary conditions is presented for two different types of operations in the same well. FIG. 41 shows the water hammer signature after a perforating event while FIG. 42 shows the water hammer signature after the main hydraulic fracturing treatment. The perforation depth was 9,416 ft. For the perforation event, the period was 4 seconds. Assuming a fluid speed of sound of 5,000 ft/s, the boundary condition factor is 2.1 seconds or approximately 2 as per Equation 3 (4 sec×5,000 ft/s/9,416 ft=2.1). A boundary condition factor of 2 denotes that the boundary condition is a closed inlet and closed outlet. There was nil fracture capacity at the perforations. For shut-in period following the fracturing treatment performed on this well, the period was 8 to 9 seconds. This is double the period for the perforating event. The boundary condition factor was about 4, indicative of a closed inlet and constant pressure outlet. This denotes that the well was in communication with a large capacity hydraulic fracture system. A question still to be further understood is how much fracture capacity is required to switch from a boundary condition factor of 2 to 4.

Another case demonstrating differing boundary conditions is presented for two treatment stages in the same well. Stage 6 had a successfully completed hydraulic fracture treatment with a period of 15 seconds, as shown in FIG. 43. The boundary condition factor for this treatment was 4. Stage 7 had a screen out which resulted in a period of 7 to 8 seconds, as shown in FIG. 44. This was half the period of Stage 6, indicative of a boundary condition of a closed inlet and a closed outlet. The screen out in Stage 7 completely bridged the wellbore and fracture system near the perforations, disconnecting the travel path of the water hammer from the high capacity hydraulic fracture system.

Water Hammer Analysis: Treatment Stage Isolation

Water hammer boundary condition calculations can provide indicators for evaluating isolation among treatment stages in pumpdown diagnostic testing. As described in SPE-201376 (Cramer et al. 2020), pumpdown diagnostics are performed during plug-and-perf horizontal well treatments when isolating a previous treatment stage and perforating a new interval, and they consist of the following activities. Pump down the frac plug and perforating guns. Pressure test the frac plug. Perforate the first cluster, closest to the toe end of the well. Conduct an injectivity test. Perforate the remaining clusters. For FIGS. 45-47, the activity numbering is identified on the charts with associated color coding.

FIGS. 45-47 are pumpdown diagnostic plots for three stages in the same well. FIG. 45 shows a case in which testing confirmed the newly-perforated stage was isolated from the prior treatment stage. During testing, two water hammer signatures occurred, one after the pump down injection and the other after the frac plug pressure test. The dashed line box around the first water hammer signature after the pump down denotes that the boundary condition factor was 4 (closed inlet and constant pressure outlet). This notes there was a connection to a large fracture capacity (the previous stage that was hydraulically fractured). The solid line box around the second water hammer signature after the frac plug pressure test denotes that the boundary condition factor was 2 (closed inlet and closed outlet). This confirms that at this point the wellbore was a closed system with no leakage past the frac plug. The ball successfully seated in the frac plug and a water hammer pulse was generated from the sudden rate termination. After the last three activities (perforation of the first cluster, injectivity test, and perforation of the remaining clusters), there was a gradual decline in pressure with no water hammer signature. Additionally, the fall-off pressures are greater than the extrapolated pumpdown pressure fall-off trendline, when there was still connectivity to the prior stage. When combined, these indications strongly confirmed that the new treatment interval was isolated from the previous treatment interval.

FIG. 46 shows a frac plug failure occurring during pumpdown operations. This is indicated by the extreme pressure drop at the start of the injectivity test. For this stage, there were six water hammer signatures. The first water hammer signature after the pump down had a boundary condition factor of 4, indicating wellbore connection to the large fracture capacity of the prior stage. The second water hammer signature after the frac plug test had a boundary condition factor of 2, indicating that the frac plug achieved isolation from the prior stage. The last four water hammer signatures that occurred after the frac plug failure all had a boundary condition factor of 4, confirming loss of isolation and connection once again to the large fracture capacity of the prior stage.

FIG. 47 shows a stage where a frac ball unseated as indicated by a rapid pressure decline after the perforation of the first cluster. The water hammer signatures for this scenario were the same as the frac plug failure scenario, showing that stage isolation was lost.

Water Hammer Analysis: Casing Failure Depth

For the following case, treatment stage 1 of a well was performed with no noticeable issues. The average injection rate and surface treating pressure for this stage were 65 bbl/min and 9,000 psi, respectively. Treatment stage 2 initially exhibited similar rate and pressure behavior as stage 1. However, 25 minutes into the treatment, the rate and pressure changed significantly, as the rate increased to 90 bbl/min and the surface treating pressure decreased to 7,500 psi. This change indicated that the depth of the fluid moving out of the wellbore could be significantly lower than expected, potentially as a result of a casing failure located far from the perforated interval. FIG. 48 compares the water hammer signature from stage 1 and 2. The period for stage 1 was 20 seconds; the period for stage 2 was 9 seconds.

The boundary condition for this case is closed inlet and constant pressure outlet, so the boundary condition factor was 4. Assuming the fluid speed of sound was 5,000 ft/s, the following measured depths were calculated for periods of 8, 9, and 10 seconds (period sensitivity of +/−1 second to account for the data collection frequency of 1 second). Measured depth of the flow exit is calculated by multiplying the period by the fluid speed of sound and then dividing by the boundary condition factor and the results are shown in Table 4.

TABLE 4

| Measured Depth of Flow Exit | | | |
|---|---|---|---|
| Period (seconds) | 8 | 9 | 10 |
| Measured depth of flow exit (ft) | 10,000 | 11,250 | 12,500 |

Water Hammer Analysis: Excess Period (Excess Length)

In FIG. 48, the period predicted for the perforation depth (18,160 ft) and 5,000 ft/s fluid speed of sound was 14.5 seconds (18,160 ft/5,000 ft/s*4). However, the water hammer signature from stage 1 showed a period of 20 seconds. The excess period was 5.5 seconds (20 s−14.5 s). Excess period can also be expressed as excess length. The predicted length for 20 second period is 25,000 ft (20/4*5,000). Correspondingly, the excess length is 6,840 ft (25,000 ft−18,160 ft). This is an increase of 38% in respect to period or length. Further investigation is required to determine if excess period and the associated excess length value provide indications of hydraulic fracture dimensions or rather fluid/casing property anomalies that reduce the fluid speed of sound. Within the water hammer model described previously, additional length can be added to the perforation depth to account for the excess period. However, as compared to water hammer wave travel in casing, the speed of sound in hydraulic fractures is much slower, highly variable, and difficult to determine (Paige et al. 1992). Consequently, the above calculation for excess length should not be considered as equivalent to fracture length.

Example 6: Water Hammer Analysis in an Unconventional Reservoir

Using the methods described in the sections above, water hammer data was analyzed for 8,831 fracturing stages in 395 wells in a North America unconventional reservoir. The analysis focused on the relationship of water hammer characteristics with the completion design and resulting well productivity. Water hammer data was not available on all stages of every well due to data quality issues. For production analysis, only the wells with water hammer data available on at least 50% of the stages were evaluated.

A high-level summary of the findings from the analysis indicated the following. The water hammer decay rate is most affected by near-wellbore fracture surface area. A higher water hammer decay rate equates to contacting more near-wellbore fracture surface area. A very low water hammer decay rate correlates with lower well productivity. Low water hammer decay rates also correlate with long distance fracture-driven interactions (FDI), also known as frac hits. The water hammer decay rate becomes more variable as the total treatment volume for a well increases. This study was limited to wells within a single field and geologic basin. The relationship of water hammer characteristics such as decay rate with well productivity observed in this field may not be the same in other geologic settings with differing rock properties or in-situ stress distributions. For this analysis, the total number of water hammer periods was used as a proxy for the water hammer decay rate due to ease of calculation and its sufficiency for performing a straightforward comparison among fracturing stages. The terminology of water hammer oscillation characteristics is covered in FIG. 23. As indicated there, the decay rate is inversely proportional to the number of water hammer periods.

As the water hammer pulse travels back and forth within the wellbore and hydraulic fracture system, friction causes it to dampen over time. There are three potential sources of friction that dampen water hammer pulses: Fluid viscosity; Contact with surface area inside the wellbore; and contact with surface area outside the wellbore. Of the three sources, friction due to contact with surface area outside the wellbore and primarily within the hydraulic fracture system is typically dominant and is the primary reason for water hammer decay rates varying for fracturing stages having the same treatment design.

High viscosity fluids, such as crosslinked gel, will cause a water hammer signature to dampen faster. For analysis purposes, this is not typically an issue because in any given well, the same fluid type is used for each fracturing stage. However, this needs to be accounted for when comparing water hammer data between wells that were treated with different fluid types. Even though crosslinked gel stages are flushed with slick water, when the water hammer pulse exits the wellbore, it will travel through the crosslinked gel filling the fractures which can influence the water hammer decay rate.

In this dataset, 5,484 stages were completed with crosslinked gel and 3,347 stages were completed with slick water. When comparing stages that had the same treatment size (2,600 lbs of proppant/ft), it was found that the difference in number of water hammer periods between crosslinked gel and slick water is roughly 0.5 periods, as shown in FIG. 49. When compared to the range of values for number of water hammer periods, a difference of 0.5 periods is small but not negligible.

When evaluating water hammer data for all stages, there is not a clear trend between number of water hammer periods and stage depth. The primary reason for this is that friction within the hydraulic fracture system can have the dominant effect on friction and thus the water hammer decay rate during the post-treatment shut-in period. This is primarily the result of differences in surface area as demonstrated in the following hypothetical example. A wellbore consisting of 5½ in. casing at a measured depth of 20,000 ft has an internal surface area of 24,450 ft2. The cumulative fracture surface area for a stage with 10 perforation clusters, each connected to one smooth-walled, planar fracture extending 75 ft radially from the wellbore is 176,700 ft2. In this example, the fracture surface area is more than seven times greater than the wellbore surface area. It is a conservative estimate of the potential difference. Hydraulic fractures typically extend much farther than 75 ft radially from the wellbore. Field studies indicate that hydraulic fracture systems can be complex, with much greater surface area and fracture-width variation than the simple case presented above (Raterman et al. 2019). The above exercise is continued to demonstrate the relative effects of variations in wellbore and fracture system components on surface area and thus friction. The difference in surface area between the two-fold difference in measured depth of 10,000 and 20,000 ft is 12,225 ft2. The difference in surface area between a stage that treated half fracture per cluster with a stage that treated one fracture per cluster (two-fold difference in the number of fractures) is a conservatively estimated difference of 88,350 ft2. Variation in fracture system properties will have a greater impact on surface area and consequently on friction and water hammer decay rate.

There are qualifications to the above assessment. The data used for this analysis was primarily on wells with 5½ in. 23 lb/ft casing using plug-and-perf completions, with measured depths varying between 11,000 ft and 21,000 ft among all fracturing stages. Perforation friction typically has a minor influence on water hammer characteristics in this style of completion. Yet the situation may be somewhat different for other completion types. For instance, as reported by Iriarte et al. (2017), treatments using the ball-actuated sliding sleeve method of treatment sequencing exhibit relatively high water hammer decay rates due to the sleeve ball seats acting as baffles as the water hammer pulses flow in and out of the wellbore.

As postulated by Ciezobka et al. (2016), water hammer dampening or decay is affected by the degree of fracture connectivity with the wellbore. Being in contact with a greater number of fractures results in more rapid signal dampening or decay since friction is proportional to fracture surface area and complexity. This case is exemplified in comparing FIG. 50*a*. and FIG. 50*b*. with FIG. 50*c*. and FIG. 50*d*. Being in contact with fewer fractures or a less complex fracture network results in less friction and slower signal dampening or decay. Two relationships observed in analyzing the case study data support the above postulation. Wells with very low water hammer decay rates typically have poorer well productivity. Low water hammer decay rates also correlate with instances of long-distance FDI's, i.e., frac hits resulting from creating fewer and longer hydraulic fractures.

A related observation was that the water hammer decay rate became more variable as the volume of fracturing fluid and proppant per lateral foot treatment size increased. This relationship is shown in FIG. 51. Increases in treatment volume were the result of increasing the number of perforation clusters (fracture initiation points) per foot of lateral or increasing the treatment volume (proppant and fluid) per cluster. Although these tactics can lead to increased fracture density, cumulative fracture surface area and water hammer decay rate, they can also lead to increased communication among clusters and proppant bridging within less advantaged fractures (Cramer et al. 2020). The latter outcomes will reduce the number of active hydraulic fractures, forcing more volume into fewer fractures which decreases cumulative fracture surface area, friction acting on the water hammer pulse, and the water hammer decay rate.

Of all variables analyzed, treatment volume per foot of lateral had the strongest correlation with the number of water hammer periods per stage. As shown in FIG. 52, wells characterized by low average water hammer decay rates (red bar) typically had much longer-reaching FDI's. FDI's were determined by identifying pressure increases in passive offset wells that were synchronous with treatments being performed in the active analyzed well. The data in FIG. 52 is from 68 wells that had the same perforation cluster spacing, number of clusters and proppant volume for each treatment stage. The cutoff used for low decay rate was six or more water hammer periods per treatment stage and the cutoff for high decay rate was four or fewer periods per treatment stage. This data suggests that for a given treatment volume, treatments with low water hammer decay rates are associated with the creation of fewer, longer, less complex fractures, resulting in less cumulative fracture surface area.

Wells that have very low water hammer decay rates commonly exhibit lower well productivity, underperforming by 10% to 20% as compared to wells with higher water hammer decay rates. The cutoff used for determining a very low decay rate depended on the size of the treatment. For the wells in this data set, treatments characterized by 3,200 lbs of proppant/ft of lateral were considered to have a very low decay rate if it had an average of seven or more water hammer periods per treatment stage. Treatments characterized by 2,600 lbs of proppant/ft of lateral, six or more water hammer periods per treatment stage was classified as a very low decay rate.

FIG. 53 and FIG. 54 show the relationship of well performance to water hammer decay for the two treatment-volume categories. Type curve expectation is the 35-year estimated ultimate recovery (EUR) for each well. It is based on a correlation of geologic, petrophysical and treatment characteristics with historical well productivity in the area. The results for both groupings show that well productivity is lower on wells that have longer-lasting water hammers, and substantially lower for instances of very low water hammer decay rate as defined previously.

Example 7: Automated ISIP Calculation

ISIP, or Instantaneous Shut-In Pressure, is the pressure measured at the end of injection of hydraulic stimulation, after friction forces in the wellbore, perforations and near-wellbore region dissipate. ISIP data is a valuable source of insights on local stress conditions and geometrical characteristics of induced fractures and is systematically gathered during hydraulic fracturing operations at no additional cost. Using geophysical signal processing methods we can automate calculations of ISIP by isolating water-hammer oscillations from the pressure fall-off behavior due to leak-off, the latter being represented by an exponential decay equation enabling the estimation of not only shut-in pressure but also the maximum rate of pressure decay. The technique was applied to a large subset of wells in the Eagle Ford reservoir and was then compared to the values of ISIP manually calculated by the frac engineer, as well as more traditional algorithms, such as linear interpolation. This technique models the end of stage pressure as the sum of a water hammer added to an underlying slow pressure decay, as illustrated in FIG. 55. The water hammer is seen as a damped harmonic oscillator, which is caused by pressure reverberations traveling through the pipe at the speed of sound. The exponential pressure decay is caused by fluid slowly leaking off through the formation and its fractures. In rare situations, the water hammer is not present in the pressure response. In these cases, only the exponential decay can be modeled.

The total pressure response P may be written as the sum of the water hammer pressure PWH and exponential falloff pressure, PE, where, $$P_\mathrm{WH}=Me\hat{}(-\gamma t)\cos(\omega t-\theta) \quad \text{(Eq. 19)}$$

$$P_E=b\ e\hat{}(-\mathrm{at})+c. \quad \text{(Eq. 20)}$$

Where M is the magnitude of the water hammer (which may be 0); $\gamma$ is its damping factor; $\omega$ is its frequency in radians per time, and $\theta$ is its phase in radians. The parameter b is the magnitude of the exponential pressure decay; a is its decay factor, and c is its steady-state value. All these parameters are to be determined from the analysis which follows. Once this is done, the ISIP can be obtained from b+c, and the initial rate of pressure decline from a·b. The variable t is the elapsed time since the start of shut-in.

The method of obtaining the ISIP and initial rate decay is based on a time series of pressure measurements recorded at the well head or bottom hole. It is assumed that the time series is sampled at a uniform rate, without gaps, at a sufficiently high rate as to prevent aliasing. For most unconventional well completions, a sampling rate of 1 Hz or greater should be adequate. Furthermore, it is assumed that the data is recorded with sufficient precision so that quantization errors are an insignificant percentage of the total signal power. A recording system that automatically scales the data so that it always fits within the dynamic range of the instrument is desirable. It is also assumed that the time series starts at or near the shut-in of the well after a stage completion. This starting time is usually easy to obtain from the moment the slurry rate falls below a certain threshold. If this method is inadequate for determining the starting time, the reader is referred to Alwarda, et. al (SPE-201488-MS).

It is sometimes the case, particularly after the last stage of a job, that the pressure sensor or connection to the recording system is removed prematurely, before the water hammer has had time to dissipate. Such a situation occurred in FIG. 56. In such an instance, it is important to include only that portion of the data which is usable, as shown. Simple examples like this can easily be handled automatically by truncating any sequence of pressures of some specified minimum length, whose pressures remain constant within a specified minimum tolerance.

We have found it useful to filter out high frequency components of the data prior to further analysis. We use a fourth-order autoregressive Butterworth filter with a cutoff frequency of 0.10 Hz. The filter is run in both the forward and reverse directions to ensure that the phase of the data remains unchanged. FIG. 57*a* compares the spectral magnitude of a typical time series before and after filtering. FIG. 57*b* compares the time series itself before and after filtering. This filtering removes the higher frequency components of the data which are not relevant for modeling the pressure response, while preserving the components which are relevant. The resonant frequency of the water hammer can be determined from a careful analysis of the Fourier spectrum of the time series. In FIG. 57*a*, a very large spike occurs near zero frequency, due to the fact that wellhead pressures have a large steady-state component. However, when a water hammer is present, there is a local minimum in the spectrum (in this case around 0.02 Hz), followed by a local maximum at around 0.06 Hz. The local maximum is due to the water hammer resonance.

A robust procedure to determine the resonant frequency is to first locate the first local spectral minimum ($f_{min}$) which is less than some maximum frequency $f_{max}$ (say 0.25 Hz) that we can be reasonably expect to exceeds the resonant frequency ($f_{pea}$k). Once $f_{min}$ is located, then search for the next global spectral maximum frequency ($f_{pea}$k) that is less than $f_{max}$. This process is illustrated in FIG. 4*a*. Additional precision may be obtained by interpolating the resonant frequency between samples of the Discrete Fourier Transform (the black dots in FIG. 58*b*). A parabola is constructed through the maximum DFT sample and its two nearest neighbors. The location of the maximum of this parabola is determined analytically, and this becomes the final estimate of the resonant frequency of the water hammer. The resonant radial frequency is then $\omega=f_{max}/2\pi$. Furthermore, if we interpolate the complex spectrum (from which the spectral magnitude is calculated) at the resonant frequency ($\omega$), the result will be a complex number whose phase is that of the water hammer ($\theta$).

Once the resonant frequency and phase of the water hammer is known, it is an easy matter to calculate the times of all its peaks, troughs and zero crossings. These are displayed in FIG. 59. In most cases, the peaks and troughs calculated in this manner are adequate for computing the magnitude and damping factor of the water hammer. However, in rare situations, the time of a peak or trough needs to be adjusted within a narrow tolerance, in order the capture its true value. This was the case for the water hammer shown in FIG. 59. A comparison of the filtered data (black) with the raw peaks (orange) and troughs (blue) as computed from the resonant frequency and phase of the water hammer. In this case, an adjustment of these peaks and troughs made a noticeable difference only in the first trough.

Once the peaks and troughs are obtained, they can be collected into adjacent pairs. The magnitude of the peak-trough excursion of every pair can then be plotted against their corresponding zero crossing times, as shown in FIG. 60. When plotted on a semi-logarithmic grid, these excursion magnitudes are expected to correlate with a straight line. The time-zero intercept of this line represents the water hammer magnitude (M), and its slope represents its damping factor ($\gamma$).

Magnitudes of peak-trough pressure differences for the water hammer of FIG. 59. The red line is the linear regression of the logarithm of the pressure differences. The water hammer is now completely characterized by Eq. 19 and its parameters M, $\gamma$, $\omega$ and $\theta$. A modeled version of the water hammer can thus be calculated at every time sample and subtracted from the actual filtered data. This leaves an estimated pressure decay curve shown in FIG. 61, which we intend to model via Eq. 20 and its parameters, a, b, and c.

In this section we model the blue pressure decay curve from FIG. 61 according to Eq. 20. This curve has a sudden anomalous dip near time zero. We have observed such a dip quite frequently, and attribute it to the details of how the well was shut in. Since we do not wish this anomaly to influence our parameterization of the pressure decay, we exclude data prior to $t_{min}$=10 seconds.

In general, we are given an incomplete portion of an exponential decay function, as shown in the figure on the left. If we sample it three times at sampling spacing $\tau$ we obtain the sampled values $\{v_0, v_1, v_2\}$. This gives us three equations to obtain the three unknown parameters, {a,b,c}. However, since the equations are nonlinear, the usual methods of linear algebra do not apply. The solution is apparent once one realizes that the ratio $$R=(v_1-v_2)/(v_0-v_1) \quad \text{(Eq. 21)}$$

is independent of both b and c, and is equal to $e^{-a\tau}$ for all $t_0$. Thus $a=-\ln(R)/\tau$. Once a is known, b and c can be obtained from $$b=(v_0-v_2)(v_1-v_2)(v_0-v_1)e^{at_0}/[(v_0-v_1)^2-(v_1-v_2)^2] \quad \text{(Eq. 22)}$$

$$c=-be^{-at_o} \quad \text{(Eq. 23)}$$

Although this solution is explicit and exact, it is not a robust solution for real data for two reasons: It is based on only 3 samples of the function. We need a procedure which averages all of the samples of the data, and can give reasonable results even if the data only approximates the modeled function. Equations (22) and (23) involve a division by an unaveraged quantity. This can lead to instabilities and large (possibly infinite) amplifications of noise. For these reasons it was necessary to augment equations 3-5 with a statistical averaging technique. Let our estimated pressure response (blue curve in FIG. 61) be denoted as v(t), where t takes on integer multiples of the sampling interval within the range $t_{min}\leq t\leq t_{max}$. Let R(r) be defined as the function $$R(\tau)=\frac{\Sigma v(t)-v(t+\tau)}{\Sigma v(t-\tau)-v(t)}, \quad \text{(Eq. 24)}$$

where t takes on integral multiples of the sampling interval within $$0 < \tau_{min} \leq \tau \leq \frac{(t_{max} - t_{min})}{2},$$

where tmin, tmax and tmin are all user-defined parameters. All summations are over times within the range $t_{min}+\tau \leq t \leq t_{max}-\tau$. If the data conforms to the model (Eq. 20), then $v(t)=be^{-at}+c$ and $R(\tau)=e^{-a\tau}$ as with equation (21). We can therefore estimate the parameter a to be $$\hat{a} = -\langle [\ln R(\tau)]/\tau \rangle \quad \text{(Eq. 25)}$$

where brackets < > denote an average over the permissible range of t's.

In a similar vein, we can define the function Q(t) to be analogous to equation (23):

$$Q(\tau) = \frac{\Sigma[v(t-\tau) - v(t+\tau)][v(t) - v(t+\tau)][v(t-\tau) - v(\tau)]}{\Sigma\{[v(t-\tau) - v(t)]^2 - [v(t) - v(t+\tau)]^2\}} \quad \text{(Eq. 26)}$$

If $v(t)=be^{at}+c$, then $Q(\tau)=b/K$, where K is the constant (independent of t and $\tau$):

$$K = \frac{\Sigma e^{-2at}}{\Sigma e^{-3at}} \quad \text{(Eq. 27)}$$

Note that K is a constant because a is known and the summation is over t. Our estimate of b becomes $\hat{b}=K\langle Q(\tau)\rangle$. Once a and b are both determined, the parameter c (final shut-in pressure) is found by taking the average overt of $v(t)-b\,e^{-\hat{a}t}$. When this procedure is applied to the estimate pressure response of FIG. 61 (excluding the first 10 seconds), the result is the red curve found in FIG. 62. A comparison between the filtered data (black), the estimated pressure response (blue) and the modeled pressure response (red). The modeled and estimated pressure responses lie exactly on top of each other for most of the time series. This is an indication that the model is a good approximation of the data. The pressure asymptotically approaches the final shut-in pressure (c), shown as a dotted purple line. The estimate of the ISIP is found by evaluating the modeled pressure response at time zero, and is shown as a green dot in this figure.

A slightly more robust method of estimating ISIP is to use a quadratic fit, also known as a second order polynomial fit. The quadratic fit should be applied to the smooth fall-off pressure data after the water hammer has dampened out. Just as with the linear fit method, the quadratic fit can be extrapolated back to the time when the pumps were shut down to estimate the ISIP.

One limitation of the quadratic fit is that it will tend to curve significantly upwards or downwards. To avoid this causing data quality issues, the following guidelines are recommended for the number of points to generate the quadratic fit: a minimum of 70 seconds of smooth fall-off pressure data. If not enough data is used, the quadratic fit can become unstable. a maximum of around 300 seconds or less of smooth fall-off pressure data. If too much data is used, for example 3,000 seconds worth of data, it will also cause issues with erroneous ISIP calculations.

The quadratic fit method can also be used to extrapolate the value of 5-minute shut-in pressure in cases where the wellhead pressure was bled off too soon or in cases where the pressure data stops too soon. However, it is recommended to not extrapolate the quadratic fit data farther than 60 seconds beyond the end of the available data to avoid introducing too much error in the estimate. To evaluate how far the quadratic fit can be extrapolated before the error becomes too large, data can be taken from stages where more than enough pressure data is available and the quadratic fit can be calculated on a small portion of that data. The resulting quadratic fit can then be compared against the actual pressure data to measure the amount of error generated in the estimate.

In addition, the water hammer and pressure fall-off response can be estimated with techniques common to geophysical signal processing:

- Determine the resonant frequency of the water hammer from its Fourier spectrum;
- Interpolate the complex Fourier transform of the water hammer at its resonant frequency to determine its phase;
- Obtain the times of the peaks, troughs, and zero crossings from the resonant frequency and phase;
- Perform a linear regression of the log peak-trough differences versus their zero-crossing times;
- Obtain a model of the water hammer from its frequency, phase, initial amplitude and decay rate obtained from linear regression;
- Subtract the modeled water hammer from the post shut-in data to obtain the estimated pressure fall-off response;
- Perform a nonlinear regression of the estimated pressure fall-off response to obtain the ISIP, rate of pressure decay, and final shut-in pressure.

The end of stage pressure response (during the shut-in period) has two components: Water hammer: dampened harmonic oscillator and Pressure fall-off: exponential decay.

The following are the ISIP observations for these two wells: Per stage, the pressure spread was 100 to 800 psi. Removing stage 1 of well #2 which had the 800 psi spread, the pressure spread for the other stages was 100 to 500 psi.

The general trend from lowest to highest ISIP value was Frac Engineer, Linear Fit, Quadratic Fit, and Signal Processing. The Linear Fit was generally expected to be the lowest ISIP pick out of the Quadratic and Signal processing since the Linear Fit does not account for the reduction in fall-off rate depending upon the points used for the linear extrapolation. The Signal processing was generally expected to be the highest ISIP pick out of the Linear and Quadratic fit since it accounts for and removes the water hammer signature to determine the fall-off pressure response.

75% of the frac engineer ISIP picks were the lowest ISIP values. The reason may be that the frac engineer is generally using the linear fit method and selecting points further out in the shut-in period. For the ConocoPhillips Linear Fit selection algorithm, the points selected are generally within 1.5-2 minutes into the shut-in period; however, if the water hammer continues during this time range, the algorithm pushes the time period out till the water hammer is dampened out sufficiently.

The remaining 25% of the frac engineer ISIP picks varies in the range. With various frac engineers, various methods may be used to select ISIP manually. (Note: The frac engineer pick observations are based on these two wells from a particular frac vendor. For different frac vendors and frac engineers, observations may vary.) 87% of the signal processing ISIP picks were the highest ISIP values. Removing the frac engineer ISIP picks, 97% of the signal processing ISIP picks were the highest ISIP values.

FIGS. 64-67 compare the various ISIP selection methods for Well #2 Stage #7. FIG. 64 plots the ISIP pick and the curve fit (exponential, quadratic, linear fit) used to make the ISIP pick on the shut-in pressure data. FIG. 65 flattens out the water hammer by removing curve fit used to make the ISIP pick. FIG. 66 plots the absolute value of the flattened water hammer. For this stage, this figure shows that the signal processing method does the best job fitting the middle of the water hammer. FIG. 67 plots the ISIP pick and the curve fit used to make the ISIP pick on the shut-in pressure data for Well #2 Stage #1 which had the highest pressure spread. For this stage with a high pressure fall-off, visually it can be assessed that the Linear and Quadratic method underestimates the ISIP.

Automatic determination of ISIP provides a unique opportunity to characterize the in-situ stress regime (in-situ and altered) and assess net fracturing pressure. Quantify stress changes caused by depletion, refracturing, and the sequencing of fracturing operations across multiple wells, and hence help optimizing multi-well spacing/sequencing. Evaluation fracture height from escalation of ISIPs during consecutive fracturing stages and faulting. These analyses that are contingent on good evaluation of ISIP (step-down, fall-off) along with calibration/verification of hydraulic fracturing model.

Improvements continue with pressure difference between fractures/clusters, comparison with ISIP, quantifying "success rate" in calculating ISIP value based on method compared to other automated methods, quantify error/variability in frac vendor pick compared to signal processing picks. As the volume of data increases, models will accurately predict in real time ISIP, stress fractures, and fracturing success allowing modification of the fracturing process in real time.

In conclusion, setting data requirements with service companies and data aggregation companies will lead to obtaining high quality data for water hammer analysis. The numerical water hammer model presented in the paper provides insight into physical processes associated with water hammer waveforms and is a vehicle for sensitivity testing of wellbore and treatment variables to evaluate the corresponding effect on water hammer signatures. Using a consistent injection-rate step-down process at the end of fracturing treatments leads to more reliable results when comparing water hammer characteristics among multiple treatments and wells. The water hammer decay rate is affected by pipe friction and friction in hydraulic fracture network. Continuing to pump during a water hammer, as is done during the injection rate step-down process at the end of treatments, increases the decay rate. During the shut-in period, there is no active pumping. However, there is still friction from the back-and-forth movement of fluid within the wellbore/fracture system that affects decay rate. When fluid viscosity, friction reducer effectiveness, and pipe geometry are consistent among treatments being evaluated, pipe friction has a smaller impact on variations in the water hammer decay rate as compared to friction in the fracture network. The water hammer decay rate appears to be mostly influenced by the fracture surface area near the wellbore. High decay rates are an indication of a large amount of near-wellbore fracture surface area and low decay rates indicate less near-wellbore fracture surface area. For the wells analyzed in the unconventional reservoir case study data set, low water hammer decay rates correlated with relatively lower well productivity and long FDI's. Optimal water hammer characteristics as related to well productivity may vary across fields and completion design types. Consequently, water hammer comparative analysis studies should be limited to specific completion styles, and geographic and geologic settings.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 9,988,895, US-2015-0176394 (Roussel, et al.) "Method for Determining Hydraulic Fracture Orientation and Dimension" (2015).
2. U.S. Ser. No. 10/753,181, US-2018-0148999 (Roussel) "Methods for Shut-in Pressure Escalation Analysis" (2018).
3. U.S. Ser. No. 10/801,307, US-2018-0149000 (Roussel, Lessard) "Engineered Stress State with Multi-Well Completions" (2018).
4. US-2019-0120047 (Ge, Baishali) "Low Frequency Distributed Acoustic Sensing Hydraulic Fracture Geometry" (2019).
5. US-2019-0346579 (Roussel, et al.) "Ubiquitous Real-Time Fracture Monitoring" (2019).
6. US-2020-0003037 (Roussel) "Measurement of Poroelastic Pressure Response" (2020).
7. Alwarda, et. al (SPE-201488-MS)
8. Bakku, S. K., Fehler, M., and Burns, D. 2013. Fracture compliance estimation using borehole tube waves. *Geophysics* 78(4): D249-D260.
9. Carey, M. A., Mondal, S. and Sharma, M. M. 2015. Analysis of Water Hammer Signatures for Fracture Diagnostics. SPE-174866-MS, Annual Technical Conference and Exhibition, 28-30 September, Houston, Texas, USA.
10. Carey, M. A., Mondal, S., Sharma, M. M. and Hebert, D. B. 2016. Correlating Water Hammer Signatures with Production Log and Microseismic Data in Fractured Horizontal Wells. SPE-179108-MS, Hydraulic Fracturing Technology Conference and Exhibition, 9-11 February, The Woodlands, Texas, USA.
11. Ciezobka, J., Maity, D., and Salehi, I. 2016. Variable Pump Rate Fracturing Leads to Improved Production in the Marcellus Shale. SPE-179107-MS, Hydraulic Fracturing Technology Conference and Exhibition, 9-11 February, The Woodlands, Texas, USA.

12. Clark, C. J., Miskimins, J. L., and Gallegos, D. L. 2018. Diagnostic Application of Borehole Hydraulic Signal Processing. URTeC-2902141, Unconventional Resources Technology Conference, 23-25 Jul. 2018, Houston, Texas, USA.
13. Cramer, D. D., Snyder, J., Zhang, J. 2020. Pump-Down Diagnostics for Plug-and-Perf Treatments. SPE-201376-MS, SPE Virtual Annual Technical Conference and Exhibition. 27-29 October.
14. Dunham, E M., Harris, J. M., Zhang, J., Quan, Y. and Mace, K. 2017. Hydraulic Fracture Conductivity Inferred from Tube Wave Reflections. SEG-2017-17664595, SEG International Exposition and Annual Meeting, 24-29 September, Houston, Texas, USA.
15. Holzhausen, G., Branagan, P, Egan, H., and Wilmer, R. 1989. Fracture Closure Pressures from Free-Oscillation Measurements During Stress Testing in Complex Reservoirs. *Int. J. Rock Mech. Min. Sci. & Geomech.* 26 (6): 533-540.
16. Holzhausen, G. R. and Egan, H. N. 1986. Fracture Diagnostics in East Texas and Western Colorado Using the Hydraulic-Impedance Method. SPE-15215-MS, Unconventional Gas Technology Symposium, 18-21 May, Louisville, Kentucky, USA.
17. Holzhausen, G. R. and Gooch, R. P. 1985. Impedance of Hydraulic Fractures: Its Measurement and Use for Estimating Fracture Closure Pressure and Dimensions. SPE-13892-MS. Low Permeability Gas Reservoirs, 19-22 May, Denver, Colorado, USA.
18. Hwang, J., Szabian, M. J., and Sharma, M. M. 2017. Hydraulic Fracture Diagnostics and Stress Interference Analysis by Water Hammer Signatures in Multi-Stage Pumping Data. URTeC-2687423. Unconventional Resources Technology Conference, 24-26 Jul. 2017, Austin, Texas, USA.
19. Iriarte, J., Merritt, J., and Kreyche, B. 2017. Using Water Hammer Characteristics as a Fracture Treatment Diagnostic. SPE-185087-MS, Oklahoma City Oil and Gas Symposium, 27-30 March, Oklahoma City, Oklahoma, USA.
20. Liang, C., O'Reilly, O., Dunham, E M., & Moos, D. (2017). Hydraulic fracture diagnostics from Krauklis-wave resonance and tube-wave reflections. *Geophysics* 82(3): D171-D186.
21. Ma, X., Zhou, F., Ortega Andrade, J. A., Gosavi, S. V., and Burch, D. 2019. Evaluation of Water Hammer Analysis as Diagnostic Tool for Hydraulic Fracturing. URTeC-2019-935, Unconventional Resources Technology Conference, 22-24 Jul. 2019, Denver, Colorado, USA.
22. Mondal, S. 2010. *Pressure Transients in Wellbores: Water Hammer Effects and Implications*. PhD Dissertation, The University of Texas at Austin.
23. Nguyen, D., et al., "Practical Applications of Water Hammer Analysis from Hydraulic Fracturing Treatments," SPE-204154-MS, 2021 SPE Hydraulic Fracturing Technology Conference.
24. Operators Group for Data Quality, "Operators Group for Data Quality"-"CONTRACT ADDENDUM", www.OGDQ.org.
25. Paige, R. W., Murray, L. R., & Roberts, J. D. 1995. Field Application of Hydraulic Impedance Testing for Fracture Measurement. SPE-26525-PA, *SPE Production & Facilities* 10(1):7-12.
26. Paige, R. W., Roberts, J. D., Murray, L. R., and Mellor, D. W. 1992. Fracture Measurement Using Hydraulic Impedance Testing. SPE-24824-MS, Annual Technical Conference and Exhibition, October 4-7, Washington, DC, USA.
27. Raterman, K., Liu, Y., Warren, L. 2019. Analysis of a Drained Rock Volume: An Eagle Ford Example. URTeC-2019-263, Unconventional Resources Technology Conference, 31 July, Denver, Colorado, USA.
28. Roussel, "Analyzing ISIP Stage-by-Stage Escalation to Determine Fracture Height and Horizontal-Stress Anisotropy," SPE-184865-MS (2017).
29. Roussel, "Stress Shadowing Fracture Diagnostics: Informing Spacing/Completion Design Cheaper and Faster," American Rock Mechanics Association (2021).
30. Sneddon, I. N. 1946. The Distribution of Stress in the Neighborhood of a Crack in an Elastic Solid. *Proc. R. Soc. Lond.* A187 (1009): 229-260.
31. Zhang, J., et al., "Investigating Near-Wellbore Diversion Methods for Re-stimulating Horizontal Wells," SPE HFTC, Near Wellbore Diversion (2020).

The invention claimed is:

1. A method for completing a hydrocarbon well where the process comprises:
- installing a wellbore in a hydrocarbon reservoir said wellbore having a wellbore configuration;
- sealing the wellbore;
- fracturing the wellbore by increasing pump pressure;
- shutting off the pump pressure; and
- performing a water hammer sensitivity analysis comprising:
  - identification of a shut-in period;
  - identification of one or more water hammer peaks and troughs;
  - calculation of one or more water hammer periods;
  - calculation of a number of said water hammer periods; and
  - calculation of one or more water hammer decay rates;
  - said water hammer sensitivity analysis utilizing a simulator based on fundamental fluid-mechanics to model water hammer responses for said wellbore configuration and treatment to obtain a consistent, identifiable oscillatory response.

2. The method of claim 1, wherein said shutting off of the pump pressure creates a final pressure step-down of 25 bbl/min or greater.

3. The method of claim 1, wherein said water hammer sensitivity analysis measures perforation friction, treatment stage isolation, boundary conditions, casing failure depth, or a combination thereof.

4. The method of claim 1, wherein said water hammer sensitivity analysis is compared to a database of water hammer signatures to estimate well parameters selected from near-wellbore fracture surface area, fracture quality, well productivity, or a combination thereof.

5. A method for fracturing a hydrocarbon well where the process comprises:
- sealing a hydrocarbon wellbore, said wellbore having a wellbore configuration;
- fracturing the wellbore by increasing pump pressure;
- shutting off the pump pressure;
- performing a water hammer sensitivity analysis comprising:
  - identification of a shut-in period;
  - identification of one or more water hammer peaks and troughs;
  - calculation of one or more water hammer periods;
  - calculation of a number of said water hammer periods; and calculation of one or more water hammer decay rates;

said water hammer sensitivity analysis utilizing a simulator based on fundamental fluid-mechanics to model water hammer responses for said wellbore configuration and treatment to obtain a consistent, identifiable oscillatory response; and calculating an instantaneous shut-in pressure (ISIP); and identifying one or more fracturing patterns from an ISIP signature.

6. The method of claim 5, wherein said one or more fracturing patterns identifies a successful fracture, an unseated ball, or a leak in the wellbore.

7. The method of claim 5, wherein said ISIP signature is calculated via a Linear Method, Quadratic Method, or Signal processing.

8. The method of claim 5, wherein said ISIP signature is used to characterize an in-situ stress regime, assess net fracturing pressure, fracturing dimensions, or a combination thereof.

9. The method of claim 5, wherein said ISIP signature is used to improve fracture parameters for subsequent fractures.

* * * * *